US007040706B2

(12) United States Patent
Koffler

(10) Patent No.: US 7,040,706 B2
(45) Date of Patent: May 9, 2006

(54) SEAT AND METHOD OF MAKING SAME

(75) Inventor: Adam J. Koffler, St. Louis Park, MN (US)

(73) Assignee: Phat Cushion LLC, Las Vegas, NV (US)

( * ) Notice: Subject to any disclaimer, the term of this patent is extended or adjusted under 35 U.S.C. 154(b) by 0 days.

(21) Appl. No.: 10/731,876

(22) Filed: Dec. 9, 2003

(65) Prior Publication Data

US 2004/0160111 A1 Aug. 19, 2004

Related U.S. Application Data

(60) Provisional application No. 60/432,181, filed on Dec. 9, 2002.

(51) Int. Cl.
*A47C 7/18* (2006.01)

(52) U.S. Cl. ..... 297/452.25; 297/452.21; 297/452.22; 297/452.26; 297/452.27; 297/452.32; 297/452.33

(58) Field of Classification Search ..... 297/452.22, 297/452.23, 452.25, 452.26, 452.33, 452.32, 297/452.31, 452.29, 452.21, 452.27
See application file for complete search history.

(56) References Cited

U.S. PATENT DOCUMENTS 3,647,260 A * 3/1972 Grant et al. ..... 297/229
3,713,696 A * 1/1973 Dudley ..... 297/452.32 X
3,812,225 A 5/1974 Hosoda et al.
4,085,239 A 4/1978 Briston et al.
4,203,815 A 5/1980 Noda et al.
4,418,483 A 12/1983 Fujita et al.
4,452,920 A 6/1984 Joubert
4,522,447 A * 6/1985 Snyder et al. ..... 297/452.27
4,588,229 A * 5/1986 Jay ..... 297/452.25

(Continued)

FOREIGN PATENT DOCUMENTS

EP 0071662 A1 2/1983

(Continued)

OTHER PUBLICATIONS

"Flame Retardants Buyers' Guide", *American Dyestuff Reporter*, vol. 85, No. 1, By ADR Staff, (Jan. 1996), 15-31.

(Continued)

*Primary Examiner*—Rodney B. White
(74) *Attorney, Agent, or Firm*—Schwegman, Lundberg, Woessner & Kluth, P.A.

(57) ABSTRACT

The present invention provides a seat that includes a seat comfort zone that peripherally encompasses a pelvic zone, a front seat zone adjacent to the front side of a seat comfort zone and a first side seat zone, second side seat zone and rear seat zone peripherally encompassing a first side, second side and rear side, respectively, of the seat comfort zone. The seat comfort zone, the pelvic zone, the first side seat zone, the second side seat zone, the front seat zone and the rear seat zone include a soft elastic material. Further, the front seat zone is less firm than the first side seat zone, the second side seat zone, the rear seat zone, the seat comfort zone and the pelvic zone. The first side seat zone, the second side seat zone and the rear seat zone are more firm than the front seat zone, the seat comfort zone and the pelvic zone. The pelvic zone is more elastic than the front seat zone, the comfort zone, the first side seat zone, the second side seat zone and the rear seat zone.

52 Claims, 5 Drawing Sheets

U.S. PATENT DOCUMENTS

| | | | | | |
|---|---|---|---|---|---|
| 4,643,481 | A | * | 2/1987 | Saloff et al. | 297/452.25 |
| 4,655,962 | A | | 4/1987 | Rowland et al. | |
| 4,692,475 | A | | 9/1987 | Rowland et al. | |
| 4,693,772 | A | | 9/1987 | Douglas | |
| 4,718,727 | A | * | 1/1988 | Sheppard | 297/452.26 |
| 4,726,624 | A | * | 2/1988 | Jay | 297/452.25 |
| 4,951,334 | A | * | 8/1990 | Maier | 297/452.21 X |
| 5,018,790 | A | * | 5/1991 | Jay | 297/452.26 |
| 5,163,737 | A | * | 11/1992 | Navach et al. | 297/452.25 |
| 5,206,075 | A | | 4/1993 | Hodgson, Jr. | |
| 5,246,783 | A | | 9/1993 | Spenadel et al. | |
| 5,272,236 | A | | 12/1993 | Lai et al. | |
| 5,278,272 | A | | 1/1994 | Lai et al. | |
| 5,322,728 | A | | 6/1994 | Davey et al. | |
| 5,378,045 | A | * | 1/1995 | Siekman et al. | 297/452.25 |
| 5,380,810 | A | | 1/1995 | Lai et al. | |
| 5,395,162 | A | * | 3/1995 | Jay et al. | 297/452.25 |
| 5,441,331 | A | * | 8/1995 | Vento | 297/452.33 |
| 5,457,833 | A | * | 10/1995 | Jay | 297/452.25 X |
| 5,513,899 | A | * | 5/1996 | Michaels et al. | 297/452.25 X |
| 5,522,106 | A | * | 6/1996 | Harrison et al. | 297/452.25 X |
| 5,630,240 | A | * | 5/1997 | Matsuoka et al. | 297/452.25 X |
| 5,671,977 | A | * | 9/1997 | Jay et al. | 297/452.25 X |
| 5,836,025 | A | * | 11/1998 | Poncy, Sr. | 297/452.22 X |
| 5,869,164 | A | * | 2/1999 | Nickerson et al. | 428/76 |
| 6,027,171 | A | * | 2/2000 | Partington et al. | 297/452.22 X |
| 6,082,824 | A | * | 7/2000 | Chow | 297/452.22 X |
| 6,089,657 | A | * | 7/2000 | Banno et al. | 297/452.27 X |
| 6,142,573 | A | * | 11/2000 | Harding et al. | 297/452.25 |
| 6,221,928 | B1 | | 4/2001 | Kozma et al. | |
| 6,241,320 | B1 | * | 6/2001 | Chew et al. | 297/452.26 |
| 6,242,503 | B1 | | 6/2001 | Kozma et al. | |
| 6,262,137 | B1 | | 7/2001 | Kozma et al. | |
| 6,371,562 | B1 | * | 4/2002 | Yoshimura et al. | 297/452.25 X |
| 6,481,801 | B1 | * | 11/2002 | Schmale | 297/452.27 |
| 6,502,263 | B1 | * | 1/2003 | Rowley et al. | 297/452.25 X |
| 6,625,830 | B1 | * | 9/2003 | Lampel | 297/452.26 X |
| 6,830,799 | B1 | | 12/2004 | Duffin et al. | |
| 2004/0155512 | A1 | * | 8/2004 | Nakamura | 297/452.26 |
| 2005/0081980 | A1 | | 4/2005 | Koffler et al. | |

FOREIGN PATENT DOCUMENTS

| | | | |
|---|---|---|---|
| EP | 0425695 | | 5/1991 |
| EP | 0726290 | A1 | 8/1996 |
| FR | 2488829 | | 2/1982 |
| JP | 61-055126 | | 3/1986 |
| WO | WO-90/03414 | | 4/1990 |
| WO | WO-9858992 | A1 | 12/1998 |

OTHER PUBLICATIONS

"Rubber—Definition", www.m-w.com, Merriam Webster Dictionary—Online, (Archived Dec. 1, 1998), Online.

ARCAT, "Arcat Home Page", www.arcat.com.

Babrauskas, Vytenis, "Fire hazard comparison of fire-retarded and non-fire-retarded products", *Book, Gaithersburg, MD :Washington, DC : U.S. Dept. of Commerce, National Bureau of Standards*, (1988), 86 pages.

Bennett, H., "Antioxidant—Definition", *Concise chemical and technical dictionary*, 4th enl. ed. English Book xxxviii, 1271 p. :ill. ; 25 cm. New York, N.Y.: Chemical Pub. Co., ISBN: 0820602043, (1986), 116.

Bennett, H., "Blowing Agent—Definition", *Concise chemical and technical dictionary*, 4th enl. ed. English Book xxxviii, 1271 p. :ill.; 25 cm. New York, N.Y.: Chemical Pub. Co., ISBN: 0820602043, (1986), 212.

Bennett, H., "Cross-Linking Agent—Definition", *Concise chemical and technical dictionary*, 4th enl. ed. English Book xxxviii, 1271 p. :ill. ; 25 cm. New York, N.Y. : Chemical Pub. Co., ISBN: 0820602043, (1986), 352.

Bennett, H., "Cure—Definition", *Concise chemical and technical dictionary*, 4th enl. ed. English Book xxxviii, 1271 p. : ill. ; 25 cm. New York, N.Y.: Chemical Pub. Co., ISBN: 0820602043, (1986), 359.

Bennett, H., "Extender—Definition", *Concise chemical and technical dictionary*, 4th enl. ed. English Book xxxviii, 1271 p. : ill. ; 25 cm. New York, N.Y. : Chemical Pub. Co., ISBN: 0820602043, (1986), 523.

Bennett, H., "Filler—Definition", *Concise chemical and technical dictionary*, 4th enl. ed. English Book xxxviii, 1271 p. : ill. ; 25 cm. New York, N.Y. : Chemical Pub. Co., ISBN: 0820602043, (1986), 535.

Bennett, H., "Plasticizer—Definition", *Concise chemical and technical dictionary*, 4th enl. ed. English Book xxxviii, 1271 p. : ill. ; 25 cm. New York, N.Y.: Chemical Pub. Co., ISBN: 0820602043, (1986), 911.

Bennett, H., "Reinforcing Agent—Definition", *Concise chemical and technical dictionary*, 4th enl. ed. English Book xxxviii, 1271 p. : ill. ; 25 cm. New York, N.Y.: Chemical Pub. Co., ISBN: 0820602043, (1986), 980.

Bennett, H., "Resin—Definition", *Concise chemical and technical dictionary*, 4th enl. ed. English Book xxxviii, 1271 p. : ill. ; 25 cm. New York, N.Y. : Chemical Pub. Co., ISBN: 0820602043, (1986), 982-983.

Bennett, H., "Stabilizer—Definition", *Concise chemical and technical dictionary*, 4th enl. ed. English Book xxxviii, 1271 p. : ill. ; 25 cm. New York, N.Y.: Chemical Pub. Co., ISBN: 0820602043, (1986), 1063.

Bennett, H., "Synthetic Resin—Definition", *Concise chemical and technical dictionary*, 4th enl. ed. English Book xxxviii, 1271 p. : ill. ; 25 cm. New York, N.Y.: Chemical Pub. Co., ISBN: 0820602043, (1986), 1096.

Bennett, H., "Vulcanization—Definition", *Concise chemical and technical dictionary*, 4th enl. ed. English Book xxxviii, 1271 p. : ill. ; 25 cm. New York, N.Y.: Chemical Pub. Co., ISBN: 0820602043, (1986), 1206.

Fire Retardant Chemicals Assoc., "Flame retardants—101:basic dynamics", *Book, 220 p. : ill. ; 28 cm. [Lancaster, PA]: Fire Retardant Chemicals Association*, (Mar. 24-27, 1996), 1-220.

Hairston, Deborah W., "Flame Retardants: Cool Under Fire", *Chemical Engineering*, 109(9), (Sep. 1995), 65-68.

Klempner, Daniel, et al., "Handbook of polymeric foams and foam technology", *Munich : New York : New York: Hanser*, (1991), 196-242.

Kroschwitz, Jacqueline I., "Flame Retardants (Phosphorus)", *Kirk-Othmer Encyclopedia of Chemical Technology; Explosives and Propellants to Flame Retardants for Textiles*, Fourth Edition, vol. 10, John Wiley & Sons, (1993), 976-998.

Kroschwitz, Jacqueline I., "Phosphorus Containing Polymers", *Encyclopedia of polymer science and engineering: Peroxy Compounds to Polyesters*, vol. 11, ISBN: 0-471-80943-8, John Wiley & Sons, (1988), 96-111.

Kroschwitz, Jacqueline I., "Wood", *Kirk-Othmer Encyclopedia of Chemical Technology; Vitamins to Zone Refining*, John Wiley & Sons, ISBN: 0471-52694-0 (v. 25), (1998), 627-664.

Morris, William, "Press—Definition", *The American heritage dictionary of the English language,Boston : Houghton Mifflin*, (1981), 1036.

Parker, Sybil, et al., "Resin (Synthetic Resin)—Definition", *McGraw-Hill Concise Encyclopedia of Science & Technology*, Hardcover: 2450 pages, Publisher: McGraw-Hill Professional; 4th edition (May 1, 1998), ISBN: 0070526591, (1998), 1666.

Society of Plastics Engineers; "Fire safety through use of flame retarded polymers", *Book, Polymer Modifiers and Additives Division and the Fire Retardant Chemicals Association, Lancaster, Pa. : The Association*, Adam's Mark Hotel, Houston, Texas, (1985).

Technomic Publishing Company, "Handbook of flame retardant chemicals and fire testing services", *Book, Lancaster, Pa., U.S.A.: Technomic Pub. Co.*,, (1988).

Troitzsch, Jurgen H., "Fire Retarded Polymer Applications: Developments in Europe and the Us", *Book, Technomic Publishing Co*. (1997).

"Encyclopedia of polymer Science & Technology", *"Rubber, Guayle", Introduction, J.Wiley & Sons, Inc*., (2004).

* cited by examiner

SEAT AND METHOD OF MAKING SAME

This application claims benefit under 35 U.S.C. § 119(e) of U.S. Provisional Application No. 60/432,181 filed on Dec. 9, 2002 which is incorporated herein by reference.

TECHNICAL BACKGROUND

Early seat and backrest cushioning was made from down and fabric materials (e.g., polyester fiber or cotton) which offered great comfort, but offered little support especially as these materials compacted with use.

Although the introduction of latex foam rubber offered increased durability and support for seat and backrest cushioning, it was eventually overshadowed by a more cost-effective flexible polyurethane foam (FPF). Flexible polyurethane foam greatly enhanced the comfort level in most seating applications. However, even high density, High Resilience (HR) polyurethane foam lacked the support necessary for reducing spinal strain, circulatory inhibition and pressure ulcers, which are especially prevalent among persons confined to sitting for a prolonged period of time.

Visco elastic foam ("memory foam") is an open-celled, body-heat and body-weight sensitive material originally developed by NASA to alleviate the G-Force stresses and pressures placed on astronauts during space flight. Memory foam material automatically conforms to the shape and position of the body and returns to its original shape and re-conforms with a change in body position. However, memory foam lacks the lateral support necessary for optimal pelvic positioning and improved postural alignment required for increased sitting comfort and sitting tolerance.

As such, there is a need for a seat and backrest that is comfortable, durable and which provides support. The seat and backrest should be comfortable for both short and long term sitting. The seat and backrest also should be durable to withstand different pressures from different body weights over a period of time and should also provide enough support to prevent or alleviate human ailments (e.g., spinal strain, thrombosis or pressure ulcers) acquired or aggravated by sitting.

SUMMARY

A seat and backrest are provided that include seat and backrest zones that are comfortable, durable and which provides body support for both short and long term sitting. The seat and backrest are durable to withstand different pressures from different body weights which can prevent or alleviate human ailments, for example, spinal strain, thrombosis or pressure ulcers acquired or aggravated by sitting.

In one embodiment, a seat includes a seat comfort zone that peripherally encompasses a pelvic zone, a front seat zone adjacent to the front side of a seat comfort zone and a first side seat zone, second side seat zone and rear seat zone peripherally encompassing a first side, second side and rear side, respectively, of the seat comfort zone. The seat comfort zone, the pelvic zone, the first side seat zone, the second side seat zone, the front seat zone and the rear seat zone include a soft elastic material. Further, the front seat zone is less firm than the first side seat zone, the second side seat zone, the rear seat zone, the seat comfort zone and the pelvic zone. The first side seat zone, the second side seat zone and the rear seat zone are more firm than the front seat zone, the seat comfort zone and the pelvic zone. The pelvic zone is more elastic than the front seat zone, the comfort zone, the first side seat zone, the second side seat zone and the rear seat zone.

In another embodiment, a seat includes a seat comfort zone that peripherally encompasses a pelvic zone, a front seat zone that is adjacent to the front side of the seat comfort zone, a first side seat zone, a second side seat zone and a rear seat zone peripherally encompassing a first side and a second opposite side of the seat comfort zone. A backrest is angularly connected to an area distal to the front seat zone. The backrest includes a lower back zone peripherally encompassing a center back zone on two opposite sides, a backrest comfort zone peripherally encompassing the lower back zone and the center back zone, and a first side backrest zone and a second side backrest zone peripherally encompassing a first side and a second opposite side of the backrest comfort zone. A head zone is distal to the seat. The seat comfort zone, the pelvic zone, the first side seat zone, the second side seat zone, the front seat zone, the rear seat zone, the center back zone, the lower back zone, the backrest comfort zone, the head zone, the first side backrest zone and the second side backrest zone include a soft elastic material. Further, the front seat zone is less firm than the first side seat zone, the second side seat zone, the rear seat zone, the seat comfort zone and the pelvic zone. The first side seat zone, the second side seat zone and the rear seat zone are more firm than the front seat zone, the seat comfort zone and the pelvic zone. The pelvic zone is more elastic than the front seat zone, the comfort zone, the first side seat zone, the second side seat zone and the rear seat zone. The center back zone and the head zone are less firm than the lower back zone, the backrest comfort zone, the first side backrest zone and the second side backrest zone. The first side backrest zone and the second side backrest zone are more firm than the center back zone, the head zone, the lower back zone and the backrest comfort zone. The lower back zone is more elastic than the center back zone, the head zone, the backrest comfort zone, the first side backrest zone and the second side backrest zone.

A method of making a seat, a backrest, or both, is also provided. The method includes mixing at least two compositions, placing the at least two compositions at specific locations in a mold until the mold is filled and placing the filled mold into a hot press.

The seat, backrest, or both can be manufactured from foam cushion formed from: (a) at least one of rubber and a resin; (b) a blowing agent; (c) a polymeric adhesion modifier; (d) a decomposition accelerating agent, and (e) a cross-linking agent.

The seat, backrest, or both can be manufactured from foam cushion formed from: (a) at least one of natural rubber and an ethylene-vinyl acetate (EVA) copolymer; (b) azodicarbonamide (AC); (c) FUSABOND; (d) dicumyl peroxide; and (e) a combination of zinc oxide and stearic acid.

The seat, backrest, or both can be manufactured from foam cushion formed from: (a) natural rubber present in about 5 wt. % to about 12 wt. % of the foam cushion; (b) an ethylene-vinyl acetate (EVA) copolymer present in about 79 wt. % to about 83 wt. % of the foam cushion; (c) azodicarbonamide (AC) present in about 3 wt. % to about 4.2 wt. % of the foam cushion; (d) FUSABOND present in about 2.8 wt. % to about 3.9 wt. % of the foam cushion; (e) dicumyl peroxide present in about 0.5 wt. % to about 0.9 wt. % of the foam cushion; and (f) a combination of zinc oxide and stearic acid, wherein the zinc oxide is present in about 1.0 wt. % to about 2.2 wt. % of the foam cushion and stearic acid is present in about 0.5 wt. % to about 1.25 wt. % of the foam cushion.

DETAILED DESCRIPTION

Rubber

Figure 1:
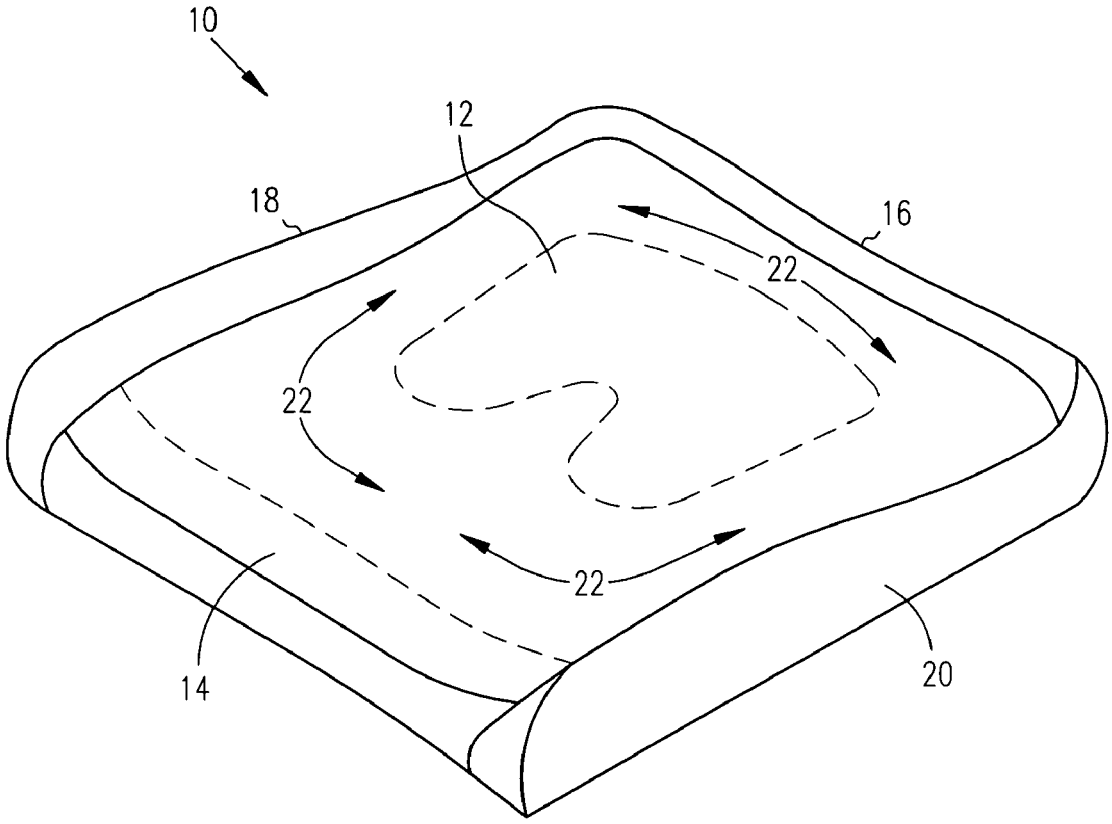
FIG. 1 is an isomeric view of a seat constructed in accordance with one embodiment.

As used herein, "rubber" refers to (a): an elastic substance that is obtained by coagulating the milky juice of any of various tropical plants (as of the genera Hevea and Ficus), is essentially a polymer of isoprene, and is prepared as sheets and then dried; (b): any of various synthetic rubber-like substances; or (c): natural or synthetic rubber modified by chemical treatment to increase its useful properties (as toughness and resistance to wear). See, *Merriam-Webster Online Dictionary*, http://www.m-w.com.

As used herein, "synthetic rubber" refers to a flexible chain polymer with the ability to deform elastically when vulcanized or cured. Suitable synthetic rubbers include, e.g., a polybutadiene rubber (BR); a polyisoprene rubber (IR); a styrene-butadiene rubber (SBR); a nitrile rubber (NBR); a butyl rubber (IIR); an ethylene-propylene terpolymer (EPDM); a silicone rubber; a neoprene rubber; a polysulfide; a polyacrylate rubber; an epichlorohydrin rubber; a fluoroelastomer (FDM); a chloronated polyethylene (CSM); a halogenated butyl or bromobutyl (BIIR); a chlorinated polyethylene rubber (CPE); a polyurethane; a thermoplastic rubber; chlorinated natural rubber, cyclized rubber; and combinations thereof.

As used herein, "natural rubber" refers to cis-1,4-polyisoprene, which occurs naturally in over 200 species of plants, including dandeloins and goldenrod. Specifically, natural rubber (NR) can be obtained from the *Hevea brasiliensis* tree, the guayule bush *Parthenoim argentatum*, or the *Sapotaceae* tree.

Natural rubber can have different grades, e.g., latex grade or remilled grade. The latex grade natural rubber (NR) includes, e.g., ribbed smoked sheet (RSS), white and pale crepes, and pure blanket crepes. The remilled grade natural rubber (NR) includes, e.g., estate brown crepes, estate compo crepes, thin brown crepes or remils, thick brown crepes or ambers, and flat bark crepes. The natural rubber (NR) can be a technically-specified natural rubber (TSR), a superior processing natural rubber (SP), a technically classified natural rubber (TC), an air-dried sheet natural rubber (ADS), a skin natural rubber, a deproteinized natural rubber (DPNR), an oil-extended natural rubber (OENR), a heveal-plus MG natural rubber, or an epoxidized natural rubber.

The natural rubber (NR) can include cis-polyisoprene, trans-polyisoprene, or a combination of cis- and trans-polyisoprene. Additionally, the natural rubber (NR) can include any suitable amount of polyisoprene, e.g., about 93 wt. % to about 95 wt. % of polyisoprene.

The rubber can be employed in the foam cushion in any appropriate and suitable amount. For example, the rubber can be employed up to about 99 wt. % of the foam cushion, up to about 95 wt. % of the foam cushion, or up to about 90 wt. % of the foam cushion. Typically, the rubber can be employed up to about 80 wt. % of the foam cushion, in about 5 wt. % to about 12 wt. % of the foam cushion, or in about 7 wt. % to about 9 wt. % of the foam cushion.

Resin

As used herein, "resin" refers to a semisolid or solid, complex, amorphous mixture of organic compounds; having no definite melting point and no tendency to crystallize. Resins may be of vegetable origin, of animal origin, or synthetic origin. See, e.g., *Concise Chemical and Technical Dictionary*, Fourth Enlarged Edition, Bennet, Chemical Publishing Co., NY, N.Y. (1986). The resin can be colorless or can be colored. The synthetic resins, originally viewed as substitutes for certain natural resins, have a large place of their own in industry and commerce. Phenol-formaldehyde, phenol-urea, and phenol-melamine resins are important commercially. Any unplasticized organic polymer is considered a resin, thus nearly any one of the common plastics may be viewed as a synthetic resin. See, *McGraw-Hill Concise Encyclopedia of Science & Technology*, Fourth Edition, Parker, Mc-Graw Hill (1998).

Specifically, the resin can be a thermoplastic polymer, a thermoplastic terpolymer, a thermoplastic homopolymer, a thermoplastic copolymer, or a combination thereof. Specifically, the thermoplastic copolymer can include an ethylene vinyl acetate (EVA), an ethylene propylene rubber, an ethylene methyl acrylate copolymer, an ethylene ethyl acrylate copolymer, an ethylene butyl acrylate copolymer, a polybutylene terephthalate (PBT) polymer, or a combination thereof. Specifically, the thermoplastic homopolymer can include a polyethylene, a chlorinated polyethylene, a metallocene polyethylene, a polypropylene, or a combination thereof. Specifically, the thermoplastic terpolymer can include a modified ethylene acrylate carbon monoxide terpolymer.

Specifically, the resin can be an ethylene vinyl acetate (EVA) copolymer. Commercially available EVA copolymers include, e.g., AT Polymers 1070C (9% VA), AT Polymers 1710 (17% VA), AT Polymers 2306 (23% VA), AT Polymers 2803 (28% VA), AT Polymers 2810 (28% VA), Chevron/Ace Plastics TD 3401 (9.5% VA), Chevron/Ace Plastics DS 4089-70 (18% VA), DuPont Elvax® 40 (40% VA), DuPont Elvax® 140-W (33% VA), DuPont Elvax® 250-W (28% VA), DuPont Elvax® 260 (28% VA), DuPont Elvax® 350 (25% VA), DuPont Elvax® 360 (25% VA), DuPont Elvax® 450 (18% VA), DuPont Elvax® 460 (18% VA), DuPont Elvax® 550 (15% VA), DuPont Elvax® 560 (15% VA), DuPont Elvax® 650 (12% VA), DuPont Elvax® 660 (12% VA), DuPont Elvax® 750 (9% VA), DuPont Elvax® 760 (9.3% VA), DuPont Elvax® 770 (9.5% VA), Exxon Escorene® LD-740 (24.5% VA), Exxon Escorene® LD-724 (18% VA), Exxon Escorene® LD-721.62 (19.3% VA), Exxon Escorene® LD-721.88 (19.3% VA), Exxon Escorene® LD-721 (19.3% VA), Exxon Escorene® LD-740 (24.5% VA), Exxon Escorene® LD-318 (9% VA), Exxon Escorene® LD-319.92 (9% VA), Exxon Escorene® LD-725, Quantum UE 630-000 (17% VA), Quantum 637-000 (9% VA), Rexene® X1903 (10% VA), Rexene® X0901 (12% VA), Rexene® X0911 (18% VA), and Rexene® X0915 (9% VA).

Elvax® resins are a family of ethylene/vinyl acetate copolymers and are commercially available from DuPont (Wilmington, Del.).

Another class of suitable resins include, e.g., polyolefinic polymers. The polyolefinic polymer can include a low density polyethylene (LDPE), a very low density polyethylene (VLDPE), a linear low density polyethylene (LLDPE), a single site initiated polyethylene (e.g., PE, LDPE, or VLDPE), a polypropylene, a single-site initiated polypropylene, an ethylene-propylene diene monomer (EPDM) copolymer, an ethylene-propylene rubber (EPR), a single-site initiated ethylene-propylene diene monomer copolymer, a single-site initiated ethylene-propylene rubber, a high density polyethylene (HDPE), a polystyrene, a styrene copolymer, an ethylene-styrene interpolymer, a polyacrylonitrile, a polybutadiene, a polyvinylchloride (PVC), a polyvinylidene chloride, a polyvinylfluoride, a polyvinylidene fluoride, a polyvinyl acetate, a polyvinyl alcohol, a polyamide, a polyacrylate (e.g., a polymethyl acrylate or a polymethyl methacrylate), a polyether sulfone, a polysulfone, a polychlorotrifluoroethylene, a polytetrafluoroethylene, a cellulose, a polyester, a polyhalocarbon, and copolymers of ethylene with propylene, isobutene, butene, hexene, octene, vinyl chloride, vinyl propionate, vinyl isobutyrate, vinyl alcohol, allyl alcohol, allyl acetate, allyl acetone, allyl benzene, allyl ether, maleic anhydride, ethyl acrylate (EEA), methyl acrylate, acrylic acid, or methacrylic acid; and blends or alloys thereof.

LDPE resins are disclosed, e.g., in *Petrothene Polyolefins . . . A Processing Guide*, Fifth Edition, Quantum USI Division, 1986, pages 6–16. Some LDPE resins are commercially available, e.g., from Exxon Chemical Company (Houston, Tex.), Dow Plastics (Midland, Mich.), Novacor Chemicals (Canada) Limited (Mississauga, Ontario, Canada), Mobil Polymers (Norwalk, Conn.), Rexene Products Company (Dallas, Tex.), Quantum Chemical Company (Cincinnati, Ohio), and Westlake Polymers Corporation (Houston, Tex.). Commercially available LDPE resins include Eastman 1924P, Eastman 1550F, Eastman 800A, Exxon LD 117.08, Exxon LD 113.09, Dow 535I, Dow 683, Dow 760C, Dow 768I, Dow 537I, Novacor LF219A, Novacor LC05173, Novacor LCO522A, Mobil LIA-003, Mobil LFA-003, Rexene 2018 (7018), Rexene 1023, Rexene XO 875, Rexene PE5050, Rexene PE1076, Rexene PE2030, Quantum NA953, Quantum NA951, Quantum NA285-003, Quantum NA271-009, Quantum NA324, Westlake EF606AA, Westlake EF612, and Westlake EF412AA. A commercially available VLDPE is Union Carbide 1085.

Some EPR and EPDM resins are available commercially, e.g., from Exxon Chemical Company (Houston, Tex.), under the tradename Vistalon®, and include Vistalon® 5800, Vistalon® if 6205, Vistalon® 7000, Vistalon® 7500, Vistalon® 8000, Vistalon® 2200, Vistalon® 2504, Vistalon® 2555, Vistalon® 2727, Vistalon® 4608, Vistalon® 719, Vistalon® 3708, Vistalon® 404, Vistalon® 457, Vistalon® 503, Vistalon® 707, and Vistalon® 878. Other EPDM resins are available commercially from DuPont (Wilmington, Del.), under the tradename Nordelg and include Nordel® 2522, Nordel® 2722, Nordel® 1440, Nordel® 1470, Nordel® 1145, Nordel® 1040, and Nordel® 1070.

Single-site initiated polyolefin resins are described, e.g., in S. -Y. Lai, et al., U.S. Pat. Nos. 5,272,236, 5,278,272, and 5,380,810; in L. Spenadel, et al., U.S. Pat. No. 5,246,783; in C. R. Davey, et al., U.S. Pat. No. 5,322,728; in W. J. Hodgson, Jr., U.S. Pat. No. 5,206,075; and in F. C. Stehling, et al., WO 90/03414. Some single-site initiated polyolefin resins are available commercially, e.g., from Exxon Chemical Company (Houston, Tex.), under the tradename Exact®, and include Exact® 3022, Exact® 3024, Exact® 3025, Exact® 3027, Exact® 3028, Exact® 3031, Exact® 3034, Exact® 3035, Exact® 3037, Exact® 4003, Exact® 4024, Exact® 4041, Exact® 4049, Exact® 4050, Exact® 4051, Exact® 5008, and Exact® 8002. Other single-site initiated resins are available commercially, e.g., from Dow Plastics (Midland, Mich.) (or DuPont/Dow), under the tradenames Engage® and Affinity®, and include CL8001, CL8002, EG8100, EG8150, PL1840, PL1845 (or DuPont/Dow 8445), EG8200, EG8180, GF1550, KC8852, FW1650, PL1880, HF1030, PT1409, CL8003, Dow 8452, Dow 1030, Dow 8950, Dow 8190, and D8130 (or XU583-00-01).

Another suitable class of resins includes Elvaloy® AC acrylate copolymers, which are commercially available from DuPont (Wilmington, Del.). Elvaloy® AC acrylate copolymer resins are advertised as temperature resistant, noncorrosive, and low odor producing resins that can withstand high-heat processes without thermal degradation. Elvaloy® AC acrylate copolymer resins are also advertised as highly compatible with LDPE, and easily bond to various polar and nonpolar substrates such as PE, PET, OPP, and OPA.

Another suitable class of resins include, e.g., AquaStike Polychloroprene Latex, Arcal® Styrene Allyl Alcohol, ASR Plus® Styrene Acrylic Emulsion, Bakelite® Phenolic Resin, Capcure® Epoxy Hardener/Accelerator, Chlorub® Chlorinated Rubber, Cycloaliphatic Epoxy Resin, CYRACURE® U.V.R. & U.V.I. Resins, Derakaneg Vinyl Ester Resin, D.E.H.® Epoxy Hardener, D.E.N.® Epoxy Novolac, D.E.R.® Epoxy Resin, Duraplus 2® Styrene Acrylic Emulsion, Eastoflex® Amorphous Polyolefin, Elvanol® Polyvinyl Alcohol, Elvax® Ethylene Vinyl Acetate, G-Cryl® Acrylic Resin, Genamid® Amidoamine Resin, Indopol® Polybutene, Kraton® Thermoplasitic Elastomer, Maincote® Styrene Acrylic Emulsion, Modaflow® Powder 2000/III, Modaflow® Resin/2100, Modaflow® AQ-3000, Multiflow® Flow Modifier, Neoprene® Neoprene Latex®, Paraloid® Acrylic Resin, Photomer® Radiation Curing Chemicals, Polyco® Vinyl Acetate/Acrylic Emulsion, Polycup®, Delsette®, Hercosett®, Kymene®, Primal® Acrylic Emulsion, Rhoplex® Acrylic Emulsion, RoBond® Acrylic Emulsion, RoShield® Acrylic Emulsion, Rovace® Vinyl Acetate/Acrylic Emulsion, Stadex® Dextrin, Staley® Starch Derivatives, TONE® Caprolactone Polymer, UCAR® Solution Vinyl Resin, Versamid® Polyamide Resin, Versamine® Modified Amine, Waterpoxy®, C5 Aliphatic Resins, C9/D.C.P.D. Aromatic Resins, Adtac LV®, Aliphatic/Aromatic Mix Resins, Aliphatic Terpene Resins, Endex®, Hercolite®, Hercotac®, Hydrogenated Water White Resins, Kristalex®, Picco®, Piccodiene® 2215, Piccopale®, Piccolastic®, Piccolyte®, Piccotac®, Piccotex®, Piccovar®, Pure Monomer Aromatic Resins, Regalite®, and Regalrez®.

The resin can be employed in combination with the rubber. Alternatively, the resin can be employed in the absence of any rubber present or the rubber can be employed in the absence of any resin present.

The resin can be employed in any suitable and appropriate amount. For example, the resin can be employed up to about 99 wt. % of the foam cushion, up to about 95 wt. % of the foam cushion, or up to about 90 wt. % of the foam cushion. Typically, the resin can be employed in about 79 wt. % to about 83 wt. % of the foam cushion or in about 80.5 wt. % to about 82.5 wt. % of the foam cushion.

A specific suitable resin useful in the present invention includes, e.g., an ethylene-vinyl acetate (EVA) copolymer. The ethylene-vinyl acetate (EVA) copolymer can include any suitable and appropriate amount of vinyl acetate. Typically, the ethylene-vinyl acetate (EVA) copolymer can include about 15 wt. % to about 75 wt. % vinyl acetate.

When an ethylene-vinyl acetate (EVA) copolymer is employed as the resin, it can be employed in any suitable and appropriate amount. For example, the ethylene-vinyl acetate (EVA) copolymer can be employed up to about 99 wt. % of the foam cushion, up to about 95 wt. % of the foam cushion, or up to about 90 wt. % of the foam cushion.

Blowing Agent

As used herein, a "blowing agent" or "foaming agent" refers to a substance which, when heated, decomposes to form a gas. See, e.g., *Concise Chemical and Technical Dictionary*, Fourth Enlarged Edition, Bennet, Chemical Publishing Co., NY, N.Y. (1986). The Foaming agent will decompose at elevated temperatures to form one or more gasses. Foaming agents can be used to expand the compositions into a foam. In general, the foaming agent will have a decomposition temperature (with the resulting liberation of gaseous material) from about 130° C. to about 350° C. The blowing agent can be a liquid, gas, or solid at standard temperature and pressure. Foaming agents are included in the mixture to produce foamed articles. Foaming agents are medium expanding compositions that are gases at temperatures and pressures encountered during the foam expanding step. Typically, a foaming agent is introduced in the gaseous or liquid state and expands, for example, upon a rapid decrease in pressure.

Any suitable blowing agent can be employed, provided the blowing agent effectively decomposes, when heated, to form a gas and can expand a composition into a foam.

Suitable classes of blowing agents include, e.g., ($C_1$–$C_{12}$) hydrocarbons, ($C_1$–$C_{12}$)organohalogens, ($C_1$–$C_{12}$)alcohols, ($C_1$–$C_{12}$)ethers, ($C_1$–$C_{12}$)esters, ($C_1$–$C_{12}$)amines, or combinations thereof. Suitable ($C_1$–$C_{12}$)hydrocarbons include, e.g., acetylene, propane, propene, butane, butene, butadiene, isobutane, isobutylene, cyclobutane, cyclopropane, ethane, methane, ethene, pentane, pentene, cyclopentane, pentene, pentadiene, hexane, cyclohexane, hexene, hexadiene, and combinations thereof.

Other suitable specific blowing agents include, e.g., sodium bicarbonate, ammonia, nitrogen, carbon dioxide, neon, helium, butane, isobutane, 1,1-difluoroethane, p,p'-oxybis(benzene)sulfonyl hydrazide, p-toluene sulfonyl hydrazide, p-toluene sulfonyl semicarbazide, 5-phenyltetrazole, ethyl-5-phenyltetrazole, dinitroso pentamethylenetetramine, acetone, azodicarbonamide (AC), dinitroso pentamethylene tetramine (DNPT), and combinations thereof.

Additional suitable foaming agents include, e.g., Formacel® Z-2, Porofor®, Genitron®, Ficel®, Planagen®, HFC-245fa, Meforex® 134a, Meforex® 134b, HFC-365mfc, azodicarbonamide, acetone, Dinitrosopentamethylene tetramine, Exxsol® 1200, Exxsol® 1550, Exxsol® 1600, Exxsol® 2000, Exxsol® HP 95, Freon® R-22 (HCFC), R-11 (CFC), R-12 (CFC), R-113 (CFC), R-141 (HCFC), R-22 (HCFC), R-HFC134a, and HFC-134a.

Additional suitable foaming agents include, e.g., SUVA® (DuPont), Dymel® (DuPont), Formacel® (DuPont), Zyron® (DuPont), Porofor® (Bayer), Genitron® (Bayer), Ficel® (Bayer), Planagen® (Bayer), Meforex® 134a (Ausimont), Meforex® 141b (Ausimont), HFC-245fa (Ausimont), HFC-365mfc (Ausimont), acetone, Exxsol® 1200 (Exxon Mobil), Exxsol® 1550 (Exxon Mobil), Exxsol® 1600 (Exxon Mobil), Exxsol® 2000 (Exxon Mobil), Exxsol® HP 95 (Exxon Mobil), Freon® R-22 (HCFC) (Foam-Tech), Freon® R-11 (CFC) (Foam-Tech), and HFC-Freon® 134a (Foam-Tech).

Other suitable blowing agents are disclosed, e.g., in Aldrich Handbook of Fine Chemicals (Milwaukee, Wis.).

Specifically, the blowing agent can be azodicarbonamide (AC), which is chemically designated as $H_2NC(=O)N=NC(=O)NH_2$.

The blowing agent can be employed in any suitable and appropriate amount. For example, the blowing agent can be employed up to about 50 wt. % of the foam cushion, up to about 40 wt. % of the foam cushion, or up to about 30 wt. % of the foam cushion. Typically, the blowing agent can be employed in about 0.1 wt. % of the foam cushion to about 10 wt. % of the foam cushion, in about 3.0 wt. % of the foam cushion to about 4.2 wt. % of the foam cushion, or in about 3.5 wt. % to about 4.0 wt. % of the foam cushion.

Polymeric Adhesion Modifier

As used herein, a "polymeric adhesion modifier" or "bonding polymer" refers to a material to help bond together polymers used in toughened, filled, and blended compounds.

Any suitable and appropriate polymeric adhesion modifier can be employed. Suitable classes of polymeric adhesion modifiers include, e.g., anhydride grafted polyolefin resins, styrene maleic anhydride (SMA) copolymers, and combinations thereof. Specifically, the anhydride can be maleic anhydride. Specifically, the polyolefin can be polyethylene, polypropylene, EPDM, ethylene vinyl acetate (EVA), a copolymer thereof, or a combination thereof.

Specifically, the polymeric adhesion modifier can be a FUSABOND polymeric adhesion modifier. Specific suitable FUSABONDs include, e.g., FUSABOND P modified proplylene, FUSABOND E modified polyethylene, FUSABOND C modified ethylene vinyl acetate, FUSABOND A modified ethylene-acrylate terpolymer, FUSABOND N modified ethylene-based rubber, and combinations thereof.

Fusabond® resins are modified polymers that have been functionalized (typically by maleic anhydride grafting) to help bond together polymers used in toughened, filled and blended compounds. The Fusabond® resins are commercially available from DuPont (Wilmington, Del.). The Fusabond® resins include modified ethylene acrylate carbon monoxide terpolymers, ethylene vinyl acetates (EVAs), polyethylene, metallocene polyeythylenes, ethylene propylene rubbers, and polypropylenes.

The polymeric adhesion modifier can be employed in any suitable and appropriate amount. For example, the polymeric adhesion modifier can be employed up to about 30 wt. % of the foam cushion, up to about 20 wt. % of the foam cushion, or up to about 10 wt. % of the foam cushion. Typically, the polymeric adhesion modifier can be employed in about 0.5 wt. % of the foam cushion to about 15 wt. % of the foam cushion, in about 2.8 wt. % of the foam cushion to about 3.9 wt. % of the foam cushion, or in about 3.0 wt. % of the foam cushion to about 3.5 wt. % of the foam cushion.

Cross-linking Agent

The cross-linking agent can be a free radical source. As used herein, a "free radical source" refers to cross-linking with a peroxide. "Peroxide" refers to an organic compound that includes one or more peroxide, i.e., O—O, linkages. Suitable peroxides are disclosed, e.g., in *Aldrich Catalogue of Fine Chemicals* (Milwaukee, Wis.). Heating the peroxide causes it to generate radicals which react with the components of the mixture to cause covalent cross-links in the mixture. By regulating the amounts and types of organic peroxide present in the mixture, the relative rates of radical generation, abstraction, and cross-linking steps can be controlled to permit foaming of the polymeric adhesion materials. The resulting materials have high cross-link levels. Peroxide cross-linking is described, e.g., in Park, *Handbook of Polymeric Foam and Foam Technology*, Polyolefin Foam, Ch. 9, pp. 186–242.

The cross-linking can alternatively occur with high-energy, ionizing radiation, which involves the use of equipment that generates electrons, X-rays, Beta-rays or Gamma-rays. A preferred method for cross-linking olefinic compositions through exposure to ionizing radiation is through the use of an electron-beam radiation source. Exposure of the compositions of the present invention to ionizing radiation may be accomplished at dosages in the range of about 0.1 to 40 Megarads, and preferably, at about 1 to 20 Megarads. U.S. Pat. No. 4,203,815 (Noda) discloses methods of exposing compositions to both high and low-energy ionizing radiation to effect improvements in surface quality, strength and subsequent heat-sealing or embossing processes. The amount of cross-linking may be appropriately controlled by the dosage of ionizing radiation.

The cross-linking agent (i.e., graft initiator) can be a radical generating species, for example, a peroxide. Examples of peroxides include methylethylketone peroxide; dicumyl peroxide; 2,5-dimethyl-2,5-di(t-butylperoxy)hexane; 1,1-bis(t-butylperoxy)-3,3,5-trimethylcyclohexane; 1,1-di-(t-butylperoxy)cyclohexane; 2,2'-bis(t-butylperoxy) diisopropylbenzene; 4,4'-bis(t-butylperoxy)butylvalerate; Ethyl 3,3-bis(t-butylperoxy) butyrate; t-butyl cumyl peroxide; Di [(t-butylperoxy)-isopropyl] benzene; t-butyl peroxide; 6,6,9,9-tetramethyl-3-methyl-3, n-butyl-1,2,4,5-tetraoxycyclononane; 6,6,9,9-tetramethyl-3-methyl-3-ethyl arbonylmethyl 1,2,4,5-tetraoxy-cyclononane; ethyl 3,3-di (t-butylperoxy)-butyrate; dibenzoyl peroxide; 2,4-dichlorobenzoyl peroxide; OO-t-butyl O-(2-ethylhexyl) mono peroxycarbonate; t-butyl cumyl peroxide; 2,5-dimethyl-2,5-di-(t-butylperoxy)hexyne-3; and combinations thereof. Specifically, the graft initiator can be dicumyl peroxide, such as 40% active dicumyl peroxide (e.g., Luperco® 500 40KE).

The cross-linking agent can be employed in any suitable and appropriate amount. Typically, the cross-linking agent can be employed in about 0.1 wt. % of the foam cushion to about 2.0 wt. % of the foam cushion, in about 0.5 wt. % of the foam cushion to about 0.9 wt. % of the foam cushion, or in about 0.6 wt. % of the foam cushion to about 0.7 wt. % of the foam cushion.

Decomposition Accelerating Agent

As used herein, a "decomposition accelerating agent" refers to a chemical or combination of chemicals that accelerates decomposition and free radical generation of the free radical source.

Any suitable and appropriate decomposition accelerating agent can be employed, provided the decomposition accelerating agent can effectively accelerate the reaction without causing premature gellation.

Suitable classes of decomposition accelerating agent include inorganic salts, lead-containing compounds, metallic soaps, urea compounds, and $R^1COOR^2$, wherein: $R^1$ is $(C_1–C_{20})$alkyl, $(C_2–C_{20})$alkenyl, $(C_1–C_{20})$alkynyl, aryl $(C_1–C_{20})$alkyl, aryl $(C_2–C_{20})$alkenyl, aryl$(C_2–C_{20})$alkynyl, cycloalkyl$(C_1–C_{20})$alkyl, cycloalkyl$(C_2–C_{20})$alkenyl, or cycloalkyl$(C_2–C_{20})$alkynyl; and $R^2$ is hydrogen, $(C_1–C_{20})$ alkyl, $(C_2–C_{20})$alkenyl, $(C_1–C_{20})$alkynyl, aryl$(C_1–C_{20})$ alkyl, aryl $(C_2–C_{20})$alkenyl, aryl$(C_2–C_{20})$alkynyl, cycloalkyl$(C_1–C_{20})$alkyl, cycloalkyl$(C_2–C_{20})$alkenyl, or cycloalkyl$(C_2–C_{20})$alkynyl; wherein any alkyl, alkenyl, alkynyl, cycloalkyl, or aryl is optionally substituted on carbon with one or more halo, nitro, cyano, $(C_1–C_{20})$alkoxy, or trifluoromethyl; or pharmaceutically acceptable salts thereof.

Specifically, the decomposition accelerating agent can be an inorganic salt.

As used herein, an "inorganic salt" refers to a compound, that does not include any carbon atoms, that is the product resulting from the reaction of an acid and a base, e.g., sodium chloride. Any suitable inorganic salt can be employed and are disclosed, e.g., in *Aldrich Catalogue of Fine Chemicals* (Milwaukee, Wis.).

Specifically, the decomposition accelerating agent can be a carboxylic acid.

As used herein, a "carboxylic acid" refers to a compound that includes one or more C(═O)OH functional groups. Any suitable carboxylic acid can be employed and are disclosed, e.g., in *Aldrich Catalogue of Fine Chemicals* (Milwaukee, Wis.).

Specifically, the decomposition accelerating agent can be a combination of an inorganic salt and a carboxylic acid.

Specifically, the decomposition accelerating agent can be zinc oxide, tribasic lead sulfate, zinc stearate, lead stearate, CELLPASTE-K5, stearic acid, or a combination thereof.

Specifically, the decomposition accelerating agent can be zinc oxide and stearic acid.

The decomposition accelerating agent can be employed in any suitable and appropriate amount. For example, the decomposition accelerating agent can be employed up to about 40 wt. %, up to 35 wt. %, or up to 30 wt. % of the foam cushion. Typically, the decomposition accelerating agent can be employed up to about 25 wt. % of the foam cushion, in about 1.5 wt. % to about 13.5 wt. % of the foam cushion, or in about 2.0 wt. % to about 13.0 wt. % of the foam cushion.

Cross-linking Agent

As used herein, a "cross-linking agent" refers to a compound that increases the ability of one or more branched or straight-chained molecules to form one or more valence bridges between them. See, e.g., *Concise Chemical and Technical Dictionary*, Fourth Enlarged Edition, Bennet, Chemical Publishing Co., NY, N.Y. (1986). Cross-linking of a polymeric mixture can aid in the formation of desirable foamed and non-foamed materials. Cross-linking can also lead to improvements of the ultimate physical properties of the materials (e.g., foam cushion), such as flexibility and low tackiness. Cross-linking can take place prior to, during, or after expansion of the foam.

Cross-linking can be accomplished by grafting vinyl silane groups onto a component of the mixture and activating cross-linking by exposing the mixture to moisture. Silane cross-linking can be useful for making thin gauge foamed articles such as tape grade foams. A combination of peroxide and silane cross-linking can also be used. In the case of peroxide, the cross-linking can be accomplished in the beginning zones of a foaming chamber via heat activation or in another heat treatment process. Silane cross-linking can be activated by exposure to a source of moisture, for example, prior to expansion in an oven. Suitable vinyl silanes include, vinyltrimethoxy silane, vinyltris (methylethylketoxime) silane.

Another class of suitable cross-linking agents includes, e.g., alkoxy silanes (e.g., methyltrimethoxy silane, dimethyldimethoxy silane, phenyltrimethoxy silane, diphenyldimethoxy silane, methyltriethoxy silane, dimethyl diethoxy silane, phenyl triethoxy silane, or diphenyl diethoxy silane), oximesilanes (e.g., methyltris (methylethylketoxime) silane, dimethylbis (methylethylketoxime) silane, phenyltris (methylethylketoxime) silane, or diphenylbis (methylethylketoxime) silane). These cross-linking agents can be used individually or in a mixture of two or more.

Another suitable class of cross-linking agents includes, e.g., $(C_3–C_{10})$alkylene diols and $(C_3–C_{10})$cycloalkylene diols. Examples of $(C_3–C_{10})$alkylene diols are 1,3-propanediol, 1,4-butanediol, 1,6-hexanediol, 2-ethyl-1,3-hexanediol, 2,2,4-trimethyl-1,3-pentanediol and 2-butyl-2-ethyl-1,3-propanediol.

Additional suitable cross-linking agents includes, e.g., hydroquinone di(beta-hydroxyl ethyl)ether, ethoxylated bisphenol A, 4,4'-methylene bis(2-chloroaniline), 4,4'-methylene bis(3-chloro-2,6-diethylaniline), 3,5-dimethylthio-2,4-toluenediamine, 3,5-dimethylthio-2,6-toluenediamine, trimethylene glycol di-p-aminobenzoate and 1,4-bis(beta?-hydroxyethoxy) benzene.

Additional suitable specific cross-linking agents include, e.g., ethyleneglycol di(meth)acrylate; diethyleneglycol di(meth)acrylate; triallyl cyanurate (TAC); triallyl isocyanurate (TAIC), triallyl phosphate (TAPA), trimethylol propane trimethacrylate; allyl methacrylate; or a combination thereof.

Suitable specific oximesilanes include, e.g., methyltris (methylethylketoxime) silane, dimethylbis (methylethylketoxime) silane, phenyltris (methylethylketoxime) silane, vinyltris (methylethylketoxime) silane, diphenylbis (methylethylketoxime) silane, and combinations thereof.

Optional Components

Any one or more of a cure retarder, a reinforcing agent, a filler, an extender, a placticizer, a vulcanization agent, an antioxidant, a fire retardant, a colorant, an electrically conductive material, and a stabilizer can be employed in the present invention in the process of manufacturing the foam cushion.

As used herein, a "cure retarder" refers to a substance that slows the process for a polymer or polymeric-containing substance to cure. Curing refers to the time necessary for a polymeric substance to complete reaction so that it becomes infusible and chemically inert. Cure refers to the change in physical properties of a material by chemical reaction, which may be condensation, polymerization, or vulcanization; usually accomplished by the action of heat and catalysts; alone or in combination, with or without pressure. See, e.g., *Concise Chemical and Technical Dictionary*, Fourth Enlarged Edition, Bennet, Chemical Publishing Co., NY, N.Y. (1986). Retarders are chemicals that prevent the premature vulcanization of rubber compounds during mixing, caldering, and other processing steps. In the absence of the processing safety provided by retarders, scorched stocks, and consequently, waste results either during the processing steps or during the storage of the fully compounded green stocks. Retarders are often called antiscorching agents, scorch inhibitors, cure retarders, or prevulcanization inhibitors, whereas such conventional retarders as salicyclic acid, phthalic anhydride, and N-nitrosodiphenylamine (NDPA) are simply called retarders.

Conventional cure retarders include benzoic acid, phthalic anhydride, and NDPA. More recent ones include a sulfonamide derivative Vulkalent® E (Mobay) and N-(cyclohexylthio)phthalimide (CTP), Santogard® PVI and AK-8169 (Monsanto).

As used herein, a "reinforcing agent" refers to a substance that imparts strength, toughness, and a greater resistance to wear. See, e.g., *Concise Chemical and Technical Dictionary*, Fourth Enlarged Edition, Bennet, Chemical Publishing Co., NY, N.Y. (1986).

As used herein, "filler" refers to a substance that tends to convert rubber or a polymeric material from an elastic to a ridged state, even at low concentrations, and substantially increases resistance to abrasion and tear. See, e.g., *Concise Chemical and Technical Dictionary*, Fourth Enlarged Edition, Bennet, Chemical Publishing Co., NY, N.Y. (1986).

As used herein, an "extender" refers to an inert substance that used to provide added weight of bulk and lower costs. See, e.g., *Concise Chemical and Technical Dictionary*, Fourth Enlarged Edition, Bennet, Chemical Publishing Co., NY, N.Y. (1986).

As used herein, a "plasticizer" refers to a substance which is added to a plastic or polymeric material to soften, increase toughness, or otherwise modify the properties of the plastic or polymeric material. See, e.g., *Concise Chemical and Technical Dictionary*, Fourth Enlarged Edition, Bennet, Chemical Publishing Co., NY, N.Y. (1986).

As used herein, a "vulcanization agent" refers to a substance that aids or assist in the vulcanization process. Vulcanization refers to an irreversible process during which a rubber compound, through a change in its chemical structure (e.g., cross-linking) becomes less plastic and more resistant to swelling by organic liquids, and elastic properties are conferred, improved, or extended over a greater range of temperature. See, e.g., *Concise Chemical and Technical Dictionary*, Fourth Enlarged Edition, Bennet, Chemical Publishing Co., NY, N.Y. (1986).

As used herein, an "antioxidant" refers to a substance that prevents or slows down oxidation, e.g., phenyl naphthylamine. See, e.g., *Concise Chemical and Technical Dictionary*, Fourth Enlarged Edition, Bennet, Chemical Publishing Co., NY, N.Y. (1986).

As used herein, a "fire retarder" or "fire retardant" refers to a substance that retards fire, prevents or diminishes the ability of a substance from igniting, catching fire, and/or burning.

Suitable fire retardants are disclosed, e.g., in *Flame Retardants-Products Information*, Spartan Flame Retardants, Inc., 1983, pp. 1–17; *Flame retardants Buyers Guide*, American Dyestuff Reporter, January 1996, pp. 15–31; *Flame Retardants*-101,: *Basic Dynamics-Past Efforts Create Future Opportunities*, Fire Retardant Chemicals Association, Mar. 24–27, 1996, pp. 1–220; *Phosphorous-Containing Polymers*, Enc. of Polymer Science and Engineering, vol. 11, 1998, pp. 96–111; *Phosphorous Flame Retardants*, Enc. of Chemical Tech., vol. 10, 1993, pp. 976–993; *Flame Retardants: Cool Under Fire*, Chemical Engineering, September 1995, vol. 102, No. 9, pp. 65–68; Fine Chemical, Vol. 20, No. 11 (1991) pp. 9–36; Kirk-Othmer, "Phosporous Flame retardants", *Encyclopedia of Chemical Technology*, vol. 10, 1993, pp. 976–993; *Kirk-Othmer Encyclopedia of Chemical Technology*, 4th ed., vol. 25, John Wiley & Sons, New York, 1998, pp. 627–664; Fire Retardant Chemical Association (FRCA) (http://www.arcat.com); International Resources (Columbus, Md.); *Handbook of Flame Retardant Chemicals and Fire Testing Services*, Russell C. Kidder, Technomic Publ. (1994); *Fire Hazard Comparison of Fire-Retarded and Non-Fire-Retarded Products*: Results of a Test Program Conducted by the Center for Fire Research for the Fire Retardant Chemicals Association, Publishing Company Technomic (Editor), Paperback-January 1988; *Fire Retarded Polymer Applications*, Kidder, Hardcover, January 1997; and *Fire Safety through Use of Flame Retarded Polymers*: Papers-Joint Meeting SPE and Fire Retardant Chemicals Association, Adam's Mark Hotel, Houston, Tex., Mar. 25–27, 1985; Society of Plastics Engineers Staff, Paperback/Books on Demand.

Suitable specific fire retardants include, e.g., phosphonium ammonium borate (i.e., phospho-ammonium boron); 3,4,5,6-dibemzo-1,2-oxaphosphane-2-oxide or 9,10-dihydro-9-oxa-10-phospaphe nanthrene-10-oxide (OPC) [CAS Registry Number 35948-25-5]; sulfamic acid monoammonium salt (ammonium sulfamate) [CAS Registry Number 7773-06-0]; di-n-butyltin oxide (DBTO) [CAS Registry Number 818-08-6]; di-n-octyltin oxide (DOTO) [CAS Registry Number 780-08-6]; dibutyltin diacetate di-n-butyltin diacetate (NS-8) [CAS Registry Number 1067-33-0]; dibutyltin dilaurate di-n-butyltin dilaurate (Stann BL) [CAS Registry Number 77-58-7]; ferrocene; iron pentacarbonyl; ammonium sulfate; ammonium phosphate; zinc chloride; and combinations thereof.

As used herein, a "stabilizer" refers to a substance that when added to a plastic or polymeric material, will prevent or slow down the aging and weathering changes. See, e.g., Concise Chemical and Technical Dictionary, Fourth Enlarged Edition, Bennet, Chemical Publishing Co., NY, N.Y. (1986).

As used herein, an "electrically conductive material" or "electrical conductive material" refers to any substance that increases the electrical conductivity of the article of manufacture (e.g., foam cushion). Suitable electrically conductive materials include, e.g., metal containing substances.

Each of the cure retarder, a reinforcing agent, a filler, a colorant, an extender, a placticizer, a vulcanization agent, an antioxidant, a fire retardant, electrically conductive material, and a stabilizer can be employed in any suitable and appropriate amount. For example, any one or more of the cure retarder, a reinforcing agent, a filler, an extender, a placticizer, a vulcanization agent, an antioxidant, a fire retardant, and a stabilizer can be employed up to about 40 wt. % of the foam cushion, up to about 20 wt. % of the foam cushion, up to about 10 wt. % of the foam cushion, or up to about 1 wt. % of the foam cushion. Typically, any one or more of the cure retarder, a reinforcing agent, a filler, an extender, a placticizer, a vulcanization agent, an antioxidant, a fire retardant, and a stabilizer can be employed up to about 5 wt. % of the foam cushion, up to about 1 wt. % of the foam cushion, or up to about 0.5 wt. % of the foam cushion.

One specific foam cushion is formed from: (a) at least one of natural rubber and an ethylene-vinyl acetate (EVA) copolymer; (b) azodicarbonamide (AC); (c) FUSABOND; (d) dicumyl peroxide; and (e) a combination of zinc oxide and stearic acid.

Another specific foam cushion is formed from: (a) natural rubber employed in about 5 wt. % to about 12 wt. % of the foam cushion; (b) an ethylene-vinyl acetate (EVA) copolymer employed in about 79 wt. % to about 83 wt. % of the foam cushion; (c) azodicarbonamide (AC) employed in about 3 wt. % to about 4.2 wt. % of the foam cushion; (d) FUSABOND employed in about 2.8 wt. % to about 3.9 wt. % of the foam cushion; (e) dicumyl peroxide employed in about 0.5 wt. % to about 0.9 wt. % of the foam cushion; and (f) a combination of zinc oxide and stearic acid, wherein the zinc oxide is employed in about 1.0 wt. % to about 2.2 wt. % of the foam cushion and stearic acid is employed in about 0.5 wt. % to about 1.25 wt. % of the foam cushion.

The seat, backrest, or both, of the present invention can include one or more (e.g., up to about 100, up to about 50, or up to about 25) layers. Each of the layers can independently include the components (e.g., (a) at least one of rubber and a resin, (b) a blowing agent, (c) a polymeric adhesion modifier, (d) a decomposition accelerating agent, and (e) a cross-linking agent), as disclosed herein, for an article of manufacture (e.g., foam cushion). Specifically, any one or more layers can have different compositions from the other layers. For example, any one or more layers of the article of manufacture (e.g., foam cushion) can include (a) rubber, (b) a blowing agent, (c) a polymeric adhesion modifier, (d) a decomposition accelerating agent, and (e) a cross-linking agent; any one or more other layers can include (a) a resin, (b) a blowing agent, (c) a polymeric adhesion modifier, (d) a decomposition accelerating agent, and (e) a cross-linking agent; any one or more other layers can include (a) both rubber and a resin, (b) a blowing agent, (c) a polymeric adhesion modifier, (d) a decomposition accelerating agent, and (e) a cross-linking agent; and any one or more other layers can include (a) at least one of rubber and a resin, (b) a blowing agent, (c) a polymeric adhesion modifier, (d) a decomposition accelerating agent, (e) a cross-linking agent, and at least one of a cure retarder, a reinforcing agent, a filler, an extender, a placticizer, a vulcanization agent, an antioxidant, a fire retardant, an accelerator, a colorant, an electrically conductive material, and a stabilizer. Alternatively, each of the one or more layers can include the same components, in the about same amounts.

The seat, backrest, or both, of the present invention can optionally be laminated employing those materials, conditions, and methods known to those of skill in the art of lamination.

The seat, backrest, or both, of the present invention can optionally be elastic, elastomeric, stretchable, and/or biaxial stretchable.

The seat, backrest, or both, disclosed herein can have a density or specific gravity greater than, equal to, or less than that of liquid water, at a specified temperature (e.g., 4° C.). Specifically, the article of manufacture (e.g., foam cushion) disclosed herein can have a density or specific gravity less than that of liquid water, at a specified temperature (e.g., 4° C.). For example, liquid water has a density of about 1.00 g/mL at about 4° C., a density of about 0.98 g/mL at about 65° C., a density of about 0.97 g/mL at about 83° C., and a density of about 0.96 g/mL at about 97° C. Additionally, the article of manufacture (e.g., foam cushion) can have a relative density of up to about 0.90 of liquid water, a relative density of up to about 0.80 of liquid water, a relative density of up to about 0.70 of liquid water, or a relative density of up to about 0.60 of liquid water. In one specific embodiment of the present invention, the article of manufacture (e.g., foam cushion) disclosed herein can float on water.

As used herein, "relative density" refers to the ratio of absolute density of a substance, expressed in grams per milliliter, to the absolute density of water at a given temperature, expressed in grams per milliliter.

As used herein, "extruding" or "extrusion" refers to the forcing of a material through a suitable shaped orifice under compressive forces. The most widely used method for producing extruded shapes is direct, hot extrusion process. In this process, a heated billet of material is placed in a cylindrical chamber and then compressed by a hydraulically operated ram. The opposite end of the cylinder contains a die having an orifice of the desired shape; as this die opening is the path of least resistance for the billet under pressure, the substance, in effect, squirts out of the opening as a continuous bar having the same cross-sectional shape as the die opening. The material to be extruded, prior to or during the extrusion, can optionally be heated, partially heated, cooled, or partially cooled.

As used herein, "adhesive bonding" refers to an adhesive, such as a hot melt adhesive, that can be applied between two materials to bind them together.

As used herein, the term "auxiliary blowing agents" refers to compounds used to produce gases to expand, or blow a flexible material (e.g., foam) during production. Most auxiliary blowing agents are low temperature boiling solvents, for example, chlorofluorocarbons, methylene chloride, methyl chloroform, acetone, hydrochlorofluorocarbons, isopentane or combinations thereof.

As used herein, the term "ball rebound" refers to a test procedure used to measure the surface resiliency of a flexible material (e.g., foam). The test involves dropping a steel ball of known mass from a predetermined height onto a sample of the material. The rebound height attained by the steel ball, expressed as a percentage of the original drop height, is the ball rebound resiliency value.

As used herein, the term "biaxial stretch" refers to a material (e.g., foam) having stretchability in two directions perpendicular to one another, e.g. stretchability in a longitudinal direction (front to back) and a lateral direction (side to side).

As used herein, the term "bottoming out" refers to a lack of support of a cushioning material under full weight load. A cushion that bottoms out can sink down until the sitter feels the structure underneath.

As used herein, the term "coccydynia" refers to the pain suffered by a human in the coccyx and neighboring regions. The coccyx is a small bone that articulates with the sacrum and usually consists of four fused vertebrae which form the terminus of the spinal column in a human.

As used herein, the term "comfort" or "comfortable" refers to the ability of the material (e.g., foam) to reflect at the surface and to conform to the body shape, preventing a concentration of pressure on the body without bottoming out.

As used herein, the term "cradling" refers to the distribution of body weight uniformly over the sitting and leaning area of a seat or backrest.

As used herein, the term "density" refers to a measurement of the mass per unit volume measured and expressed in pounds per cubic foot (pcf).

As used herein, the term "elastic," refers to that property of a material where upon the removal of an extending force, is capable of substantially recovering its original size and shape and/or exhibits a significant retractive force.

As used herein, the term "felted" refers to a flexible material (e.g., foam) that has been densified by heat and compression for use as a vibration dampening or shock absorbing material.

As used herein, the term "fatigue" refers to a tendency of a material (e.g., foam) to soften under cyclic stresses. Fatigue can be measured by cyclicly compressing and relaxing a flexible sample and measuring its change in Indentation Force Deflection (IFD).

As used herein, the term "firm" or "firmness" refers to the ability of a material (e.g., foam) to maintain its original form under load-bearing pressure as measured by the Indentation Force Deflection.

As used herein, the term "High Resilience (HR) foam" refers to foam that has a very rapid recovery from extreme compression and a fairly linear increase in resistance to compression per unit of penetration.

As used herein, the term "Indentation Force Deflection" (IFD) refers to a measure of the load bearing capacity of a flexible material (e.g., foam) measured as the force (in pounds) required to compress a four inch thick sample no smaller than 24 inches square, to 25 percent of the sample's initial height. Flexible foam IFD measurements can range from about 5 pounds (plush) to about 80 pounds (very firm).

As used herein, the term "loin" refers to the area on each side of the backbone of a human or animal between the ribs and hips.

As used herein, the term "mixed and prepared separately" refers to sections of a material (e.g. foam) that can be partially cooked, completely cooked, not cooked at all, or a combination thereof. Further, the sections can be cooled, frozen or a combination thereof.

As used herein, the term "nonwoven" refers to fibrous materials and webs of fibrous material which are formed without the aid of a textile weaving or knitting process.

As used herein, the term "plush" refers to a material (e.g., foam) with an Indentation Force Deflection of about 4 to about 25 pounds per 50 inches squared on a 4" thick sample compressed to 25 percent of the sample's initial height.

As used herein, the term "polyurethane foam" refers to a foam that is produced from a reaction of two key chemicals, a polyol and an isocyanate with water. These chemicals are mixed together vigorously in high intensity mixers in specific amounts with other ingredients.

As used herein, the term "polyester" refers to a family of organic polymers characterized by the presence of ester groups RC(=O)OR, wherein each R is independently hydrogen or a hydrocarbon, within the molecule. Polyesters can be prepared to have reactive hydroxyl groups and thus can be used as a polyol in the preparation of urethane foam. Esters are more susceptible to hydrolysis than are ethers.

As used herein, the term "polyol" refers to a chemical compound having more than one reactive hydroxyl group within the molecule. Polyol usually refers to a glycerine based product with three reactive hydroxyl groups.

As used herein, the term "pre-prepared mold" refers to coating the mold with a substance (e.g., silicon), pre-heating the mold, cooling the mold, freezing the mold, or a combination thereof prior to filling the mold and/or placing the filled mold into a hot press.

As used herein, the term "pressure ulcer" refers to a suppurating sore on the skin caused by prolonged and sustained pressure on the surface of the skin that does not heal and results in the destruction of tissue.

As used herein, the term "ratio of firmness" refers to the relationship of seat firmness to backrest firmness.

As used herein, "relative density" refers to the ratio of absolute density of a substance, expressed in grams per milliliter, to the absolute density of water at a given temperature, expressed in grams per milliliter.

As used herein, "resilience" refers to the surface elasticity of a material (e.g., foam). Resilience is measured by dropping a standard steel ball onto a foam sample from a given height and measuring the percentage that the steel ball rebounds.

As used herein, "sacrum" refers to triangular bone at the base of the spine that joins to a hip bone on either side and forms part of the pelvis. In human beings it consists of five fused vertebrae.

As used herein the term "sciatica" refers to pain along the course of a sciatic nerve especially in the back of the thigh. The sciatic nerve is either of the pair of largest nerves in the body that arise one on each side from the nerve plexus supplying the posterior limb and pelvic region and that pass out of the pelvis and down the back of the thigh.

As used herein, the term "shredded foam" refers to flexible foam that has been torn into small pieces or crumbs, for the purpose of creating a filling material.

As used herein, the term "sonic bonding" refers to a process performed, for example, by passing a material (e.g., foam) between a sonic horn and anvil roll.

As used herein, the term "support" refers to a material (e.g., foam) that does not compress to the point where the material no longer holds up to the weight of a person.

As used herein, the term "support factor" refers to the ratio of 65% Indentation Force Deflection divided by 25% Indentation Force Deflection.

As used herein, "thermal bonding" refers to passing a material (e.g., foam) to be bonded between a heated calender roll and an anvil roll.

As used herein, the term "thrombosis" refers to the formation or presence of one or more blood clots that may partially or completely block an artery, for example, flowing to the heart or brain, or a vein.

In the following detailed description, reference is made to the accompanying drawings which form a part hereof, and in which is shown by way of illustration specific embodiments in which the invention can be practiced. These embodiments are described in sufficient detail to enable those skilled in the art to practice the invention, and it is to be understood that other embodiments can be utilized and that structural changes can be made without departing from the scope of the present invention. Therefore, the following detailed description is not to be taken in a limiting sense, and the scope of the subject matter of this application is defined by the appended claims and their equivalents.

A specific foam cushion useful in manufacturing a seat, backseat, or both of the present invention can be manufactured as provided below:

It has surprisingly been discovered that the use of specific materials described herein can be used to manufacture a seat, backrest, or a combination thereof that includes multiple zones with the materials. Specifically, the seat, backrest or combination thereof can include more than one material (e.g., 2, 3, 4, or 5). However, it may be relatively inexpensive to manufacture the seat, backrest, or combination thereof from only one material. In such an embodiment, the seat, backrest, or combination thereof includes a soft, continuous one piece seamless elastic material that is fatigue resistant.

Methods of Manufacturing the Foam Cushion

Each of the (a) rubber and/or resin; (b) a blowing agent; (c) a polymeric adhesion modifier; (d) cross-linking agent; and (e) decomposition accelerating agent; alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer), can be combined, in any suitable and appropriate manner, in any suitable and appropriate order, and under any suitable and appropriate conditions, to effectively provide a foam cushion.

First Mixture

Rubber, a resin, a blowing agent, a polymeric adhesion modifier, and a decomposition accelerating agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer) can be mixed to form a first mixture. The rubber, resin, blowing agent, polymeric adhesion modifier, and decomposition accelerating agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer) can be mixed, in any order, to form the first mixture.

The rubber, resin, blowing agent, polymeric adhesion modifier, and decomposition accelerating agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer) can be mixed, under any suitable and appropriate conditions, to form the first mixture. For example, the rubber, resin, blowing agent, polymeric adhesion modifier, and decomposition accelerating agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer) can be mixed at any suitable and appropriate temperature. Specifically, the rubber, resin, blowing agent, polymeric adhesion modifier, and decomposition accelerating agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer) can be mixed at a temperature above about 0° C., above about 25° C., above about 50° C., above about 80° C., above about 100° C., or above about 150° C. More specifically, the rubber, resin, blowing agent, polymeric adhesion modifier, and decomposition accelerating agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer) can be mixed at about 80° C. to about 160° C., at about 100° C. to about 140° C., or at about 110° C. to about 130° C.

Additionally, the rubber, resin, blowing agent, polymeric adhesion modifier, and decomposition accelerating agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer) can be mixed for any suitable and appropriate period of time. For example, the rubber, resin, blowing agent, polymeric adhesion modifier, and decomposition accelerating agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer) can be mixed for more than about 1 minute, more than about 5 minutes, or more than about 10 minutes. Specifically, the rubber, resin, blowing agent, polymeric adhesion modifier, and decomposition accelerating agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer) can be mixed for about 8 minutes to about 20 minutes.

Specifically, rubber, a resin, a blowing agent, a polymeric adhesion modifier, and a decomposition accelerating agent are combined in any order and are mixed for about 8 minutes to about 20 minutes at about 110° C. to about 130° C. to form a first mixture. More specifically, rubber, a resin, a blowing agent, a polymeric adhesion modifier, and a decomposition accelerating agent are combined in any order and are mixed for about 8 minutes to about 20 minutes at about 110° C. to about 130° C. to form a first mixture. More specifically, natural rubber, an ethylene-vinyl acetate (EVA) copolymer, azodicarbonamide (AC), a FUSABOND, zinc oxide, and stearic acid are combined in any order and are mixed for about 8 minutes to about 20 minutes at about 110° C. to about 130° C. to form a first mixture.

Second Mixture

The first mixture and a cross-linking agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer), can be combined to effectively provide a second mixture. The first mixture and a cross-linking agent, alone or in combination with the one or more optional components (e.g., cure retarder, a reinforcing agent, a filler, an extender, a placticizer, a vulcanization agent, an antioxidant, a fire retardant, a colorant, an electrically conductive material, and a stabilizer), can be combined, in any suitable and appropriate manner, in any suitable and appropriate order, and under any suitable and appropriate conditions, to effectively provide a second mixture.

The second mixture can be mixed at any suitable and appropriate temperature. Specifically, the second mixture can be mixed at a temperature of above about 0° C., above about 25° C., above about 50° C., above about 75° C., or above about 100° C. More specifically, the second mixture can be mixed at a temperature of between about 100° C. and 140° C. or between about 110° C. and 130° C.

The second mixture can be mixed for any suitable and appropriate period of time. Specifically, the second mixture can be mixed for more than about 1 minute, for more than about 2 minutes, for more than about 5 minutes, or for more than about 10 minutes. More specifically, the second mixture can be mixed for a period of time between about 1 minute and about 8 minutes or for a period of time between about 2 minutes and about 4 minutes.

The second mixture can be spread to form one or more sheets. The second mixture can be spread, to form the one or more sheets, employing any suitable and appropriate method. The one or more sheets can have any suitable and appropriate size (i.e., length, width, and thickness). Specifically, the one or more sheets can have a length of more than about 1 ft., more than about 2 ft., or more than about 5 ft. Specifically, the one or more sheets can have a width of more than about 1 ft., more than about 2 ft., or more than about 5 ft. Specifically, each of the one or more sheets can have a thickness of between about 0.01 mm and about 1 cm., of between about 0.5 mm and about 50 mm, of between about 0.5 mm and about 20 mm, or of between about 1 mm and about 8 mm. The one or more sheets can have a combined thickness of more than about 0.25 inch, more than about 0.5 inch, or more than about 1 inch. Specifically, the one or more sheets can have a combined thickness of up to about 12 inches, up to about 6 inches, or up to about 4 inches. More specifically, the one or more sheets can have a combined thickness of between about 0.5 inch and about 10 inches or between about 1 inch and about 6 inches or between about 2 inches and about 6 inches.

Cooling

The one or more sheets can optionally be cooled. The one or more sheets can optionally be cooled in any suitable and appropriate manner to any suitable and appropriate temperature and for any suitable and appropriate period of time. Specifically, the one or more sheets can optionally be cooled to below about 100° C., to below about 80° C., to below about 75° C., or to below about 50° C. Specifically, the one or more sheets can be cooled for more than 10 seconds, for more than for 1 minute, or for more than 5 minutes.

Cutting

The one or more sheets can optionally be cut. The one or more sheets can optionally be cut in any suitable and appropriate manner (e.g., knife, razor, laser, etc.).

Stacking

The one or more sheets can be stacked, one on top of the other. Prior to stacking the one or more sheets, the one or more sheets can optionally be contacted with a non-stick substance. The non-stick substance can be applied to the one or more sheets in any suitable and appropriate manner, e.g., by dipping, spraying, brushing, etc. Additionally, the one or more sheets can be contacted with the non-stick substance at any portion or portions of the one or more sheets. Typically, those surfaces of the one or more sheets that will subsequently come into contact with any machinery can be contacted with the non-stick substance.

As used herein, a "non-stick substance" refers to any substance that can effectively prevent or decrease the likelihood that the one or more sheets will stick to a foreign object (e.g., machinery or press). Any suitable non-stick substance can be employed, provided the non-stick substance will effectively prevent or decrease the likelihood that the one or more sheets will stick to a foreign object (e.g., the machinery or press). Suitable non-stick substances include, e.g., silicone-containing compounds, oils, and waxes. Any suitable amount of non-stick substance can be employed, provided the amount of non-stick substance will effectively prevent or decrease the likelihood that the one or more sheets will stick to a foreign object (e.g., the machinery or press).

Pressing

The one or more sheets can be pressed at an elevated temperature and an elevated pressure to form a cooked stack. The one or more sheets can be pressed at an elevated temperature and an elevated pressure in any suitable and appropriate manner. Typically, the one or more sheets, employing a commercial size press, will be compacted at an elevated temperature and an elevated pressure.

As used herein, "press" refers to exert force against, to bear down on, or to make compact or reshape by applying steady force. See, e.g., *The American Heritage Dictionary of the English Language*, Houghton Mifflin Co., Boston, Mass. (1981).

The one or more sheets can be pressed at any suitable and appropriate temperature to form a cooked stack. For example, the one or more sheets can be pressed at a temperature of above about 50° C., above about 80° C., or above about 160° C. Specifically, the one or more sheets can be pressed at temperature of between about 100° C. and about 200° C. or between about 160° C. and about 175° C.

The one or more sheets can be pressed for any suitable and appropriate period of time to form a cooked stack. For example, the one or more sheets can be pressed for more than about 1 minute, for more than about 10 minutes, for more than about 20 minutes, or for more than about 40 minutes. Specifically, the one or more sheets can be pressed for a period of time between about 15 minutes and about 70 minutes or between about 28 minutes and about 35 minutes.

Attaching

The foam cushion or cooked stack can optionally be attached to one or more other foam cushions obtained as described herein, to form a larger-sized foam cushion. Typically, the pieces of foam cushion or cooked stack are attached on an end-to-end fashion. The attachment can be performed with any suitable device to effectively provide the larger-sized foam cushion. The attachment can be performed, e.g., employing a laser, hot knife machine, adhesive, cauterization, or any combination thereof.

Extrusion

The foam cushion can be manufactured via layers by forming sheets, cooling the sheets, pressing the sheets, stacking the sheets, and slicing the sheets as described herein. Alternatively, the foam cushion can be manufactured by extruding the second mixture or by extruding the sheet. The second mixture or the sheet to be extruded can optionally be cooled, or partially cooled prior to and/or during the extrusion. Additionally, the second mixture or the sheet to be extruded can optionally be heated, or partially heated prior to and/or during the extrusion.

When the second mixture or the sheet to be extruded is cooled (or partially cooled), the second mixture or the sheet is cooled prior to and/or during the extrusion to a temperature of less than about 150° C., less than about 100° C., less than about 75° C., or less than about 50° C.

When the second mixture or the sheet to be extruded is heated (or partially heated), the second mixture or the sheet is heated prior to and/or during the extrusion to a temperature of about 50° C., above about 75° C., above about 100° C., or above about 150° C.

Rinsing

The foam cushion can optionally be rinsed with a suitable substance to remove any debris, dirt, film, residue, non-stick substance, or piece of foam cushion that was previously cut as described above, which may exist on the foam cushion from the manufacturing process. Suitable substances useful in the optional rinsing step include, e.g., aqueous solutions that optionally include soaps and/or surfactants. Specifically, the suitable substance can be water. The suitable substance can be relatively hot or relatively cold. Specifically, the temperature of the suitable substance employed can be up to about 120° C., up to about 100° C., up to about 80° C., up to about 60° C., up to about 40° C., or up to about 20° C.

Scrubbing

The foam cushion can optionally be scrubbed to remove any debris, dirt, film, residue, non-stick substance, or piece of foam cushion that was previously cut as described above, which may exist on the foam cushion from the manufacturing process. The optional scrubbing step can be carried out with suitable non-abrasive material, e.g., a piece of foam cushion, a cloth, or a rag. Alternatively, the optional scrubbing step can be carried out with any suitable abrasive material, e.g., a brush, pad, steel wool, teflon coated scrubber, grinder, etc.

Drying

The foam cushion can optionally be dried to remove any undesirable moisture that may exist on the foam cushion from the rinsing and/or scrubbing steps described above. The optional drying step can be carried out in any suitable and appropriate manner. Specifically, the drying can be carried out by forcing relatively dry (e.g., less than 75% relative humidity, less than about 50% relative humidity, or less than about 25% relative humidity) and hot air (e.g., above about 25° C., above about 50° C., above about 75° C., or above about 100° C.) over and across the surfaces of the foam cushion. Alternatively, the drying can be carried out by allowing the foam cushion to drip-dry.

In one embodiment, the foam cushion described herein can be substantially uniform in composition. Alternatively, in another embodiment, the foam cushion described herein can be non-uniform in composition. Likewise, in one embodiment, the foam cushion described herein can uniform regarding physical properties (e.g., density, elasticity, etc.). Alternatively, in another embodiment, the foam cushion described herein can non-uniform regarding the physical properties (e.g., density, elasticity, etc.). For example, the foam cushion described herein can include multiple layers, wherein each layer independently includes a foam cushion as described herein. Specifically, the foam cushion described herein can include multiple layers, wherein each layer includes the same ingredients (is manufactured from the same ingredients), in the same amount, and possesses the same physical properties (e.g., density, elasticity, etc.). Alternatively, the foam cushion described herein can include multiple layers, wherein the layers include different ingredients (is manufactured from different ingredients), the layers include the same ingredients (is manufactured from the same ingredients) in different amounts, and the layers posses different physical properties (e.g., density, elasticity, etc.). In such a specific embodiment wherein the foam cushion described herein includes multiple layers and at least one of the layers includes the same ingredients (is manufactured from the same ingredients) in different amounts, includes different ingredients (is manufactured from different ingredients) or includes the same ingredients (is manufactured from the same ingredients) in different amounts, such a layer will typically possess different physical properties (e.g., density, elasticity, etc.).

FIG. 1 illustrates one embodiment of a seat 10. The seat 10 includes a pelvic zone 12 area shaped to accommodate the area of the human pelvis. A seat comfort zone 22 peripherally encompasses the pelvic zone 12. A front seat zone 14 is adjacent to a front side of the seat comfort zone 22. A first side seat zone 18, a second side seat zone 20 and a rear seat zone 16 peripherally encompass a first side, a second side and a rear side, respectively, of the seat comfort zone 22.

The seat comfort zone 22, the pelvic zone 12, the first side seat zone 18, the second side seat zone 20, the front seat zone 14, and the rear seat zone 16 include a soft elastic material. The front seat zone 14 is less firm than the first side seat zone 18, the second side seat zone 20, the rear seat zone 16, the seat comfort zone 22 and the pelvic zone 12. The first side seat zone 18, the second side seat zone 20 and the rear seat zone 16 are more firm than the front seat zone 14, the seat comfort zone 22 and the pelvic zone 12. The pelvic zone 12 is more elastic than the front seat zone 14, the seat comfort zone 22, the first side seat zone 18, the second side seat zone 20 and the rear seat zone 16.

In one embodiment, the seat 10 includes a soft, continuous, one piece seamless elastic material that is fatigue resistant. The soft elastic material includes any suitable material described herein.

The front seat zone 14 of the seat 10 includes a soft elastic material that is in one option, more soft than the first side seat zone 18, the second side seat zone 20, the rear seat zone 16, the seat comfort zone 22 and the pelvic zone 12 of the seat 10. The first side seat zone 18, the second side seat zone 20 and the rear seat zone 16 of the seat 10 includes a soft elastic material that is in one option, more firm than the front seat zone 14, the seat comfort zone 22 and the pelvic zone 12 of the seat 10. The pelvic zone 12 of the seat 10 includes a soft elastic material that is in one option, more elastic than the front seat zone 14, the first side seat zone 18, the second side seat zone 20, the rear seat zone 16 and the seat comfort zone 22 of the seat 10.

In another embodiment, the seat 10 includes at least two pieces of the soft elastic material described herein, which can be combined to provide the appropriate soft, elastic and firmness properties of the pelvic zone 12, the seat comfort zone 22, the front seat zone 14, the first side seat zone 18, the second side seat zone 20 and the rear seat zone 16. The at least two pieces of the soft elastic material can be integrally assembled together employing various types of attachment, including, but not limited to sewing, adhesives, bonding (e.g., adhesive, sonic or thermal) or a combination thereof.

In another embodiment, the seat 10 includes, polyurethane foam, shredded foam, High Resilience foam, latex foam rubber, down, polyester, cotton, or a combination thereof to provide the various zones of the seat 10 described herein. These materials can be integrally assembled together employing various types of attachment means including sewing, adhesives, bonding (e.g., adhesive, sonic or thermal) or a combination thereof.

These various materials can be combined to provide the appropriate soft, elastic and firm properties of the pelvic zone 12, the seat comfort zone 22, the front seat zone 14, the first side seat zone 18, the second side seat zone 20 and the rear seat zone 16 of the seat 10 that is resistant to fatigue.

Figure 2:
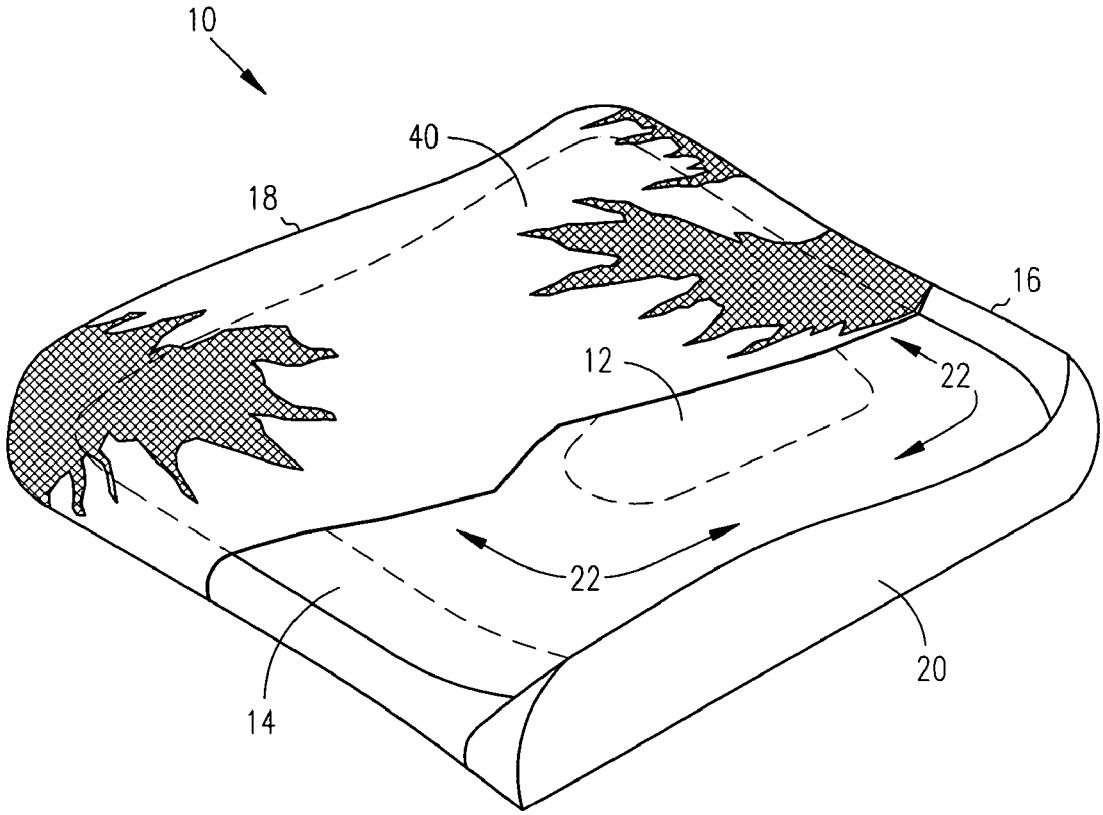
FIG. 2 is an isomeric view of a seat constructed in accordance with one embodiment.

As in FIG. 1, FIG. 2 illustrates one embodiment of the seat 10. The seat 10 includes upholstery or a covering by a seat covering 40. The seat covering 40 includes, but is not limited to, non-woven fabrics (e.g., spun bond nonwoven fabric made from a thermoplastic polyurethane elastomer or a melt blown unwoven fabric); woven fabrics, knitted cloth, vinyl, leather, or a combination thereof.

The various seating zones described in FIGS. 1 and 2 uniformly distribute body weight which results in lower pressure between the interface of the seating system and the parts of the body which are in contact with the seating system. However, pressure on the body can prevent or alleviate certain human ailments. For example, the soft compliant front seat zone 14 of the seat 10 can alleviate arterial pressure from the lower thighs which can inhibit blood flow. Reduced arterial pressure can reduce blood clotting that can partially or completely block an artery or vein. The soft compliant front seat zone 14 of the seat 10 can also alleviate pressure on the sciatic nerve. Therefore, the front seat zone 14 can aid serious medical conditions or reduce the likelihood of series medical conditions such as thrombosis or sciatica. The highly elastic properties of the pelvic zone can provide improved support to the pelvis, tailbone and lower back which can relieve human ailments such as coccydynia.

The front seat zone 14, the seat comfort zone 22 and the pelvic zone 12 of the seat 10 can distribute body weight and reduce lower body pressure decreasing pressure sores and ulcers or the formation of pressure sores and ulcers that can result from extended periods of sitting (e.g., long periods of air travel or being confined to the use of a wheel chair). The firm first side seat zone 18, the second side seat zone 20, the rear seat zone 16, or a combination thereof of the seat 10 can be flat or elevated with respect to the front seat zone 14, the seat comfort zone 22, the pelvic zone 12, or a combination thereof. The first side seat zone 18 and the second side seat zone 20 of the seat 10 can provide lateral support. Improved lateral support can improve the sitting capability for individuals that tend to slip easily from a neutral posture. Improved lateral support can also improve the sitting capability for individuals with limited side-to-side stability or poor balance.

Figure 3:
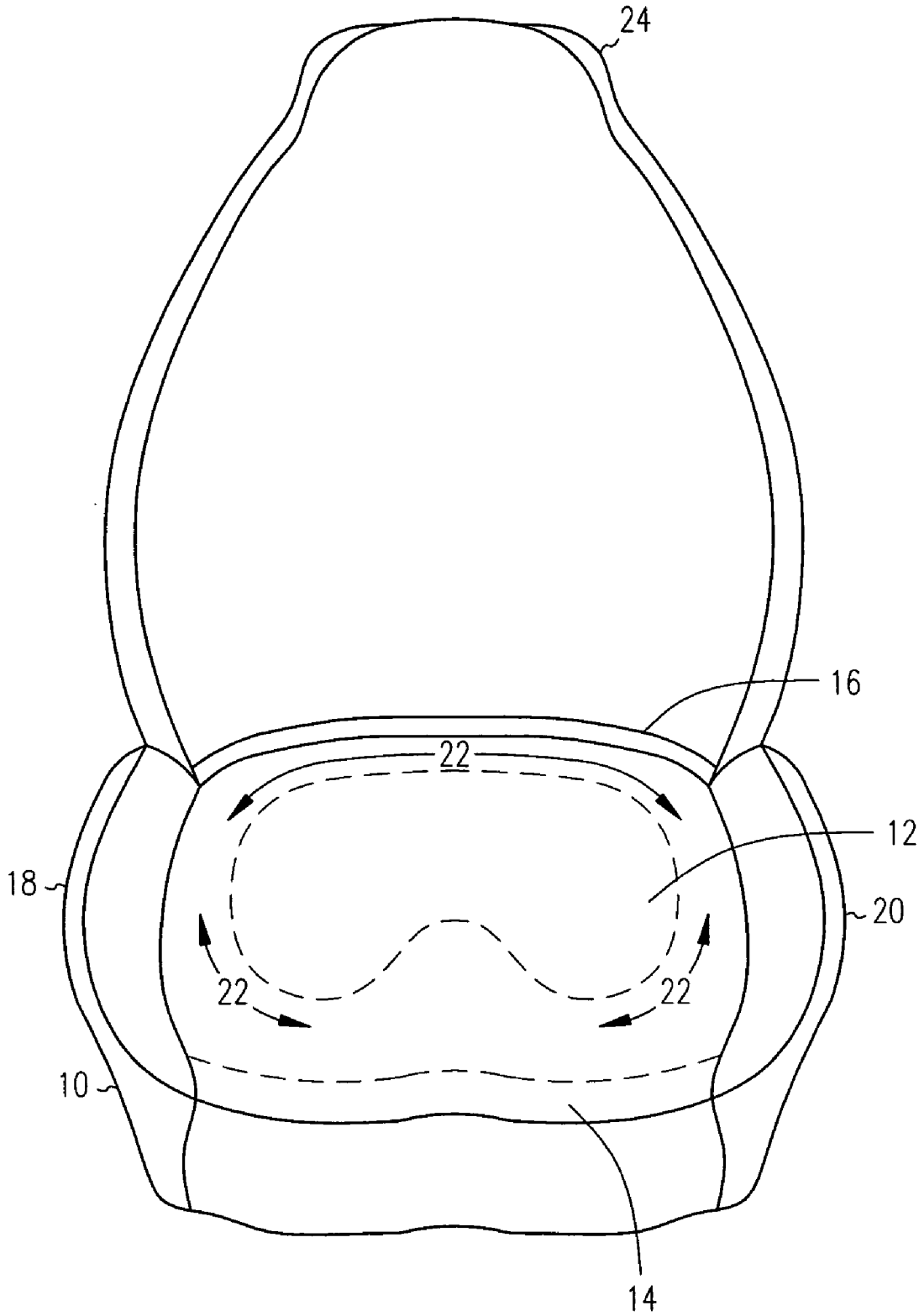
FIG. 3 is a front view of a seat constructed in accordance with one embodiment.

As in FIG. 1, FIG. 3 illustrates one embodiment of the seat 10 with a backrest 24. The backrest 24 is angularly connected to an area distal to the front seat zone 14 by any mechanical means. The seat 10 includes a pelvic zone 12 shaped to accommodate the area of the human pelvis. Seat comfort zone 22 peripherally encompasses the pelvic zone 12. The first side seat zone 18, the second side seat zone 20 and the rear seat zone 16 peripherally encompasses the seat comfort zone 22 on three sides. The front seat zone 14 is distal to the rear seat zone 16 and adjacent to the first side seat zone 18 and the second side seat zone 20. The backrest 24 is angularly connected to the seat 10 by any mechanical means which can reduce the surface area of the rear seat zone 16 or completely eliminate it.

Figure 4:
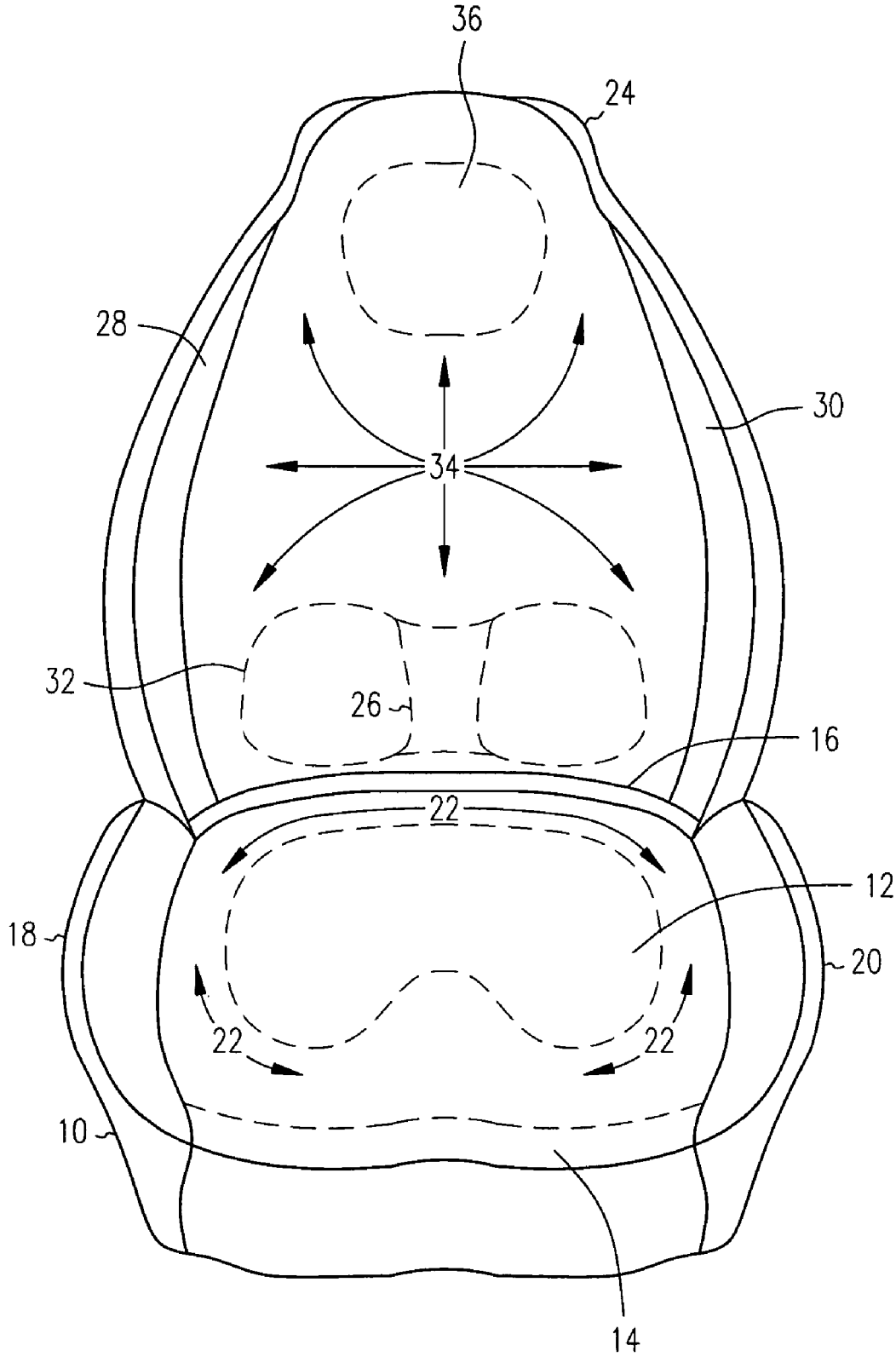
FIG. 4 is a front view of a seat constructed in accordance with one embodiment.

FIG. 4 illustrates one embodiment of the seat 10 with the backrest 24. The backrest 24 is angularly connected by any mechanical means to an area distal to the front seat zone 14. The backrest 24 is angularly connected to the seat 10 by any mechanical means which can reduce the surface area of the rear seat zone 16 or completely eliminate it.

The backrest 24 includes a lower back zone 32 that peripherally encompasses a center back zone 26 on two opposite sides. A backrest comfort zone 34 peripherally encompasses the lower back zone 32 and the center back zone 26. A first side backrest zone 28 and a second side backrest zone 30 peripherally encompass a first side and a second opposite side of the backrest comfort zone 34. A head zone 36 is distal to the seat 10.

The center back zone 26 and the head zone 36 are less firm than the lower back zone 32, the backrest comfort zone 34, the first side backrest zone 28 and the second side backrest zone 30. The first side backrest zone 28 and the second side backrest zone 30 are more firm than the center back zone 26, the head zone 36, the lower back zone 32 and the backrest comfort zone 34. The lower back zone 32 is more elastic than the center back zone 26, the head zone 36, the backrest comfort zone 34, the first side backrest zone 28 and the second side backrest zone 30.

In one embodiment, backrest 24 includes a soft, continuous, one piece seamless elastic material that is resistant to fatigue. The soft elastic material includes any suitable material described herein.

The center back zone 26 and the head zone 36 of the backrest 24 includes a soft elastic material that is less firm than the lower back zone 32, the backrest comfort zone 34, the first side backrest zone 28 and the second side backrest zone 30 of the backrest 24. The first side backrest zone 28 and the second side backrest zone 30 of the backrest 24 include a soft elastic material that is more firm than the center back zone 26, the head zone 36, the lower back zone 32 and the backrest comfort zone 34 of the backrest 24. The lower back zone 32 of the backrest 24 includes a soft elastic material that is more elastic than the center back zone 26, the head zone 36, the backrest comfort zone 34, the first side backrest zone 28 and the second side backrest zone 30 of the backrest 24.

In another embodiment, the backrest 24 includes at least two pieces of the soft elastic material described herein, which can be combined to provide the appropriate soft, elastic and firmness properties of the center back zone 26, the head zone 36, the lower back zone 32, the backrest comfort zone 34, the first side backrest zone 28 and the second side backrest zone 30. The at least two pieces of the soft elastic material can be integrally assembled together employing various types of attachment means. The attachment means include sewing, adhesives, bonding (e.g., adhesive, sonic or thermal) or a combination thereof.

In another embodiment, the backrest 24 includes, polyurethane foam, shredded foam, High Resilience foam, latex foam rubber, down, polyester, cotton, or a combination thereof to provide the various zones of the backrest 24 described herein. These materials can be integrally assembled together employing various types of attachment means including sewing, adhesives, bonding (e.g., adhesive, sonic or thermal) or a combination thereof.

The various materials can be combined to provide the appropriate soft, elastic and firm properties of the center back zone 26, the head zone 36, the lower back zone 32, the backrest comfort zone 34, the first side backrest zone 28 and the second side backrest zone 30 that is resistant to fatigue.

Figure 5:
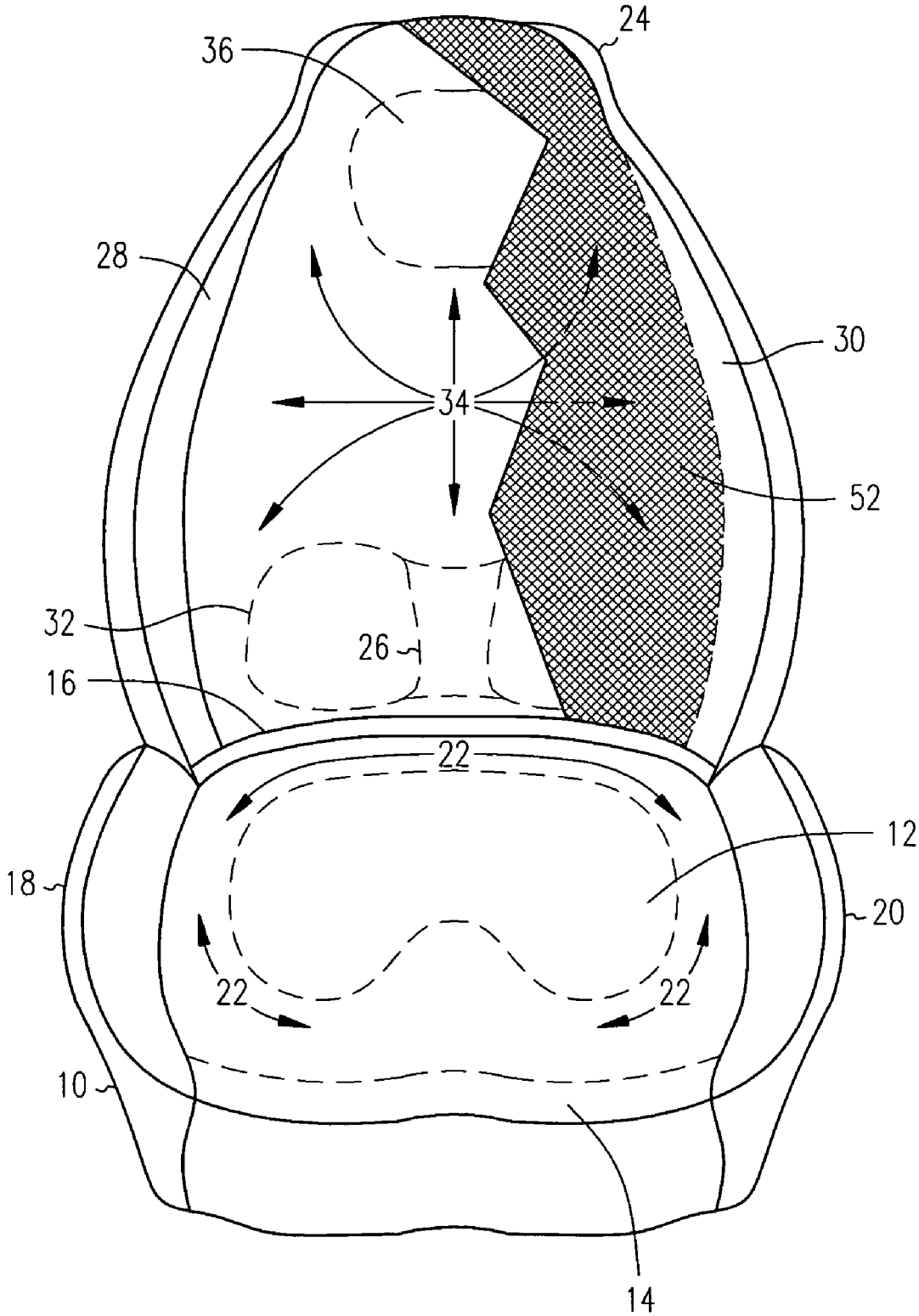
FIG. 5 is a front view of a seat constructed in accordance with one embodiment.

As in FIG. 4, FIG. 5 illustrates one embodiment of the seat 10 with the backrest 24 angularly connected to an area distal to the front seat zone 14 by any mechanical means. The backrest 24 is angularly connected to the seat 10 by any mechanical means which can reduce the surface area of the rear seat zone 16 or completely eliminate it.

The backrest 24 can be upholstered or covered by a backrest covering 52. The backrest covering 52 includes, but is not limited to non-woven fabrics (e.g., spun bond non-woven fabric made from a thermoplastic polyurethane elastomer or a melt blown unwoven fabric); woven fabrics, knitted cloth, vinyl, leather, or a combination thereof.

The various seat and backrest zones described in FIGS. 3, 4 and 5 uniformly distribute body weight which results in lower pressure between the interface of the seating and backrest systems and the parts of the body which are in contact with the seating and backrest systems. However, pressure on the body can prevent or alleviate certain human ailments. For example, the highly elastic properties of the lower back zone 32 of the backrest 24 can support the loin of the back. The soft compliant center back zone 26 can reduce or alleviate pressure on the lower part of the spine and tail bone. The soft compliant head zone 36 can alleviate or reduce neck pressure by allowing the head to rest further into the backrest than the neck area supported by the backrest comfort zone 34 thus providing neck support.

The backrest comfort zone 34 can further provide support and cradle the rib cage and distribute body weight to reduce upper body pressure which can decrease pressure sores and ulcers that can result from extended periods of sitting (e.g., long periods of air travel or being confined to the use of a wheel chair). The firm first side backrest zone 28 and the firm second side backrest zone 30 can be flat or elevated with respect to the front seat zone 14, the seat comfort zone 22, the pelvic zone 12, or a combination thereof. The first side backrest zone 28 and the second side backrest zone 30 can provide lateral support for the back. Improved lateral support can improve the sitting capability for individuals that tend to slip easily from a neutral posture. Improved lateral support can also improve the sitting capability for individuals with limited side-to-side stability or poor balance.

All publications, patents, and patent documents cited herein are incorporated by reference herein, as though individually incorporated by reference. The invention has been described with reference to various specific and preferred embodiments and techniques. However, it should be understood that many variations and modifications may be made while remaining within the spirit and scope of the invention.

The invention will now be illustrated by the following non-limiting examples:

EXAMPLES

A. Following the General Procedure as Outlined Below, a Specific Foam Cushion Useful in Manufacturing a Seat or Bachseat of the Present Invention, can be Manufactured:

General Procedures

I.

(1) Mix the following substances together: at least one or a resin (colored or colorless) and rubber; a blowing agent (optional), a polymeric adhesion modifier (optional), a decomposition accelerating agent (optional), a cross-linking agent (optional), and one or more auxiliary materials (optional) to form a Concentrated Batch and heat (optional) for a period of time;
(2) Cut the Concentrated Batch into desired Lumps;
(3) Thin the Lumps into thin Sheets of desired thickness;
(4) Cool (to room temperature) Sheets (optional);
(5) Cut Sheets to specific length Pieces (optional);
(6) Spray Non-Stick Substance (optional) to all surfaces of the (optionally textured) Press Mold;
(7) Layer a desired number of Pieces to form a Stack in Press Mold;
(8) Cook Stack in Press;
(9) Remove Cooked Stack from Press Mold;
(10) Cook additional Stacks separately in Press Mold;
(11) Trim/Cut Length Ends of Cooked Stacks straight (e.g., at 90° angle or at 45° angle) to Width Ends (optional);
(12) SEE BELOW;
(13) SEE BELOW;
(14) SEE BELOW;
(15) Trim/Cut Width Ends of Extended Length Finished Product Sheet to desired Width;
(16) Rinse and wash Finished Product (optional);
(17) Air dry Finished Product and roll for shipping (optional);
(18) Ship and deliver Finished Product Roll (optional); and
(19) Install Finished Product (optional).

II.

(1) Mix the following substances together: at least one or a resin (colored or colorless) and rubber; a blowing agent (optional), a polymeric adhesion modifier (optional), a decomposition accelerating agent (optional), a cross-linking agent (optional), and one or more auxiliary materials (optional) to form a Concentrated Batch and heat (optional) for a period of time;
(2) Cut the Concentrated Batch into desired Lumps;
(3) Extrude the Lumps into desired size and shape;
(4) Cool (to room temperature) extruded lumps (optional);
(5) Trim/Cut extruded lumps to desired size and shape (optional);
(6) Rinse and wash Finished Product (optional);
(17) Air dry Finished Product and roll for shipping (optional);
(18) Ship and deliver Finished Product Roll (optional); and
(19) Install Finished Product (optional).

It may be possible to do work by hand without the use of any machine or specialized equipment.

(with Cauterization or Laser):

(12) Slice skin off top and/or bottom of Cooked Stacks if desired;
(13) Slice remaining Cooked Stacks to desired thickness (Cooked Sheets); and

(14) Attach many Cooked Sheets end-to-end at Length Ends via cauterization (or laser) to form Extended Length Finished Product Sheet.

(with Glue):

(12) Attach many Cooked Stacks end-to-end at Length Ends via glue to form Extended Length Cooked Stack;

(13) Slice skin off top and/or bottom of attached Extended Length Cooked Stack if desired; and

(14) Slice remaining Extended Length Cooked Stack to desired thickness to Extended Length Finished Product Sheet.

Specifically, the resin can be ethylene vinyl acetate (EVA), the rubber can be caosu, the blowing agent can be vinylfor (AC 7), the polymeric adhesion modifier can be fusabondO, the decomposition accelerating agent can be a combination of zinc oxide and stearic acid, and the cross-linking agent can be dicumyl peroxide (DCP).

Specifically, the batches can be mixed in weights of about 50 Kg which can provide 1 lb/square yard of about 8 mm of Finished Product.

Following the General Procedure as outlined above (with the exceptions as shown below), an article of manufacture can be produced:

Example #1

(2) Mix:
44.86 Kg Ethylene Vinyl Acetate (White Colored),
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 minutes;
mix at 100° C.–130° C. until concentrated to 20 mm thickness.

(2) Cut (1) to 2 Kg Lumps and mix separately at 80° C.–100° C.

(3) Thin Lumps into 1 mm Sheets 6 Ft Width by 7.5 Ft Length.

(4) Cool Sheets slowly to room temperature with non-contact water cooling system.

(5) Cut Sheets to Pieces 6 Width by 7.5 Ft Length.

(6) Apply Silicone Spray to all surfaces of the textured Press Mold.

(7) Layer 50 Pieces in Height in Adjacent Stacks to form an Adjoined Pre-Cooked Stack centered in the Press Mold (with the interior perimeter of the Press Mold exposed up to 50.0% of the surface area).

(8) Cook Stack in Press for 28–35 Minutes at 160° C.–175° C.

(9) Remove Cooked Stack from Press Mold.

(10) Cook 9 additional Stacks separately in Press Mold.

(11) Trim 6 Length Ends of Cooked Stacks straight (at 90° angle) to Width Ends.

(12) Slice 1 mm skin off top and bottom of Cooked Stacks.

(13) Slice remaining Cooked Stacks to 6 mm thickness (Cooked Sheets).

(14) Attach 10 Cooked Sheets end-to-end at Length Ends via cauterization to form Extended Length Finished Product Sheet (75 Ft Length).

(15) Trim 6 Ft Width Ends of Extended Length Finished Product Sheet to 6 Ft Width.

(16) Rinse and wash Finished Product in clean, room temperature water while gently scrub washing with like material brushes.

Example #2

(1) Mix 44.86 Kg Ethylene Vinyl Acetate—White Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.

(2) Cut (1) to 2 Kg Lumps and mix separately at 80° C.–100° C.

(3) Thin Lumps into 1 mm Sheets 6 Ft Width by 7.5 Ft Length.

(4) Cool Sheets slowly to room temperature with non-contact water cooling system.

(5) Cut Sheets to Pieces 6 Ft Width) by 7.5 Ft Length.

(6) Apply Silicone Spray to all surfaces of the Press Mold.

(7) Layer 50 Pieces in Height in Adjacent Stacks to form an Adjoined Pre-Cooked Stack centered in the Press Mold (with interior perimeter of the Press Mold exposed up to 50.0% of the surface area).

(8) Cook Stack in Press for 28–35 Minutes at 160° C.–175° C.

(9) Remove Cooked Stack from Press Mold.

(10) Cook 9 additional Stacks separately in Press Mold.

(11) Trim 6 Ft Length Ends of Cooked Stacks straight (at 90° angle) to Width Ends.

(12) Slice remaining Cooked Stacks to 8 mm thickness (Cooked Sheets).

(13) Attach 10 Cooked Sheets end-to-end at Length Ends via laser to form Extended Length Finished Product Sheet (75 Ft Length).

(14) Trim 6 Ft Width Ends of Extended Length Finished Product Sheet to 6 Ft Width.

(15) Rinse and wash Finished Product in clean, room temperature water while gently scrub washing with like material brushes.

Example #3

(1) Mix 44.86 Kg Ethylene Vinyl Acetate—White Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.

(2) Cut (1) to 2 Kg Lumps and mix separately at 8° C.–100° C.

(3) Thin Lumps into 1 mm Sheets 6 Ft Width by 7.5 Ft Length.

(4) Cool Sheets slowly to room temperature with non-contact water cooling system.

(5) Cut Sheets to Pieces 6 Ft Width by 7.5 Ft Length.

(6) Apply Silicone Spray to all surfaces of the Press Mold.

(7) Layer 52 Pieces in Height in Adjacent Stacks to form an Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.
(9) Remove Cooked Stack from Press Mold.
(10) Cook 9 additional Stacks separately in Press Mold.
(11) Trim 6 Ft Length Ends of Cooked Stacks straight (at 45° angle) to Width Ends.
(12) Slice 1 mm skin off top and bottom of Cooked Stacks.
(13) Slice remaining Cooked Stacks to 10 mm thickness (Cooked Sheets).
(14) Attach 10 Cooked Sheets end-to-end at Length Ends via cauterization to form Extended Length Finished Product Sheet (75 Ft Length).
(15) Trim 6 Ft Width Ends of Extended Length Finished Product Sheet to 6 Ft Width.
(16) Rinse and wash Finished Product in clean, room temperature water while gently scrub washing with like material brushes.

Example #4

(1) Mix 44.86 Kg Ethylene Vinyl Acetate—White Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 6 Ft Width by 7.5 Ft Length.
(4) Cool Sheets slowly to room temperature with non-contact water cooling system.
(5) Cut Sheets to Pieces 6 Ft Width by 7.5 Ft Length.
(6) Apply Silicone Spray to all surfaces of the textured Press Mold.
(7) Layer 50 Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.
(9) Remove Cooked Stack from Press Mold.
(10) Cook 9 additional Stacks separately in Press Mold.
(11) Trim 6 Ft Length Ends of Cooked Stacks straight (e.g., at 90° angle) to Width Ends.
(12) Slice 1 mm skin off top and bottom of Cooked Stacks.
(13) Slice remaining Cooked Stacks to 12 mm thickness (Cooked Sheets).
(14) Attach 10 Cooked Sheets end-to-end at Length Ends via cauterization to form Extended Length Finished Product Sheet (75 Ft Length).
(15) Trim 6 Ft Width Ends of Extended Length Finished Product Sheet to 6 Ft Width.
(16) Rinse and wash Finished Product in clean, room temperature water while gently scrub washing with like material brushes.

Example #5

(1) Mix 44.86 Kg Ethylene Vinyl Acetate—White Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 6 Ft Width by 3 Ft Length.
(4) Cool Sheets slowly to room temperature with non-contact water cooling system.
(5) Cut Sheets to Pieces 6 Ft Width by 3 Ft Length.
(6) Apply Silicone Spray to all surfaces of the Press Mold.
(7) Layer 50 Pieces in Height in one Adjacent Stack to form an Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.
(9) Remove Cooked Stack from Press Mold.
(10) Cook 24 additional Stacks separately in Press Mold.
(11) Trim 3 Ft Length Ends of Cooked Stacks straight (e.g., at 45° angle) to Width Ends.
(12) Slice remaining Cooked Stacks to 6 mm thickness (Cooked Sheets).
(13) Attach 25 Cooked Sheets end-to-end at Length Ends via laser to form Extended Length Finished Product Sheet (75 Ft Length).
(14) Trim 6 Ft Width Ends of Extended Length Finished Product Sheet to 6 Ft Width.
(15) Rinse and wash Finished Product in clean, room temperature water while gently scrub washing with like material brushes.

Example #6

(1) Mix 44.86 Kg Ethylene Vinyl Acetate—White Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 6 Ft Width by 3 Ft Length.
(4) Cool Sheets slowly to room temperature with non-contact water cooling system.
(5) Cut Sheets to Pieces 6 Ft Width by 3 Ft Length.
(6) Apply Silicone Spray to all surfaces of the Press Mold.
(7) Layer 50 Pieces in Height in Adjacent Stacks to form an Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.

(9) Remove Cooked Stack from Press Mold.
(10) Cook 24 additional Stacks separately in Press Mold.
(11) Trim 3 Ft Length Ends of Cooked Stacks straight (e.g., at 90° angle) to Width Ends.
(12) Slice 1 mm skin off top and bottom of Cooked Stacks.
(13) Slice remaining Cooked Stacks to 8 mm thickness (Cooked Sheets).
(14) Attach 25 Cooked Sheets end-to-end at Length Ends via cauterization to form Extended Length Finished Product Sheet (75 Ft Length).
(15) Trim 6 Ft Width Ends of Extended Length Finished Product Sheet to 6 Ft Width.
(16) Rinse and wash Finished Product in clean, room temperature water while gently scrub washing with like material brushes.

Example #7

(1) Mix 44.86 Kg Ethylene Vinyl Acetate—White Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 6 Ft Width by 3 Ft Length.
(4) Cool Sheets slowly to room temperature with non-contact water cooling system.
(5) Cut Sheets to Pieces 6 Ft Width by 3 Ft Length.
(6) Apply Silicone Spray to all surfaces of the textured Press Mold.
(7) Layer 50 Pieces in Height in one Adjacent Stack to form an Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.
(9) Remove Cooked Stack from Press Mold.
(10) Cook 24 additional Stacks separately in Press Mold.
(11) Trim 3 Ft Length Ends of Cooked Stacks straight (e.g., at 45° angle) to Width Ends.
(12) Slice 1 mm skin off top and bottom of Cooked Stacks.
(13) Slice remaining Cooked Stacks to 10 mm thickness (Cooked Sheets).
(14) Attach 25 Cooked Sheets end-to-end at Length Ends via cauterization to form Extended Length Finished Product Sheet (75 Ft Length).
(15) Trim 6 Ft Width Ends of Extended Length Finished Product Sheet to 6 Ft Width.
(16) Rinse and wash Finished Product in clean, room temperature water while gently scrub washing with like material brushes.

Example #8

(1) Mix 44.86 Kg Ethylene Vinyl Acetate—White Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 6 Ft Width by 3 Ft Length.
(4) Cool Sheets slowly to room temperature with non-contact water cooling system.
(5) Cut Sheets to Pieces 6 Ft Width by 3 Ft Length.
(6) Apply Silicone Spray to all surfaces of the textured Press Mold.
(7) Layer 50 Pieces in Height in one Adjacent Stack to form an Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.
(9) Remove Cooked Stack from Press Mold.
(10) Cook 24 additional Stacks separately in Press Mold.
(11) Trim 3 Ft Length Ends of Cooked Stacks straight (e.g., at 45° angle) to Width Ends.
(12) Slice 1 mm skin off top and bottom of Cooked Stacks.
(13) Slice remaining Cooked Stacks to 12 mm thickness (Cooked Sheets).
(14) Attach 25 Cooked Sheets end-to-end at Length Ends via laser to form Extended Length Finished Product Sheet (75 Ft Length).
(15) Trim 6 Ft Width Ends of Extended Length Finished Product Sheet to 6 Ft Width.
(16) Rinse and wash Finished Product in clean, room temperature water while gently scrub washing with like material brushes.

Example #9

(1) Mix 44.86 Kg Ethylene Vinyl Acetate—Black Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 4 Ft Width by 8 Ft Length.
(4) Cool Sheets slowly to room temperature with non-contact water cooling system.
(5) Cut Sheets to Pieces 4 Ft Width by 8 Ft Length.
(6) Apply Silicone Spray to all surfaces of the Press Mold.
(7) Layer 50 Pieces in Height in Adjacent Stacks to form an Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.
(9) Remove Cooked Stack from Press Mold.
(10) Cook additional Stacks separately in Press Mold.
(11) Trim 8 Ft Length Ends of Cooked Stacks straight (e.g., at 45° angle) to Width Ends.

(12) Slice remaining Cooked Stacks in Half to 25 mm (or other) thickness (Cooked Halved Stacks).
(13) Do Not Attach for a single (4 Ft Width by 8 Ft length) Mat, or Attach Cooked Halved Stacks end-to-end at Length Ends via cauterization to form an Extended Length Finished Product Mat.
(14) Trim 4 Ft Width Ends of Single or Extended Length Finished Product Halved Stack to 4 Ft Width.
(15) Rinse and wash Finished Product in clean, room temperature water while gently scrub washing with like material brushes.

Example #10

(1) Mix 44.86 Kg Ethylene Vinyl Acetate—Yellow Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 3 Ft Width by 6 Ft Length.
(4) Cool Sheets slowly to room temperature with non-contact water cooling system.
(5) Cut Sheets to Pieces 3 Ft Width by 6 Ft Length.
(6) Apply Silicone Spray to all surfaces of the textured Press Mold.
(7) Layer 50 Pieces in Height in one Adjacent Stack to form an Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.
(9) Remove Cooked Stack from Press Mold.
(10) Cook additional Stacks separately in Press Mold.
(11) Trim 6 Ft Length Ends of Cooked Stacks straight (e.g., at 45° angle) to Width Ends.
(12) Slice remaining Cooked Stacks in Half to 25 mm thickness (Cooked Halved Stacks).
(13) Do Not Attach for a single (3 Ft Width by 6 Ft length) Pad, or Cut Cooked Halved Stacks in half to form Two single (3 Ft Width by 3 Ft length) Pads.
(14) Trim 3 Ft Width Ends of Finished Product Pad to 3 Ft Width.
(15) Rinse and wash Finished Product in clean, room temperature water while gently scrub washing with like material brushes.

Example #11

(1) Mix 44.86 Kg Ethylene Vinyl Acetate—Yellow Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 3 Ft Width by 6 Ft Length.
(4) Cool Sheets slowly to room temperature with non-contact water cooling system.
(5) Cut Sheets to Pieces 3 Ft Width by 6 Ft Length.
(6) Apply Silicone Spray to all surfaces of the Press Mold.
(7) Layer 30 Pieces in Height in one Adjacent Stack to form an Adjoined Pre-Cooked Stack centered in the Press Mold (with interior perimeter of the Press Mold exposed up to 50.0% of the surface area).
(8) Cook Stack in Press for 18–26 Minutes at 160° C.–175° C.
(9) Remove Cooked Stack from Press Mold.
(10) Cook additional Stacks separately in Press Mold.
(11) Trim 6 Ft Length Ends of Cooked Stacks straight (e.g., at 45° angle) to Width Ends.
(12) Do Not slice skin off top or bottom of Cooked Stacks.
(13) Slice remaining Cooked Stacks in Half to 15 mm thickness (Cooked Halved Stacks).
(14) Do Not Attach for a single (3 Ft Width by 6 Ft length) Pad, or Cut Cooked Halved Stacks in half to form Two single (3 Ft Width by 3 Ft length) Pads, or Attach desired number of Cooked Halved Stacks end-to-end at Length Ends via cauterization to form Extended Length Finished Pad Product.
(15) Trim 3 Ft Width Ends of Finished Pad Product to 3 Ft Width.
(16) Rinse and wash Finished Product in clean, room temperature water while gently scrub washing with like material brushes.

Example #12

(1) Mix 44.86 Kg Ethylene Vinyl Acetate—White (or other) Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 100° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 4 Ft Width by 8 Ft Length.
(4) Cool Sheets slowly to room temperature with non-contact water cooling system.
(5) Cut Sheets to Pieces 4 Ft Width by 8 Ft Length.
(6) Apply Silicone Spray to all surfaces of the Press Mold.
(7) Layer 50 Pieces in Height in one Adjacent Stack to form an Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.
(9) Remove Cooked Stack from Press Mold.
(10) Cook additional Stacks separately in Press Mold.
(11) Trim 8 Ft Length Ends of Cooked Stacks straight (e.g., at 90° angle) to Width Ends.
(12) Do Not Slice or Slice remaining Cooked Stacks in Half to 25 mm thickness (Cooked Halved Stacks).

(13) Do Not Attach for a single (4 Ft Width by 8 Ft length) Product, or Cut Cooked Non-Halved and Halved Stacks in half to form Two single (4 Ft Width by 4 Ft length) Product.
(14) Trim 4 Ft Width Ends of Finished Product to 4 Ft Width.
(15) Rinse and wash Finished Product in clean, room temperature water while gently scrub washing with like material brushes.

Example #13

(1) Mix 44.86 Kg Ethylene Vinyl Acetate—White (or other) Colored,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 4 Ft Width by 8 Ft Length.
(4) Cool Sheets slowly to room temperature with non-contact water cooling system.
(5) Cut Sheets to Pieces 4 Ft Width by 8 Ft Length.
(6) Apply Silicone Spray to all surfaces of the textured Press Mold.
(7) Layer 50 Pieces in Height in Adjacent Stacks to form an Adjoined Pre-Cooked Stack centered in the Press Mold (with interior perimeter of the Press Mold exposed up to 50.0% of the surface area).
(8) Cook Stack in Press for 28–35 Minutes at 160° C.–175° C.
(9) Remove Cooked Stack from Press Mold.
(10) Cook additional Stacks separately in Press Mold.
(11) Trim 8 Ft Length Ends of Cooked Stacks straight (e.g., at 45° angle) to Width Ends. Trim 4 Ft Width Ends of Finished Product to 4 Ft Width.
(12) Slice 1 mm skin off top or bottom of Cooked Stacks.
(13) Cut Cooked Stacks at 4 Inch along 8 Ft Length Cooked Stacks to form Products with the following dimensions 2"×4"×8' or 2"×6"×8'.
(14) Do Not Attach Product.
(15) Do Not Trim.
(16) Rinse and wash Finished Product in clean, room temperature water while gently scrub washing with like material brushes.

Example #14

(1) Mix 44.86 Kg Ethylene Vinyl Acetate—two (or more) Separate Batches each with a Different Color,
4.49 Kg Rubber,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 4 Ft Width by 8 Ft Length for Primary Color. Thin Lumps into 1 mm Sheets 4 Ft Width by 8 Ft Length for Secondary Color.
(4) Cool Sheets slowly to room temperature with non-contact water cooling system.
(5) Cut Sheets to Pieces 2 Ft Width by 4 Ft Length.
(6) Apply Silicone Spray to all surfaces of the Press Mold.
(7) Layer one Primary Color Sheet as desired and one Secondary Color Sheet as desired and roll tightly together along Length for a Log Diameter >50 mm, and duplicate additional identical Logs and place side-by-side along length until a number of Adjoined Pre-Cooked Logs are centered in the Press Mold (with the interior perimeter of the Press Mold exposed up to 50.0% of the surface area).
(8) Cook Adjoined Logs in Press for 28–35 Minutes at 160° C.–175° C.
(9) Remove Cooked Adjoined Logs as Stack from Press Mold.
(10) Cook additional Adjoined Logs separately in Press Mold.
(11) Trim 8 Ft Length Ends of Cooked Stacks straight (e.g., at 45° angle) to Width Ends.
(12) Slice skin off top and bottom of Cooked Stacks for maximum exposure of patterning (optional).
(13) Slice remaining Cooked Stacks in Half to approximately 25 mm thickness (Cooked Halved Stacks).
(14) Attach for a single (4 Ft Width by 8 Ft length) Product.
(15) Trim 4 Ft Width Ends of Finished Product to 4 Ft Width.
(16) Rinse and wash Finished Product in clean, room temperature water while gently scrub washing with like material brushes.

Example #15

(1) Mix 44.86 Kg Ethylene Vinyl Acetate—two (or more) Separate Batches each with a Different Color,
4.49 Kg Rubber,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 4 Ft Width by 8 Ft Length for Primary Color. Thin Lumps into 1 mm Sheets 4 Ft Width by 8 Ft Length for Secondary Color.
(4) Cool Sheets slowly to room temperature with non-contact water cooling system.
(5) Cut Sheets to Pieces 2 Ft Width by 4 Ft Length.
(6) Apply Silicone Spray to all surfaces of the Press Mold.
(7) Layer one Primary Color Sheet as desired and one Secondary Color Sheet as desired and roll tightly together along Length for a Log Diameter >50 mm, and duplicate additional identical Logs and place side-by-side along length until a number of Adjoined Pre-Cooked Logs are centered in the Press Mold (with the interior perimeter of the Press Mold exposed up to 50.0% of the surface area).
(8) Cook Adjoined Logs in Press for 28–35 Minutes at 160° C.–175° C.

(9) Remove Cooked Adjoined Logs as Stack from Press Mold.
(10) Cook additional Adjoined Logs separately in Press Mold.
(11) Trim 8 Ft Length Ends of Cooked Stacks straight (e.g., at 90° angle) to Width Ends. Trim 4 Ft Width Ends of Finished Product to 4 Ft Width.
(12) Slice skin off top and bottom of Cooked Stacks for maximum exposure of patterning.
(13) Slice remaining Cooked Stacks to desired thickness (Cooked Sheets). Cut Cooked Stacks at 4 Inch along 8 Ft Length Cooked Stacks to form Products with the following approximate dimensions 2"×4"×8' or 2"×6"×8'.
(14) Attach.
(15) Trim.
(16) Rinse and wash Finished Product in clean, room temperature water while gently scrub washing with like material brushes.

Example #16

(1) Mix 44.86 Kg Ethylene Vinyl Acetate—two (or more) Separate Batches each with a Different Color,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 4 Ft Width by 8 Ft Length for Primary Color. Thin Lumps into 1 mm Sheets 4 Ft Width by 8 Ft Length for Secondary Color.
(4) Cool Sheets slowly to room temperature with non-contact water cooling system.
(5) Cut Sheets to Pieces 2 Ft Width by 4 Ft Length.
(6) Apply Silicone Spray to all surfaces of the Press Mold.
(7) Layer Primary Color Sheets as desired and Secondary Color Sheets as desired and fold tightly back and forth together like an accordion along Length to a Height >50 mm, and duplicate additional identical Folded Multi-Layers and place side-by-side along length until a number of Adjoined Pre-Cooked Folded Multi-Layers are centered in the Press Mold (with the interior perimeter of the Press Mold exposed up to 50.0% of the surface area).
(8) Cook Adjoined Folded Multi-Layers in Press for 28–35 Minutes at 160° C.–175° C.
(9) Remove Cooked Adjoined Folded Multi-Layers as Stack from Press Mold.
(10) Cook additional Adjoined Folded Multi-Layers separately in Press Mold.
(11) Trim 8 Ft Length Ends of Cooked Stacks straight (e.g., at 45° angle) to Width Ends.
(12) Slice skin off top and bottom of Cooked Stacks for maximum exposure of patterning.
(13) Do Not Slice or Slice remaining Cooked Stacks in Half to approximately 25 mm thickness (Cooked Halved Stacks).
(14) Cut Cooked Non-Halved and Halved Stacks in half to form Two single (4 Ft Width by 4 Ft length) Product.
(15) Trim 4 Ft Width Ends of Finished Product to 4 Ft Width.
(16) Rinse and wash Finished Product in clean, room temperature water while gently scrub washing with like material brushes.

Example #17

(1) Mix 44.86 Kg Ethylene Vinyl Acetate—two (or more) Separate Batches each with a Different Color,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 4 Ft Width by 8 Ft Length for Primary Color. Thin Lumps into 1 mm Sheets 4 Ft Width by 8 Ft Length for Secondary Color.
(4) Cool Sheets slowly to room temperature with non-contact water cooling system.
(5) Cut Sheets to Pieces 4 Ft Width by 8 Ft Length.
(6) Apply Silicone Spray to all surfaces of the (textured) Press Mold.
(7) Layer a combined 50 Primary and alternating Secondary Colored Pieces in Height in one or more Adjacent Stacks to form an Adjoined Pre-Cooked Stack centered in the Press Mold (with interior perimeter of the Press Mold exposed up to 50.0% of the surface area), and manually integrate by use of single direction motions.
(8) Cook Stack in Press for 28–35 Minutes at 160° C.–175° C.
(9) Remove Cooked Stack from Press Mold.
(10) Cook additional Stacks separately in Press Mold.
(11) Trim 8 Ft Length Ends of Cooked Stacks straight (e.g., at 45° angle) to Width Ends.
(12) Do Not Slice remaining Cooked Stacks in Half.
(13) Cut Cooked Non-Halved and Halved Stacks in half to form Two single (4 Ft Width by 4 Ft length) Product.
(14) Trim 4 Ft Width Ends of Finished Product to 4 Ft Width.
(15) Rinse and wash Finished Product in clean, room temperature water while gently scrub washing with like material brushes.

Example #18

(1) Mix 44.86 Kg Ethylene Vinyl Acetate—two (or more) Separate Batches each with a Different Color,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 4 Ft Width by 8 Ft Length.
(4) Cool Sheets slowly to room temperature with non-contact water cooling system.

(5) Cut Primary Colored Sheets to Pieces 4 Ft Width by 8 Ft Length. Cut Secondary Colored Sheets to smaller Pieces sufficient to form Secondary Colored single colored Spheres of all different colors and sizes up to 50 mm in Diameter.
(6) Apply Silicone Spray to all surfaces of the textured Press Mold.
(7) Layer 30–40 Primary Colored Pieces in Height in Adjacent Stacks to form an Adjoined Pre-Cooked Stack centered in the Press Mold (with interior perimeter of the Press Mold exposed up to 50.0% of the surface area).
(8) Cook Stack in Press for 2–5 Minutes at 160° C.–175° C. Open Press and Add Secondary Colored single colored Un-Cooked Spheres of all different colors and sizes up to 50 mm in Diameter (in any desired pattern) atop Primary Colored Pre-Cooked Stack, with weight and volume ratios of the Pre-Cooked Stack to Un-Cooked Spheres being closely equivalent. Cook Modified Stack in Press for 28–35 Minutes at 160° C.–175° C.
(9) Remove Cooked Stack from Press Mold.
(10) Cook additional Modified Stacks separately in Press Mold.
(11) Trim 8 Ft Length Ends of Cooked Stacks straight (e.g., at 90° angle or at 45° angle) to Width Ends.
(12) Slice remaining Cooked Stacks in Half to 25 mm (or other) thickness (Cooked Halved Stacks).
(13) Attach Cooked Halved Stacks end-to-end at Length Ends via cauterization to form an Extended Length Finished Product Mat.
(14) Trim 4 Ft Width Ends of Single Finished Product Halved Stack to 4 Ft Width. Rinse and wash Finished Product in clean, room temperature water while gently scrub washing with like material brushes.

Example #19

(1) Mix 44.86 Kg Ethylene Vinyl Acetate—two (or more) Separate Batches each with a Different Color,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C.
(3) Thin Lumps into 1 mm Sheets 4 Ft Width by 8 Ft Length.
(4) Cool Sheets slowly to room temperature with non-contact water cooling system.
(5) Cut Primary Colored Sheets to Pieces 4 Ft Width by 8 Ft Length. Cut single colored Secondary Colored Sheets to smaller Pieces of all different desired colors and sizes 1 Inch to 1 Ft Width by 1 Inch to 1 Ft Length.
(6) Apply Silicone Spray to all surfaces of the Press Mold.
(7) Layer 20 Primary Colored Pieces as desired between the equivalent of 30 Layers of detached single colored Secondary Colored smaller Pieces of all different desired colors and sizes for a combined total of 50 Layers in Height in one Adjacent Stack to form an Adjoined Pre-Cooked Modified Stack centered in the Press Mold (with interior perimeter of the Press Mold exposed up to 50.0% of the surface area).
(8) Cook Modified Stack in Press for 28–35 Minutes at 160° C.–175° C.
(9) Remove Cooked Stack from Press Mold.
(10) Cook additional Modified Stacks separately in Press Mold.
(11) Trim 8 Ft Length Ends of Cooked Stacks straight (e.g., at 90° angle) to Width Ends.
(12) Do Not slice skin off top or bottom of Cooked Stacks.
(13) Slice remaining Cooked Stacks in Half to 25 mm thickness (Cooked Halved Stacks).
(14) Do Not Attach for a single (4 Ft Width by 8 Ft length) Mat, to form an Extended Length Finished Product Mat.
(15) Trim 4 Ft Width Ends of Single Length Finished Product Halved Stack to 4 Ft Width.
(16) Rinse and wash Finished Product in clean, room temperature water while gently scrub washing with like material brushes.

Example #20

(1) Mix 44.86 Kg Ethylene Vinyl Acetate—Any Color,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.
(2) Cut (1) to 2 Kg Lumps and mix separately at 80° C.–100° C. [put Lumps into heated automated extruding machine.]
(3) Thin Lumps into 1 mm Sheets 4 Ft Width by 8 Ft Length.
(4) Cool Sheets slowly to room temperature with non-contact water cooling system.
(5) Cut Sheets to smaller Pieces sufficient to form single colored Sphere Lumps of sizes up to 50 mm in Diameter.
(6) Fill Sphere Halves in lower section of Press Mold with Sphere Lumps.
(7) Cook Sphere Halves in Press for 28–35 Minutes at 160° C.–175° C.
(8) Remove Cooked Sphere Halves from Press Mold.
(9) Cook additional Sphere Halves separately in Press Mold.
(10) Trim Sphere Halves straight.
(11) Do Not slice skin off top or bottom of Cooked Sphere Halves.
(12) Do Not slice Cooked Sphere Halves.
(13) Attach Cooked Sphere Halves to form Spheres via glue.
(14) Do Not Trim.
(15) Rinse and wash Finished Product in clean, room temperature water while gently scrub washing with like material brushes.

Example #21

(1) Mix 44.86 Kg Ethylene Vinyl Acetate—Any Color,
4.49 Kg Rubber,
2.06 Kg Vinyfor AC 7,
1.79 Kg Fusabond,
0.90 Kg Zinc Oxide, and
0.54 Kg Stearic Acid,
at 110° C.–130° C. for 15 Minutes; and mix
0.36 Kg Dicumyl Peroxide at 110° C.–130° C. for 3 Minutes;
mix at 100° C.–130° C. until concentrated to 20 mm thickness.

(2) Cut (1) to 2 Kg Lumps and mix separately at 80° C.–100° C.
(3) Thin Lump into 1 mm Sheets 4 Ft Width by 8 Ft Length.
(4) Cool Sheets slowly to room temperature with non-contact water cooling system.
(5) Cut Sheets to smaller Pieces sufficient to form single colored Sphere Lumps of sizes up to 50 mm in Diameter.
(6) Apply Silicone Spray to all surfaces of the textured Press Mold with desired Shaped Halves in lower section and flat surface on top section of Press Mold.
(7) Fill Shaped Halves in lower section of Press Mold with Sphere Lumps.
(8) Cook Shaped Halves in Press for 28–35 Minutes at 160° C.–175° C.
(9) Remove Cooked Shaped Halves from Press Mold.
(10) Cook additional Shaped Halves separately in Press Mold.
(11) Trim Shaped Halves straight.
(12) Do Not slice Cooked Shaped Halves.
(13) Attach Cooked Shaped Halves to form desired Shape Product via cauterization.
(14) DoNotTrim.
(15) Rinse and wash Finished Product in clean, room temperature water while gently scrubwashing with like material brushes.

Example #22

(1) Mix 40.79 Kg Ethylene Vinyl Acetate—Any Color,
4.08 Kg Rubber,
1.88 Kg Vinyfor AC 7,
1.63 Kg Fusabond,
0.82 Kg Zinc Oxide, and
0.49 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #23

(1) Mix 44.87 Kg Ethylene Vinyl Acetate—Any Color,
0.00 Kg Rubber,
1.88 Kg Vinyfor AC 7,
1.63 Kg Fusabond,
0.82 Kg Zinc Oxide, and
0.49 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #24

(1) Mix 42.83 Kg Ethylene Vinyl Acetate—Any Color,
2.04 Kg Rubber,
1.88 Kg Vinyfor AC 7,
1.63 Kg Fusabond,
0.82 Kg Zinc Oxide, and
0.49 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #25

(1) Mix 43.48 Kg Ethylene Vinyl Acetate—Any Color,
2.04 Kg Rubber,
1.88 Kg Vinyfor AC 7,
1.63 Kg Fusabond,
0.41 Kg Zinc Oxide, and
0.25 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #26

(1) Mix 45.19 Kg Ethylene Vinyl Acetate—Any Color,
0.00 Kg Rubber,
1.88 Kg Vinyfor AC 7,
1.63 Kg Fusabond,
0.41 Kg Zinc Oxide, and
0.425 Kg Stearic Acid,
at 110° C.–130° C. for 15 Minutes; and mix
0.65 Kg Dicumyl Peroxide at 110° C.–130° C. for 3 Minutes;
mix at 100° C.–130° C. until concentrated to 20 mm thickness.

Example #27

(1) Mix 36.71 Kg Ethylene Vinyl Acetate—Any Color,
8.16 Kg Rubber,
1.88 Kg Vinyfor AC 7,
1.63 Kg Fusabond,
0.82 Kg Zinc Oxide, and
0.49 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #28

(1) Mix 32.63 Kg Ethylene Vinyl Acetate—Any Color,
12.24 Kg Rubber,
1.88 Kg Vinyfor AC 7,
1.63 Kg Fusabond,
0.82 Kg Zinc Oxide, and
0.49 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #29

(1) Mix 31.32 Kg Ethylene Vinyl Acetate—Any Color,
12.24 Kg Rubber,
1.88 Kg Vinyfor AC 7,
1.63 Kg Fusabond,
1.63 Kg Zinc Oxide, and
0.98 Kg Stearic Acid,
at 110° C.–130° C. for 15 Minutes; and mix
0.33 Kg Dicumyl Peroxide at 110° C.–130° C. for 3 Minutes;

mix at 100° C.–130° C. until concentrated to 20 mm thickness.

Example #30

(1) Mix 30.02 Kg Ethylene Vinyl Acetate—Any Color,
12.24 Kg Rubber,
1.88 Kg Vinyfor AC 7,
1.63 Kg Fusabond,
2.45 Kg Zinc Oxide, and
1.47 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #31

(1) Mix 31.17 Kg Ethylene Vinyl Acetate—Any Color,
12.24 Kg Rubber,
1.26 Kg Vinyfor AC 7,
1.10 Kg Fusabond,
2.45 Kg Zinc Oxide, and
1.47 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #32

(1) Mix 43.99 Kg Ethylene Vinyl Acetate—Any Color,
0.00 Kg Rubber,
2.75 Kg Vinyfor AC 7,
2.06 Kg Fusabond,
0.55 Kg Zinc Oxide, and
0.33 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #33

(1) Mix 43.99 Kg Ethylene Vinyl Acetate—Any Color,
0.00 Kg Rubber,
2.75 Kg Vinyfor AC 7,
1.63 Kg Fusabond,
0.82 Kg Zinc Oxide, and
0.49 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #34

(1) Mix 43.99 Kg Ethylene Vinyl Acetate—Any Color,
0.00 Kg Rubber,
2.75 Kg Vinyfor AC 7,
2.28 Kg Fusabond,
0.41 Kg Zinc Oxide, and
0.25 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #35

(1) Mix 43.99 Kg Ethylene Vinyl Acetate—Any Color,
0.00 Kg Rubber,
2.75 Kg Vinyfor AC 7,
1.88 Kg Fusabond,
0.82 Kg Zinc Oxide, and
0.25 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #36

(1) Mix 43.67 Kg Ethylene Vinyl Acetate—Any Color,
0.00 Kg Rubber,
2.75 Kg Vinyfor AC 7,
1.63 Kg Fusabond,
0.82 Kg Zinc Oxide, and
0.49 Kg Stearic Acid,
at 110° C.–130° C. for 15 Minutes; and mix
0.65 Kg Dicumyl Peroxide at 110° C.–130° C. for 3 Minutes;
mix at 100° C.–130° C. until concentrated to 20 mm thickness.

Example #37

(1) Mix 44.48 Kg Ethylene Vinyl Acetate—Any Color,
0.00 Kg Rubber,
2.00 Kg Vinyfor AC 7,
2.00 Kg Fusabond,
0.55 Kg Zinc Oxide, and
0.33 Kg Stearic Acid,
at 110° C.–130° C. for 15 Minutes; and mix
0.65 Kg Dicumyl Peroxide at 110° C.–130° C. for 3 Minutes;
mix at 100° C.–130° C. until concentrated to 20 mm thickness.

Example #38

(1) Mix 44.80 Kg Ethylene Vinyl Acetate—Any Color,
0.00 Kg Rubber,
2.00 Kg Vinyfor AC 7,
2.00 Kg Fusabond,
0.55 Kg Zinc Oxide, and
0.33 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #39

(1) Mix 31.09 Kg Ethylene Vinyl Acetate—Any Color,
12.24 Kg Rubber,
1.41 Kg Vinyfor AC 7, 2.00 Kg Fusabond,
1.63 Kg Zinc Oxide, and
0.98 Kg Stearic Acid,
at 110° C.–130° C. for 15 Minutes; and mix
0.65 Kg Dicumyl Peroxide at 110° C.–130° C. for 3 Minutes;
mix at 100° C.–130° C. until concentrated to 20 mm thickness.

Example #40

(1) Mix 27.01 Kg Ethylene Vinyl Acetate—Any Color,
16.32 Kg Rubber,
1.41 Kg Vinyfor AC 7,
2.00 Kg Fusabond,
1.63 Kg Zinc Oxide, and
0.98 Kg Stearic Acid,
at 110° C.–130° C. for 15 Minutes; and mix
0.65 Kg Dicumyl Peroxide at 110° C.–130° C. for 3 Minutes;
mix at 100° C.–130° C. until concentrated to 20 mm thickness.

Example #41

(1) Mix 26.51 Kg Ethylene Vinyl Acetate—Any Color,
16.32 Kg Rubber,
1.41 Kg Vinyfor AC 7,
2.50 Kg Fusabond,
1.63 Kg Zinc Oxide, and
0.98 Kg Stearic Acid,
at 110° C.–130° C. for 15 Minutes; and mix
0.65 Kg Dicumyl Peroxide at 110° C.–130° C. for 3 Minutes;
mix at 100° C.–130° C. until concentrated to 20 mm thickness.

Example #42

(1) Mix 25.92 Kg Ethylene Vinyl Acetate—Any Color,
16.32 Kg Rubber,
2.00 Kg Vinyfor AC 7,
2.50 Kg Fusabond,
1.63 Kg Zinc Oxide, and
0.98 Kg Stearic Acid,
at 110° C.–130° C. for 15 Minutes; and mix
0.65 Kg Dicumyl Peroxide at 110° C.–130° C. for 3 Minutes;
mix at 100° C.–130° C. until concentrated to 20 mm thickness.

Example #43

(1) Mix 26.25 Kg Ethylene Vinyl Acetate—Any Color,
16.32 Kg Rubber,
2.00 Kg Vinyfor AC 7,
2.50 Kg Fusabond,
1.63 Kg Zinc Oxide, and
0.98 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #44

(1) Mix 25.44 Kg Ethylene Vinyl Acetate—Any Color,
16.32 Kg Rubber,
2.00 Kg Vinyfor AC 7,
2.00 Kg Fusabond,
2.45 Kg Zinc Oxide, and
1.47 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #45

(1) Mix 26.03 Kg Ethylene Vinyl Acetate—Any Color,
16.32 Kg Rubber,
1.41 Kg Vinyfor AC 7,
2.00 Kg Fusabond,
2.45 Kg Zinc Oxide, and
1.47 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #46

(1) Mix 44.18 Kg Ethylene Vinyl Acetate—Any Color,
0.00 Kg Rubber,
2.75 Kg Vinyfor AC 7,
2.25 Kg Fusabond,
0.41 Kg Zinc Oxide, and
0.25 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #47

(1) Mix 44.35 Kg Ethylene Vinyl Acetate—Any Color,
0.00 Kg Rubber,
2.75 Kg Vinyfor AC 7,
2.25 Kg Fusabond,
0.25 Kg Zinc Oxide, and
0.25 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #48

(1) Mix 44.31 Kg Ethylene Vinyl Acetate—Any Color,
0.00 Kg Rubber,
2.75 Kg Vinyfor AC 7,
2.25 Kg Fusabond,
0.41 Kg Zinc Oxide, and
0.12 Kg Stearic Acid,
at 110° C.–130° C. for 15 Minutes; and mix
0.16 Kg Dicumyl Peroxide at 110° C.–130° C. for 3 Minutes;

mix at 100° C.–130° C. until concentrated to 20 mm thickness.

Example #49

(1) Mix 44.40 Kg Ethylene Vinyl Acetate—Any Color,
0.00 Kg Rubber,
2.75 Kg Vinyfor AC 7,
2.25 Kg Fusabond,
0.20 Kg Zinc Oxide, and
0.20 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #50

(1) Mix 45.40 Kg Ethylene Vinyl Acetate—Any Color,
0.00 Kg Rubber,
2.00 Kg Vinyfor AC 7,
2.00 Kg Fusabond,
0.20 Kg Zinc Oxide, and
0.20 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #51

(1) Mix 25.60 Kg Ethylene Vinyl Acetate—Any Color,
16.32 Kg Rubber,
2.00 Kg Vinyfor AC 7,
2.00 Kg Fusabond,
2.45 Kg Zinc Oxide, and
1.47 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #52

(1) Mix 25.69 Kg Ethylene Vinyl Acetate—Any Color,
16.32 Kg Rubber,
1.75 Kg Vinyfor AC 7,
2.00 Kg Fusabond,
2.45 Kg Zinc Oxide, and
1.47 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #54

(1) Mix 26.44 Kg Ethylene Vinyl Acetate—Any Color,
16.32 Kg Rubber,
1.00 Kg Vinyfor AC 7,
2.00 Kg Fusabond,
2.45 Kg Zinc Oxide, and
1.47 Kg Stearic Acid,
at 110° C.–130° C. for 15 Minutes; and mix
0.33 Kg Dicumyl Peroxide at 110° C.–130° C. for 3 Minutes;
mix at 100° C.–130° C. until concentrated to 20 mm thickness.

Example #55

(1) Mix 26.10 Kg Ethylene Vinyl Acetate—Any Color,
16.32 Kg Rubber,
1.50 Kg Vinyfor AC 7,
2.00 Kg Fusabond,
2.45 Kg Zinc Oxide, and
1.47 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #56

(1) Mix 18.85 Kg Ethylene Vinyl Acetate—Any Color,
21.76 Kg Rubber,
2.50 Kg Vinyfor AC 7,
1.50 Kg Fusabond,
3.27 Kg Zinc Oxide, and
1.96 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #57

(1) Mix 19.35 Kg Ethylene Vinyl Acetate—Any Color,
21.76 Kg Rubber,
2.00 Kg Vinyfor AC 7,
1.50 Kg Fusabond,
3.27 Kg Zinc Oxide, and
1.96 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #58

(1) Mix 18.60 Kg Ethylene Vinyl Acetate—Any Color,
21.76 Kg Rubber,
2.75 Kg Vinyfor AC 7,
1.50 Kg Fusabond,
3.27 Kg Zinc Oxide, and
1.96 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #59

(1) Mix 18.81 Kg Ethylene Vinyl Acetate—Any Color,
21.76 Kg Rubber,
2.50 Kg Vinyfor AC 7, 1.00 Kg Fusabond,
3.27 Kg Zinc Oxide, and
2.50 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #60

(1) Mix 18.35 Kg Ethylene Vinyl Acetate—Any Color,
21.76 Kg Rubber,
3.00 Kg Vinyfor AC 7,
1.50 Kg Fusabond,
3.27 Kg Zinc Oxide, and
1.96 Kg Stearic Acid,
at 110° C.–130° C. for 15 Minutes; and mix
0.16 Kg Dicumyl Peroxide at I 10° C.–130° C. for 3 Minutes;
mix at 100° C.–130° C. until concentrated to 20 mm thickness.

Example #61

(1) Mix 13.91 Kg Ethylene Vinyl Acetate—Any Color,
27.20 Kg Rubber,
2.00 Kg Vinyfor AC 7,
1.50 Kg Fusabond,
3.27 Kg Zinc Oxide, and
1.96 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #62

(1) Mix 11.60 Kg Ethylene Vinyl Acetate—Any Color,
27.20 Kg Rubber,
3.00 Kg Vinyfor AC 7,
1.50 Kg Fusabond,
4.08 Kg Zinc Oxide, and
2.45 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #63

(1) Mix 11.10 Kg Ethylene Vinyl Acetate—Any Color,
27.20 Kg Rubber,
3.50 Kg Vinyfor AC 7,
1.50 Kg Fusabond,
4.08 Kg Zinc Oxide, and
2.45 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #64

(1) Mix 6.16 Kg Ethylene Vinyl Acetate—Any Color,
32.64 Kg Rubber,
3.00 Kg Vinyfor AC 7,
1.50 Kg Fusabond,
4.08 Kg Zinc Oxide, and
2.45 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #65

(1) Mix 4.86 Kg Ethylene Vinyl Acetate—Any Color,
32.64 Kg Rubber,
3.50 Kg Vinyfor AC 7,
1.00 Kg Fusabond,
4.90 Kg Zinc Oxide, and
2.94 Kg Stearic Acid,
at 110° C.–130° C. for 15 Minutes; and mix
0.16 Kg Dicumyl Peroxide at 110° C.–130° C. for 3 Minutes;
mix at 100° C.–130° C. until concentrated to 20 mm thickness.

Example #66

(1) Mix 44.75 Kg Ethylene Vinyl Acetate—Any Color,
0.00 Kg Rubber,
2.75 Kg Vinyfor AC 7,
2.00 Kg Fusabond,
0.15 Kg Zinc Oxide, and
0.15 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #67

(1) Mix 44.95 Kg Ethylene Vinyl Acetate—Any Color,
0.00 Kg Rubber,
2.75 Kg Vinyfor AC 7,
2.00 Kg Fusabond,
0.05 Kg Zinc Oxide, and
0.05 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #68

(1) Mix 44.75 Kg Ethylene Vinyl Acetate—Any Color,
0.00 Kg Rubber,
2.75 Kg Vinyfor AC 7,
2.00 Kg Fusabond,
0.20 Kg Zinc Oxide, and
0.10 Kg Stearic Acid,
at 110° C.–130° C. for 15 Minutes; and mix
0.20 Kg Dicumyl Peroxide at 110° C.–130° C. for 3 Minutes;

mix at 100° C.–130° C. until concentrated to 20 mm thickness.

Example #69

(1) Mix 45.55 Kg Ethylene Vinyl Acetate—Any Color,
0.00 Kg Rubber,
2.00 Kg Vinyfor AC 7,
2.00 Kg Fusabond,
0.20 Kg Zinc Oxide, and
0.10 Kg Stearic Acid,
at 110° C.–130° C. for 15 Minutes; and mix
0.15 Kg Dicumyl Peroxide at 110° C.–130° C. for 3 Minutes;
mix at 100° C.–130° C. until concentrated to 20 mm thickness.

Example #70

(1) Mix 45.90 Kg Ethylene Vinyl Acetate—Any Color,
0.00 Kg Rubber,
1.88 Kg Vinyfor AC 7,
1.63 Kg Fusabond,
0.20 Kg Zinc Oxide, and
0.20 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #71

(1) Mix 46.60 Kg Ethylene Vinyl Acetate—Any Color,
0.00 Kg Rubber,
1.40 Kg Vinyfor AC 7,
1.40 Kg Fusabond,
0.20 Kg Zinc Oxide, and
0.20 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #72

(1) Mix 46.05 Kg Ethylene Vinyl Acetate—Any Color,
0.00 Kg Rubber,
1.88 Kg Vinyfor AC 7,
1.63 Kg Fusabond,
0.20 Kg Zinc Oxide, and
0.10 Kg Stearic Acid,
at 110° C.–130° C. for 15 Minutes; and mix
0.15 Kg Dicumyl Peroxide at 110° C.–130° C. for 3 Minutes;
mix at 100° C.–130° C. until concentrated to 20 mm thickness.

EXAMPLE #73

(1) Mix 46.55 Kg Ethylene Vinyl Acetate—Any Color,
0.00 Kg Rubber,
1.50 Kg Vinyfor AC 7,
1.50 Kg Fusabond,
0.20 Kg Zinc Oxide, and
0.10 Kg Stearic Acid,
at 110° C.–130° C. for 15 Minutes; and mix
0.15 Kg Dicumyl Peroxide at 110° C.–130° C. for 3 Minutes;
mix at 100° C.–130° C. until concentrated to 20 mm thickness.

Example #74

(1) Mix 46.85 Kg Ethylene Vinyl Acetate—Any Color,
0.00 Kg Rubber,
1.40 Kg Vinyfor AC 7,
1.40 Kg Fusabond,
0.10 Kg Zinc Oxide, and
0.10 Kg Stearic Acid,
at 110° C.–130° C. for 15 Minutes; and mix
0.15 Kg Dicumyl Peroxide at 110° C.–130° C. for 3 Minutes;
mix at 100° C.–130° C. until concentrated to 20 mm thickness.

Example #75

(1) Mix 46.95 Kg Ethylene Vinyl Acetate—Any Color,
0.00 Kg Rubber,
1.30 Kg Vinyfor AC 7,
1.30 Kg Fusabond,
0.20 Kg Zinc Oxide, and
0.10 Kg Stearic Acid,
at 110° C.–130° C. for 15 Minutes; and mix
0.15 Kg Dicumyl Peroxide at 110° C.–130° C. for 3 Minutes;
mix at 100° C.–130° C. until concentrated to 20 mm thickness.

Example #76

(1) Mix 47.15 Kg Ethylene Vinyl Acetate—Any Color,
0.00 Kg Rubber,
1.20 Kg Vinyfor AC 7,
1.20 Kg Fusabond,
0.20 Kg Zinc Oxide, and
0.10 Kg Stearic Acid,
at 110° C.–130° C. for 15 Minutes; and mix
0.15 Kg Dicumyl Peroxide at 110° C.–130° C. for 3 Minutes;
mix at 100° C.–130° C. until concentrated to 20 mm thickness.

Example #77

(1) Mix 5.41 Kg Ethylene Vinyl Acetate—Any Color,
32.64 Kg Rubber,
3.50 Kg Vinyfor AC 7,
1.00 Kg Fusabond,
4.50 Kg Zinc Oxide, and
2.75 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #78

(1) Mix 5.31 Kg Ethylene Vinyl Acetate—Any Color,
32.64 Kg Rubber,
3.50 Kg Vinyfor AC 7,
1.00 Kg Fusabond,
4.50 Kg Zinc Oxide, and
2.75 Kg Stearic Acid,
at 110° C.–130° C. for 15 Minutes; and mix
0.30 Kg Dicumyl Peroxide at 110° C.–130° C. for 3 Minutes;
mix at 100° C.–130° C. until concentrated to 20 mm thickness.

Example #79

(1) Mix 5.21 Kg Ethylene Vinyl Acetate—Any Color,
32.64 Kg Rubber,
3.50 Kg Vinyfor AC 7,
1.00 Kg Fusabond,
4.50 Kg Zinc Oxide, and
2.75 Kg Stearic Acid,
at 110° C.–130° C. for 15 Minutes; and mix
0.40 Kg Dicumyl Peroxide at 110° C.–130° C. for 3 Minutes;
mix at 100° C.–130° C. until concentrated to 20 mm thickness.

Example #80

(1) Mix 6.16 Kg Ethylene Vinyl Acetate—Any Color,
32.64 Kg Rubber,
3.50 Kg Vinyfor AC 7,
1.00 Kg Fusabond,
4.50 Kg Zinc Oxide, and
2.00 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #82

(1) Mix 5.66 Kg Ethylene Vinyl Acetate—Any Color,
32.64 Kg Rubber,
3.50 Kg Vinyfor AC 7,
1.50 Kg Fusabond,
4.50 Kg Zinc Oxide, and
2.00 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #83

(1) Mix 0.00 Kg Ethylene Vinyl Acetate—Any Color,
39.30 Kg Rubber,
4.00 Kg Vinyfor AC 7,
0.50 Kg Fusabond,
4.00 Kg Zinc Oxide, and
2.00 Kg Stearic Acid,
at 110° C.–130° C. for 15 Minutes; and mix
0.20 Kg Dicumyl Peroxide at 110° C.–130° C. for 3 Minutes;
mix at 100° C.–130° C. until concentrated to 20 mm thickness.

Example #84

(1) Mix 0.00 Kg Ethylene Vinyl Acetate—Any Color,
38.80 Kg Rubber,
4.00 Kg Vinyfor AC 7,
1.00 Kg Fusabond,
4.00 Kg Zinc Oxide, and
2.00 Kg Stearic Acid,
at 110° C.–130° C. for 15 Minutes; and mix
0.20 Kg Dicumyl Peroxide at 100° C.–130° C. for 3 Minutes;
mix at 100° C.–130° C. until concentrated to 20 mm thickness.

B. Physical Properties of Seat, Backrest, or Both of the Present Invention

Firmness

Indentation Force Deflection values identified in the table below are a measurement guide of the firmness of the materials used (e.g., foam) in the seat 10 and the backrest 24. These values serve only as a guide to illustrate firmness as IFD values vary greatly. Different IFD values are obtained when a different percentage of deflection (i.e., other than 25% deflection) is used, when different test sample sizes are used, when different test sample thicknesses are use, when different types of materials are used (e.g., foam), or when different temperature and humidity factors are present during the measurement of the test sample.

In one embodiment, the various zones of the seat 10, the backrest 24, or both can have the following IFD ranges at 25% Deflection Use on a 20"×20"×4" thick sample measured in pounds per 50 inches squared:

| IFD Range at 25% Deflection Use (lbs/50 insq. on 4" thick sample) | Seat Zone | Firmness |
|---|---|---|
| 4–25 | Front Seat Zone/ Center Back Zone/ Head Zone | Plush |
| 26–40 | Seat Comfort Zone/ Pelvic Zone/ Lower Back Zone/ Backrest Comfort Zone/ | Medium/ Medium Firm |
| 41–80 | First Side Seat Zone/ Second Side Seat Zone/ Rear Seat Zone/ First Side Backrest Zone/ Second Side Backrest Zone | Firm/Extra Firm |

Example 85

In one example, a 20"20"×(stated sample thickness) of a particular material used (e.g., foam) in the front seat zone 14 of the seat 10, the center back zone 26, the head zone 36, or a combination thereof of the backrest 24, can have the following IFD values for a soft plush firmness:

| Sample Thickness (inches) | IFD at 25% Deflection Use (pounds/50 inches squared) |
|---|---|
| 1.0 | 5.1 |
| 2.0 | 7.0 |
| 3.0 | 9.5 |
| 4.0 | 12.5 |
| 5.0 | 16.25 |
| 6.0 | 20.0 |
| 7.0 | 24.75 |

A 20"×20"×(stated sample thickness) of a particular material used (e.g., foam) in the seat comfort zone 22, the pelvic zone 12, or both zones of the seat 10, the lower back zone 32, the backrest comfort zone 34, or a combination thereof of the zones of the backrest 24 can have the following IFD values for a soft medium or soft medium-firm firmness:

| Sample Thickness (inches) | IFD at 25% Deflection Use (pounds/50 inches squared) |
|---|---|
| 1.0 | 25.75 |
| 2.0 | 27.0 |
| 3.0 | 29.5 |
| 4.0 | 32.5 |
| 5.0 | 35.0 |
| 6.0 | 37.5 |
| 7.0 | 39.75 |

A 20"×20"×(stated sample thickness) of a particular material used (e.g., foam) in the first side seat zone 18, the second side seat zone 20, the rear seat zone 16, or a combination thereof of the seat 10, the first side backrest zone 28, the second side backrest zone 30, or a combination thereof of the backrest 24 can have the following IFD values for a soft firm or soft extra-firm firmness:

| Sample Thickness (inches) | IFD at 25% Deflection Use (pounds/50 inches squared) |
|---|---|
| 1.0 | 41.5 |
| 2.0 | 43.0 |
| 3.0 | 47.5 |
| 4.0 | 52.0 |
| 5.0 | 57.5 |
| 6.0 | 62.0 |
| 7.0 | 73.0 |

Example 86

In another example, a 20"×20"×(stated sample thickness) of a particular material used (e.g., foam) used in the front seat zone 14 of the seat 10, the center back zone 26, the head zone 36, or a combination thereof of the backrest 24, can have the following IFD values for a soft plush firmness:

| Sample Thickness (inches) | IFD at 25% Deflection Use (pounds/50 inches squared) |
|---|---|
| 1.0 | 4.1 |
| 2.0 | 4.75 |
| 3.0 | 5.25 |
| 4.0 | 5.75 |

-continued

| Sample Thickness (inches) | IFD at 25% Deflection Use (pounds/50 inches squared) |
|---|---|
| 5.0 | 6.5 |
| 6.0 | 7.0 |
| 7.0 | 8.2 |

A 20"×20"×(stated sample thickness) of a particular material used (e.g., foam) for the seat comfort zone 22, the pelvic zone 12, or a combination thereof of the seat 10, the lower back zone 32, the backrest comfort zone 34, or a combination thereof of the backrest 24 can have the following IFD values for a soft medium or soft medium-firm firmness:

| Sample Thickness (inches) | IFD at 25% Deflection Use (pounds/50 inches squared) |
|---|---|
| 1.0 | 26.0 |
| 2.0 | 26.5 |
| 3.0 | 27.0 |
| 4.0 | 27.25 |
| 5.0 | 28.5 |
| 6.0 | 28.75 |
| 7.0 | 29.0 |

A 20"×20"×(stated sample thickness) of a particular material used (e.g., foam) in the first side seat zone 18, the second side seat zone 20, the rear seat zone 16, or a combination thereof of the seat 10, the first side backrest zone 28, the second side backrest zone 30, or a combination thereof of the backrest 24 can have the following IFD values for a soft firm or soft extra-firm firmness:

| Sample Thickness (inches) | IFD at 25% Deflection Use (pounds/50 inches squared) |
|---|---|
| 1.0 | 41.0 |
| 2.0 | 43.0 |
| 3.0 | 44.0 |
| 4.0 | 44.75 |
| 5.0 | 45.5 |
| 6.0 | 46.5 |
| 7.0 | 47.5 |

Example 87

In another example, a 20"×20"×(stated sample thickness) of a particular material used (e.g., foam) in the front seat zone 14 of the seat 10, the center back zone 26, the head zone 36, or a combination thereof of the backrest 24, can have the following IFD values for a soft plush firmness:

| Sample Thickness (inches) | IFD at 25% Deflection Use (pounds/50 inches squared) |
|---|---|
| 1.0 | 18.0 |
| 2.0 | 19.0 |
| 3.0 | 20.5 |
| 4.0 | 21.75 |
| 5.0 | 22.5 |
| 6.0 | 23.75 |
| 7.0 | 24.5 |

A 20"×20"×(stated sample thickness) of a particular foam used for the seat comfort zone 22, the pelvic zone 12, or a combination thereof of the seat 10, the lower back zone 32, the backrest comfort zone 34, or a combination thereof of the backrest 24 can have the following IFD values for a soft medium or soft medium-firm firmness:

| Sample Thickness (inches) | IFD at 25% Deflection Use (pounds/50 inches squared) |
|---|---|
| 1.0 | 35 |
| 2.0 | 36.25 |
| 3.0 | 37 |
| 4.0 | 38 |
| 5.0 | 38.9 |
| 6.0 | 39.0 |
| 7.0 | 40.5 |

A 20"×20"×(stated sample thickness) of a particular material used (e.g., foam) used in the first side seat zone 18, the second side seat zone 20, the rear seat zone 16, or a combination thereof of the seat 10, the first side backrest zone 28, the second side backrest zone 30, or a combination thereof of the backrest 24 can have the following IFD values for a soft firm or soft extra-firm firmness:

| Sample Thickness (inches) | IFD at 25% Deflection Use (pounds/50 inches squared) |
|---|---|
| 1.0 | 56.0 |
| 2.0 | 59.0 |
| 3.0 | 64.0 |
| 4.0 | 68.5 |
| 5.0 | 72.0 |
| 6.0 | 74.0 |
| 7.0 | 76.0 |

Support

The support factor for a particular material used (e.g., foam) is the ratio of 65% IFD divided by 25% IFD. The support factor of the seat 10 can have a range of about 1.0 and 3.5. The higher the support factor number, the greater the ability the material (e.g., foam) has to provide support. For greatest comfort, the support factor can be selected to maximize cradling which allows a person to sit into the cushion rather than on top of it. As the thickness of the cushion material increases, a lower support factor can be used to improve cradling and to achieve a more even distribution of body weight.

In one example, a 20"×20"×(stated sample thickness) of a particular material used (e.g., foam) in the front seat zone 14 of the seat 10, the center back zone 26, the head zone 36 or combination thereof of the backrest 24 can have the following Support Factors for a soft plush firmness with IFD values of 25% deflection use and 65% deflection use:

Example 88

| Sample Thickness (inches) | IFD at 25% Deflection Use (pounds/50 inches squared) | IFD at 65% Deflection Use (pounds/50 inches squared) | Support Factor |
|---|---|---|---|
| 1.0 | 5.0 | 10.0 | |
| 2.0 | | | |
| 2.0 | 6.5 | 12.35 | 1.9 |
| 3.0 | 8.5 | 15.3 | 1.8 |
| 4.0 | 11.0 | 18.7 | 1.7 |
| 5.0 | 14.0 | 21.0 | 1.5 |
| 6.0 | 17.5 | 22.75 | 1.3 |
| 7.0 | 22.0 | 26.4 | 1.2 |

A 20"×20"×(stated sample thickness) of a particular material used (e.g., foam) in the seat comfort zone 22, the pelvic zone 12 or a combination thereof of the seat 10, the lower back zone 32, the backrest comfort zone 34, or a combination thereof of the backrest 24 can have the following Support Factors for a soft medium or soft medium-firm firmness with IFD values of 25% deflection use and 65% deflection use:

| Sample Thickness (inches) | IFD at 25% Deflection Use (pounds/50 inches squared) | IFD at 65% Deflection Use (pounds/50 inches squared) | Support Factor |
|---|---|---|---|
| 1.0 | 25.5 | 68.85 | |
| 2.7 | | | |
| 2.0 | 26.5 | 68.9 | 2.6 |
| 3.0 | 28.5 | 71.25 | 2.5 |
| 4.0 | 31.0 | 74.4 | 2.4 |
| 5.0 | 33.75 | 77.63 | 2.3 |
| 6.0 | 36.75 | 80.85 | 2.2 |
| 7.0 | 40.0 | 84.0 | 2.1 |

A 20"×20"×(stated sample thickness) of a particular material used (e.g., foam) in the first side sat zone 18, the second side seat zone 20, the rear seat zone 16, or a combination thereof of the seat 10, the first side backrest zone 28, the second side backrest zone 30 or a combination thereof of the backrest 24 can have the following Support Factors for a soft firm or soft extra-firm firmness with IFD values of 25% deflection use and 65% deflection use with the following.

| Sample Thickness (inches) | IFD at 25% Deflection Use (pounds/50 inches squared) | IFD at 65% Deflection Use (pounds/50 inches squared) | Support Factor |
|---|---|---|---|
| 1.0 | 42.0 | 142.8 | 3.4 |
| 2.0 | 45.5 | 150.15 | 3.3 |
| 3.0 | 49.5 | 158.4 | 3.2 |
| 4.0 | 54.5 | 168.95 | 3.1 |
| 5.0 | 60.0 | 180.0 | 3.0 |
| 6.0 | 66.5 | 192.85 | 2.9 |
| 7.0 | 70.0 | 196.0 | 2.8 |

Example 89

In one example, a 20"×20"×(stated sample thickness) of a particular material used (e.g., foam) in the front seat zone 14 of the seat 10, the center back zone 26, the head zone 36 or a combination thereof of the backrest 24 can have the following Support Factors for a soft plush firmness with IFD values of 25% deflection use and 65% deflection use:

| Sample Thickness (inches) | IFD at 25% Deflection Use (pounds/50 inches squared) | IFD at 25% Deflection Use (pounds/50 inches squared) | Support Factor |
|---|---|---|---|
| 1.0 | 4.0 | 7.6 | 1.9 |
| 2.0 | 4.5 | 8.1 | 1.8 |
| 3.0 | 5.25 | 8.4 | 1.6 |
| 4.0 | 6.0 | 8.4 | 1.4 |
| 5.0 | 7.0 | 9.1 | 1.3 |
| 6.0 | 7.75 | 8.53 | 1.2 |
| 7.0 | 8.5 | 8.5 | 1.0 |

A 20"×20"×(stated sample thickness) of a material used (e.g., foam) in the seat comfort zone 22, the pelvic zone 12 or a combination thereof of the seat 10, the lower back zone 32, the backrest comfort zone 34, or a combination thereof of the backrest 24 can have the following Support Factors for a soft medium or soft medium-firm firmness with IFD values of 25% deflection use and 65% deflection use:

| Sample Thickness (inches) | IFD at 25% Deflection Use (pounds/50 inches squared) | IFD at 65% Deflection Use (pounds/50 inches squared) | Support Factor |
|---|---|---|---|
| 1.0 | 26.25 | 72.19 | 2.75 |
| 2.0 | 26.75 | 72.2 | 2.7 |
| 3.0 | 27.25 | 70.85 | 2.6 |
| 4.0 | 27.5 | 68.75 | 2.5 |
| 5.0 | 27.75 | 67.99 | 2.45 |
| 6.0 | 28.5 | 65.55 | 2.3 |
| 7.0 | 29.25 | 64.35 | 2.2 |

A 20"×20"×(stated sample thickness) of a particular material used (e.g., foam) in the first side sat zone 18, the second side seat zone 20, the rear seat zone 16, or a combination thereof of the seat 10, the first side backrest zone 28, the second side backrest zone 30 or a combination thereof of the backrest 24 can have the following Support Factors for a soft firm or soft extra-firm firmness with IFD values of 25% deflection use and 65% deflection use:

| Sample Thickness (inches) | IFD at 25% Deflection Use (pounds/50 inches squared) | IFD at 65% Deflection Use (pounds/50 inches squared) | Support Factor |
|---|---|---|---|
| 1.0 | 41.0 | 143.5 | 3.5 |
| 2.0 | 41.25 | 140.25 | 3.4 |
| 3.0 | 41.75 | 137.78 | 3.3 |
| 4.0 | 42.25 | 130.98 | 3.1 |
| 5.0 | 43.0 | 126.85 | 2.95 |
| 6.0 | 43.75 | 124.69 | 2.85 |
| 7.0 | 44.5 | 123.71 | 2.78 |

Example 90

In one example, a 20"×20"×(stated sample thickness) of a particular material used (e.g., foam) in the front seat zone 14 of the seat 10, the center back zone 26, the head zone 36 or a combination thereof of the backrest 24 can have the following Support Factors for a soft plush firmness with IFD values of 25% deflection use and 65% deflection use:

| Sample Thickness (inches) | IFD at 25% Deflection Use (pounds/50 inches squared) | IFD at 65% Deflection Use (pounds/50 inches squared) | Support Factor |
|---|---|---|---|
| 1.0 | 20.75 | 41.5 | 2.0 |
| 2.0 | 21.0 | 39.9 | 1.9 |
| 3.0 | 22.0 | 40.7 | 1.85 |
| 4.0 | 23.0 | 40.25 | 1.75 |
| 5.0 | 23.75 | 38 | 1.6 |
| 6.0 | 24.25 | 36.38 | 1.5 |
| 7.0 | 25.0 | 32.5 | 1.3 |

A 20"×20"×(stated sample thickness) of a particular material used (e.g., foam) in the seat comfort zone 22, the pelvic zone 12 or a combination thereof of the seat 10, the lower back zone 32, the backrest comfort zone 34, or a combination thereof of the backrest 24 can have the following Support Factors for a soft medium or soft medium-firm firmness with IFD values of 25% deflection use and 65% deflection use:

| Sample Thickness (inches) | IFD at 25% Deflection Use (pounds/50 inches squared) | IFD at 65% Deflection Use (pounds/50 inches squared) | Support Factor |
|---|---|---|---|
| 1.0 | 34.5 | 93.2 | 2.7 |
| 2.0 | 35.25 | 95.2 | 2.7 |
| 3.0 | 36.5 | 94.9 | 2.6 |
| 4.0 | 37.5 | 95.6 | 2.55 |
| 5.0 | 38.25 | 91.8 | 2.4 |
| 6.0 | 39.25 | 90.28 | 2.3 |
| 7.0 | 40.25 | 90.56 | 2.25 |

A 20"×20"×(stated sample thickness) of a particular material used (e.g., foam) in the first side sat zone 18, the second side seat zone 20, the rear seat zone 16, or a combination thereof of the seat 10, the first side backrest zone 28, the second side backrest zone 30 or a combination thereof of the backrest 24 can have the following Support Factors for a soft firm or soft extra-firm firmness with IFD values of 25% deflection use and 65% deflection use:

| Sample Thickness (inches) | IFD at 25% Deflection Use (pounds/50 inches squared) | IFD at 65% Deflection Use (pounds/50 inches squared) | Support Factor |
|---|---|---|---|
| 1.0 | 58.25 | 203.88 | 3.5 |
| 2.0 | 60.0 | 207.0 | 3.45 |
| 3.0 | 61.5 | 202.95 | 3.3 |
| 4.0 | 62.5 | 200.0 | 3.2 |
| 5.0 | 63.75 | 191.25 | 3.0 |
| 6.0 | 64.5 | 190.28 | 2.95 |
| 7.0 | 65.75 | 184.1 | 2.8 |

Ideally, the firmness of the seat 10 construction should be matched to the firmness of the backrest 24 construction or the comfort of the system can be negatively affected. Accordingly, the ratio of firmness of the seat 10 to the backrest 24 can be about 1.

Resilience

The resilience or "springiness" of the materials used in the seat 10 (e.g., foam) can vary from zone to zone. For example, the front seat zone 14 of the seat 10 can have a ball-rebound of at least 5%, at least 10%, or at least 15%. For example, the seat comfort zone 22, the first side seat zone 18, the second side seat zone 20, the rear seat zone 16 or a combination thereof of the seat 10 can have a ball-rebound of at least 20%, at least 25%, or at least 30%. For example, the pelvic zone 12 of the seat 10 can have a ball-rebound of at least 40%, at least 50%, at least 60%, or at least 70%.

The resilience or "springiness" of the materials used in the backrest 24 (e.g., foam) can vary from zone to zone. For example, the center back zone 26, the head zone 36 or a combination thereof of the backrest 24 can have a ball-rebound of at least 5%, at least 10%, or at least 15%. For example, the backrest comfort zone 34, the first side backrest zone 28, the second side backrest zone 30 or a combination thereof of the backrest 24 can have a ball-rebound of at least 20%, at least 25%, or at least 30%. For example, the lower back zone 32 of the backrest 24 can have a ball-rebound of at least 40%, at least 50%, at least 60%, or at least 70%.

Further, the pelvic zone 12 of the seat 10, the lower back zone of the backrest 24, or both can include an elastic material (e.g., foam) that can be elastic in the lateral direction, the longitudinal direction, or biaxially elastic in both the lateral direction and the longitudinal direction. For example, the pelvic zone 12 of the seat 10, the lower back zone of the backrest 24, or both can be stretched, transversely and/or longitudinally, by at least 5% (to at least 75% of the initial (unstretched) width and/or length). For example, the pelvic zone 12 of the seat 10, the lower back zone of the backrest 24, or both can be stretched, transversely and/or longitudinally, by at least 25% (to at least 100% of the initial unstretched width or length). For example, the pelvic zone 12 of the seat 10, the lower back zone of the backrest 24, or both can be stretched, transversely and/or longitudinally, by at least 60% (to at least 150% of the initial unstretched width or length). For example, the pelvic zone 12 of the seat 10, the lower back zone of the backrest 24, or both can be stretched, transversely and/or longitudinally, by at least 100% (to at least 200% of the initial unstretched width or length).

Density

The density of the materials used in the seat 10, the backrest 24, or both, (e.g., foam) affects the durability of the material and its ability to provide support and comfort. The seat 10, the backrest 24, or both, can utilize materials (e.g., foam) with different densities to provide a desired support, comfort and durability for a particular zone. Generally, the higher the density of the material used (e.g., foam), the greater its durability. The greater the durability, the better the material can retain its original properties to provide support and comfort.

The density of the material used in the seat 10, backrest 24, or both (e.g., foam) are independent of the firmness of the material used in the seat 10, the backrest 24, or both (e.g., foam). For example, the front seat zone 14 of the seat 10 can include a low density foam, a high density foam, or a combination thereof and maintain a soft plush firmness with low elastic properties. The seat comfort zone 22, the pelvic zone 12, or a combination thereof of the seat 10 can include a low density foam, a high density foam, or a combination thereof and maintain a soft medium to medium firm firmness with elastic properties. The first side seat zone 18, the second side seat zone 20, the rear seat zone 16 or a combination thereof of the seat 10 can include a low density foam, a high density foam, or a combination thereof and maintain a soft firm to extra firm firmness with high elastic properties.

The center back zone 26, the head zone 36 or a combination thereof of the backrest 24 can include a low density foam, a high density foam, or a combination thereof and maintain a soft plush firmness with low elastic properties. The lower back zone 32, the backrest comfort zone 34 or a combination thereof of the backrest 24 can include a low density foam, a high density foam, or a combination thereof and maintain a soft medium to medium firm firmness with elastic properties. The first side backrest zone 28, the second side backrest zone 30 or a combination thereof of the backrest 24 can include a low density foam, a high density foam, or a combination thereof and maintain a soft firm to extra firm feel with highly elastic properties.

In one embodiment, the materials used in the seat 10, backrest 24, or both (e.g., foam) disclosed herein can have a density or specific gravity greater than, equal to, or less than that of liquid water, at a specified temperature (e.g., 4° C.). For example, the materials used to manufacture the various zones of the seat 10 (e.g., foam) can have a density or specific gravity less than that of liquid water, at a specified temperature (e.g., 4° C.). For example, liquid water has a density of about 1.00 g/mL at about 4° C., a density of about 0.98 g/mL at about 65° C., a density of about 0.97 g/mL at about 83° C., and a density of about 0.96 g/mL at about 97° C. Additionally, materials used to manufacture the various zones of seat 10 (e.g., foam) can have a relative density of up to about 0.90 of liquid water, a relative density of up to about 0.80 of liquid water, a relative density of up to about 0.70 of liquid water, or a relative density of up to about 0.60 of liquid water. In one embodiment, the materials used to manufacture the various zones of seat 10, the backrest 24, or both (e.g., foam) can float on water.

In another embodiment, the materials used in the seat 10, the backrest 24, or both (e.g., foam) can have a density of about 0.5 pcf to about 7.0 pcf.

The application further provides a method of making seat 10, the backrest 24, or both. The method includes mixing at least two compositions, placing the at least two compositions at specific locations in a mold until the mold is filled and placing the filled mold into a hot press. The mold can be filled to a percentage of less than one hundred percent of the volume of a mold (e.g., 20% or 50%), a percentage of one hundred percent of the volume of a mold, or a percentage of greater than one hundred percent of the volume of a mold (e.g., 120%).

The mold can include different sections. Each section can independently be filled to a percentage of less than one hundred percent of the volume of a mold section (e.g., 20% or 50%), a percentage of one hundred percent of the volume of a mold section, or a percentage of greater than one hundred percent of the volume of a mold section (e.g., 120%).

Different compositions can be mixed and prepared separately and then placed and/or extruded into a specific pre-prepared mold (e.g., a seat mold or backrest mold) at specific locations within the mold in order to eventually join sections of different compositions into eventually one multi-composition until the mold is filled. The filled mold containing the multi-composition piece including the adjoined sections of different compositions are placed in a hot press for an adequate period of time (e.g., 5 minutes to about 45 minutes) at a range of temperatures (e.g., 100° C. to about 240° C.).

The material (e.g., foam) can further be densified by being felted. Felting includes the addition of heat and compression to create a material that can dampen vibration or absorb shock.

What is claimed is:

1. A seat comprising:

a seat comfort zone that peripherally encompasses a pelvic zone;

a front seat zone adjacent to a front side of the seat comfort zone; and a first side seat zone, second side seat zone and rear seat zone peripherally encompassing a first side, second side and rear side, respectively, of the seat comfort zone;

wherein the seat comfort zone, the pelvic zone, the first side seat zone, the second side seat zone, the front seat zone, and the rear seat zone include a soft elastic material;

wherein the front seat zone is less firm than the first side seat zone, the second side seat zone, the rear seat zone, the seat comfort zone and the pelvic zone; the first side seat zone, the second side seat zone and the rear seat zone are more firm than the front seat zone, the seat comfort zone and the pelvic zone; and the pelvic zone is more elastic than the front seat zone, the comfort zone, the first side seat zone, the second side seat zone and the rear seat zone;

wherein the soft elastic material is a continuous, one piece seamless material; and which seat comprises at least two compositions which form one multi-composition seat when said at least two compositions are placed or extruded into specific locations of a mold until the mold is filled, and the filled mold is heated.

2. The seat of claim 1 further comprising a backrest angularly connected to an area distal to the front seat zone.

3. The seat of claim 1 wherein the soft elastic material includes polyurethane foam, shredded foam, High Resilience foam, rubber, latex foam rubber, down, polyester, cotton, or a combination thereof.

4. The seat of claim 1 that further comprising a seat covering that covers the seat.

5. The seat of claim 4 wherein the seat covering includes non-woven fabrics, woven fabrics, knitted cloth, vinyl, leather, or a combination thereof.

6. The seat of claim 1 wherein the seat comfort zone, the pelvic zone, the front seat zone, the first side seat zone, the second side seat zone, the rear seat zone, or a combination thereof include an Indentation Force Deflection of about 4 to about 80 pounds per 50 inches squared at 25% deflection on a 20"×20"×4" thick sample.

7. The seat of claim 1 wherein the front seat zone includes an Indentation Force Deflection of about 4 to about 25 pounds per 50 inches squared at 25% deflection on a 20"×20"×4" thick sample.

8. The seat of claim 1 wherein the seat comfort zone, the pelvic zone, or a combination thereof include an Indentation Force Deflection of about 26 to about 40 pounds per 50 inches squared at 25% deflection on a 20"×20"×4" thick sample.

9. The seat of claim 1 wherein the first side seat zone, the second size seat zone, the rear seat zone, or a combination thereof of include an Indentation Force Deflection of about 41 to about 80 pounds per 50 inches squared at 25% deflection on a 20"×20"×4" thick sample.

10. The seat of claim 1 wherein the seat comfort zone, the pelvic zone, the front seat zone, the first side seat zone, the second side seat zone, the rear seat zone include, or a combination thereof include a Support Factor of about 1.0 to about 3.5.

11. The seat of claim 1 wherein the front seat zone has a resilience of at least 5%.

12. The seat of claim 1 wherein the front seat zone has a resilience of at least 10%.

13. The seat of claim 1 wherein the front seat zone has a resilience of at least 15%.

14. The seat of claim 1 wherein the seat comfort zone, the first side seat zone, the second side seat zone, the rear seat zone, or a combination thereof have a resilience of at least 20%.

15. The seat of claim 1 wherein the seat comfort zone, the first side seat zone, the second side seat zone, the rear seat zone, or a combination thereof have a resilience of at least 25%.

16. The seat of claim 1 wherein the seat comfort zone, the first side seat zone, the second side seat zone, the rear seat zone, or a combination thereof have a resilience of at least 30%.

17. The seat of claim 1 wherein the pelvic zone has a resilience of at least 40%.

18. The seat of claim 1 wherein the pelvic zone has a resilience of at least 50%.

19. The seat of claim 1 wherein the pelvic zone has a resilience of at least 60%.

20. The seat of claim 1 wherein at least one of the seat comfort zone, the pelvic zone, the front seat zone, the first side seat zone, the second side seat zone and the rear seat zone is manufactured from foam cushion formed from: (a) at least one of rubber and a resin; (b) a blowing agent; (c) a polymeric adhesion modifier; (d) a decomposition accelerating agent, and (e) a cross-linking agent.

21. The seat of claim 1 wherein at least one of the seat comfort zone, the pelvic zone, the front seat zone, the first side seat zone, the second side seat zone and the rear seat zone is manufactured from foam cushion formed from: (a) at least one of natural rubber and an ethylene-vinyl acetate (EVA) copolymer; (b) azodicarbonamide (AC);(c) a polymeric adhesion modifier; (d) dicumyl peroxide; and (e) a combination of zinc oxide and stearic acid.

22. The seat of claim 1 wherein at least one of the seat comfort zone, the pelvic zone, the front seat zone, the first side seat zone, the second side seat zone and the rear seat zone is manufactured from foam cushion formed from: (a) natural rubber present in about 5 wt. % to about 12 wt. % of the foam cushion; (b) an ethylene-vinyl acetate (EVA) copolymer present in about 79 wt. % to about 83 wt. % of the foam cushion; (c) azodicarbonamide (AC) present in about 3 wt. % to about 4.2 wt. % of the foam cushion; (d) a polymeric adhesion modifier present in about 2.8 wt. % to about 3.9 wt. % of the foam cushion; (e) dicumyl peroxide present in about 0.5 wt. % to about 0.9 wt. % of the foam cushion; and (f) a combination of zinc oxide and stearic acid, wherein the zinc oxide is present in about 1.0 wt. % to about 2.2 wt. % of the foam cushion.

23. A seat comprising:

a seat comfort zone that peripherally encompasses a pelvic zone;

a front seat zone adjacent to a front side of the seat comfort zone;

a first side seat zone, second side seat zone and rear seat zone peripherally encompassing a first side and second opposite side of the seat comfort zone;

a backrest angularly connected to an area distal to the front seat zone, the backrest further comprising:

a lower back zone that peripherally encompasses a center back zone on two opposite sides;

a backrest comfort zone peripherally encompassing the lower back zone and the center back zone;

a first side backrest zone and second side backrest zone peripherally encompassing a first side and second opposite side of the backrest comfort zone; and a head zone distal to the seat;

wherein the seat comfort zone, the pelvic zone, the first side seat zone, the second side seat zone, the front seat zone, the rear seat zone, the center back zone, the lower back zone, the backrest comfort zone, the head zone, the first side backrest zone and the second side backrest zone include a soft elastic material; and wherein the front seat zone is less firm than the first side seat zone, the second side seat zone, the rear seat zone, the seat comfort zone and the pelvic zone; the first side seat zone, the second side seat zone and the rear seat zone are more firm than the front seat zone, the seat comfort zone and the pelvic zone; and the pelvic zone is more elastic than the front seat zone, the comfort zone, the first side seat zone, the second side seat zone and the rear seat zone;

wherein the center back zone and the head zone are less firm than the lower back zone;

the backrest comfort zone, the first side backrest zone and the second side backrest zone; the first side backrest zone and the second side backrest zone are more firm than the center back zone, the head zone, the lower back zone and the backrest comfort zone; and the lower back zone is more elastic than the center back zone, the head zone, the backrest comfort zone, the first side backrest zone and the second side backrest zone;

wherein the soft elastic material is a continuous, one piece seamless material; and which seat comprises at least two compositions which form one multi-composition seat when said at least two compositions are placed or extruded into specific locations of a mold until the mold is filled, and the filled mold is heated.

24. The seat of claim 23 wherein said at least two compositions are placed into the mold.

25. The seat of claim 23 wherein said at least two compositions are extruded into the mold.

26. The seat of claim 23 wherein the soft elastic material includes polyurethane foam, shredded foam, High Resilience foam, latex foam rubber, down, polyester, cotton, or a combination thereof.

27. The seat of claim 23 that includes a covering that covers the seat, the backrest, or both.

28. The seat of claim 27 wherein the covering includes non-woven fabrics, woven fabrics, knitted cloth, vinyl, leather, or a combination thereof.

29. The seat of claim 23 wherein the seat comfort zone, the pelvic zone, the front seat zone, the first side seat zone, the second side seat zone, the rear seat zone, the center back zone the head zone, the lower back zone, the backrest comfort zone, the first side backrest zone, the second side backrest zone, or a combination thereof include an Indentation Force Deflection of about 4 to about 80 pounds per 50 inches squared at 25% deflection on a 20"×20"×4" thick sample.

30. The seat of claim 23 wherein the front seat zone, the center back zone, the head zone, or a combination thereof include an Indentation Force Deflection of about 4 to about 25 pounds per 50 inches squared at 25% deflection on a 20"×20"×4" thick sample.

31. The seat of claim 23 wherein the seat comfort zone, the pelvic zone, the lower back zone, the backrest comfort zone, or a combination thereof include an Indentation Force Deflection of about 26 to about 40 pounds per 50 inches squared at 25% deflection on a 20"×20"×4" thick sample.

32. The seat of claim 23 wherein the first side seat zone, the second size seat zone, the rear seat zone, the first side backrest zone, the second side backrest zone, or a combination thereof include an Indentation Force Deflection of about 41 to about 80 pounds per 50 inches squared at 25% deflection on a 20"×20"×4" thick sample.

33. The seat of claim 23 wherein the seat comfort zone, the pelvic zone, the front seat zone, the first side seat zone, the second side seat zone, the rear seat zone, or a combination thereof include a Support Factor of about 1.0 to about 3.5.

34. The seat of claim 23 wherein the front seat zone, the center back zone, the head zone, or a combination thereof have a resilience of at least 5%.

35. The seat of claim 23 wherein the front seat zone, the center back zone, the head zone, or a combination thereof have a resilience of at least 10%.

36. The seat of claim 23 wherein the front seat zone, the center back zone, the head zone, or a combination thereof have a resilience of at least 15%.

37. The seat of claim 23 wherein the seat comfort zone, the backrest comfort zone, the first side seat zone, the second side seat zone, the rear seat zone, the first side backrest zone, the second side backrest zone or a combination thereof have a resilience of at least 20%.

38. The seat of claim 23 wherein the seat comfort zone, the backrest comfort zone, the first side seat zone, the second side seat zone, the rear seat zone, the first side backrest zone, the second side backrest zone or a combination thereof have a resilience of at least 25%.

39. The seat of claim 23 wherein the seat comfort zone, the backrest comfort zone, the first side seat zone, the second side seat zone, the rear seat zone, the first side backrest zone, the second side backrest zone or a combination thereof have a resilience of at least 30%.

40. The seat of claim 23 wherein the pelvic zone, the lower back zone, or a combination thereof have a resilience of at least 40%.

41. The seat of claim 23 wherein the pelvic zone, the lower back zone, or a combination thereof have a resilience of at least 50%.

42. The seat of claim 23 wherein the pelvic zone, the lower back zone, or a combination thereof have a resilience of at least 60%.

43. The seat of claim 23 wherein at least one of the seat comfort zone, the backrest comfort zone, the first side seat zone, the second side seat zone, the rear seat zone, the first side backrest zone, and the second side backrest zone is manufactured from foam cushion formed from: (a) at least one of rubber and a resin; (b) a blowing agent; (c) a polymeric adhesion modifier; (d) a decomposition accelerating agent, and (e) a cross-linking agent.

44. The seat of claim 23 wherein at least one of the seat comfort zone, the backrest comfort zone, the first side seat zone, the second side seat zone, the rear seat zone, the first side backrest zone, and the second side backrest zone is manufactured from foam cushion formed from: (a) at least one of natural rubber and an ethylene-vinyl acetate (EVA) copolymer; (b) azodicarbonamide (AC); (c) a polymeric adhesion modifier; (d) dicumyl peroxide; and (e) a combination of zinc oxide and stearic acid.

45. The seat of claim 23 wherein at least one of the seat comfort zone, the backrest comfort zone, the first side seat zone, the second side seat zone, the rear seat zone, the first side backrest zone, and the second side backrest zone is manufactured from foam cushion formed from: (a) natural rubber present in about 5 wt. % to about 12 wt. % of the foam cushion; (b) an ethylene-vinyl acetate (EVA) copolymer present in about 79 wt. % to about 83 wt. % of the foam cushion; (c) azodicarbonamide (AC) present in about 3 wt. % to about 4.2 wt. % of the foam cushion; (d) a polymeric adhesion modifier present in about 2.8 wt. % to about 3.9 wt. % of the foam cushion; (e) dicumyl peroxide present in about 0.5 wt. % to about 0.9 wt. % of the foam cushion; and (f) a combination of zinc oxide and stearic acid, wherein the zinc oxide is present in about 1.0 wt. % to about 2.2 wt. % of the foam cushion and stearic acid is present in about 0.5 wt. % to about 1.25 wt. % of the foam cushion.

46. A seat comprising:

a seat comfort zone that peripherally encompasses a pelvic zone;

a front seat zone adjacent to a front side of the seat comfort zone;

a first side seat zone, second side seat zone and rear seat zone peripherally encompassing a first side and second opposite side of the seat comfort zone;

a backrest angularly connected to an area distal to the front seat zone, the backrest further comprising:

a lower back zone that peripherally encompasses a center back zone on two opposite sides;

a backrest comfort zone peripherally encompassing the lower back zone and the center back zone;

a first side backrest zone and second side backrest zone peripherally encompassing a first side and second opposite side of the backrest comfort zone; and a head zone distal to the seat;

wherein the seat comfort zone, the pelvic zone, the first side seat zone, the second side seat zone, the front seat zone, the rear seat zone, the center back zone, the lower back zone, the backrest comfort zone, the head zone, the first side backrest zone and the second side backrest zone include a soft elastic material; and wherein the front seat zone is less firm than the first side seat zone, the second side seat zone, the rear seat zone, the seat comfort zone and the pelvic zone; the first side seat zone, the second side seat zone and the rear seat zone are more firm than the front seat zone, the seat comfort zone and the pelvic zone; and the pelvic zone is more elastic than the front seat zone, the comfort zone, the first side seat zone, the second side seat zone and the rear seat zone;

wherein the center back zone and the head zone are less firm than the lower back zone, the backrest comfort zone, the first side backrest zone and the second side backrest zone; the first side backrest zone and the second side backrest zone are more firm than the center back zone, the head zone, the lower back zone and the backrest comfort zone; and the lower back zone is more elastic than the center back zone, the head zone, the backrest comfort zone, the first side backrest zone and the second side backrest zone;

wherein at least one of the seat comfort zone, the backrest comfort zone, the first side seat zone, the second side seat zone, the rear seat zone, the first side backrest zone, and the second side backrest zone is manufactured from foam cushion formed from: (a) at least one of rubber and a resin; (b) a blowing agent; (c) a polymeric adhesion modifier; (d) a decomposition accelerating agent, and (e) a cross-linking agent; and which seat comprises at least two compositions which form one multi-composition seat when said at least two compositions are placed or extruded into specific locations of a mold until the mold is filled, and the filled mold is heated.

47. The seat of claim 46 wherein said at least two compositions are placed into the mold.

48. The seat of claim 46 wherein said at least two compositions are extruded into the mold.

49. The seat of claim 46 wherein at least one of the seat comfort zone, the backrest comfort zone, the first side seat zone, the second side seat zone, the rear seat zone, the first side backrest zone, and the second side backrest zone is manufactured from foam cushion formed from: (a) at least one of natural rubber and an ethylene-vinyl acetate (EVA) copolymer; (b) azodicarbonamide (AC); (c) a polymeric adhesion modifier; (d) dicumyl peroxide; and (e) a combination of zinc oxide and stearic acid.

50. The seat of claim 46 wherein at least one of the seat comfort zone, the backrest comfort zone, the first side seat zone, the second side seat zone, the rear seat zone, the first side backrest zone, and the second side backrest zone is manufactured from foam cushion formed from: (a) natural rubber present in about 5 wt. % to about 12 wt. % of the foam cushion; (b) an ethylene-vinyl acetate (EVA) copolymer present in about 79 wt. % to about 83 wt. % of the foam cushion; (c) azodicarbonamide (AC) present in about 3 wt. % to about 4.2 wt. % of the foam cushion; (d) a polymeric adhesion modifier present in about 2.8 wt. % to about 3.9 wt. % of the foam cushion; (e) dicumyl peroxide present in about 0.5 wt. % to about 0.9 wt. % of the foam cushion; and (f) a combination of zinc oxide and stearic acid, wherein the zinc oxide is present in about 1.0 wt. % to about 2.2 wt. % of the foam cushion and stearic acid is present in about 0.5 wt. % to about 1.25 wt. % of the foam cushion.

51. The seat of claim 1 wherein said at least two compositions are placed into the mold.

52. The seat of claim 1 wherein said at least two compositions are extruded into the mold.

* * * * *

UNITED STATES PATENT AND TRADEMARK OFFICE

CERTIFICATE OF CORRECTION

PATENT NO. : 7,040,706 B2
APPLICATION NO. : 10/731876
DATED : May 9, 2006
INVENTOR(S) : Koffler It is certified that error appears in the above-identified patent and that said Letters Patent is hereby corrected as shown below:

On Title Page, in field (56), under "U.S. Patent Documents", in column 1, line 37, after "6,625,830" delete "B1" and insert -- B2 --, therefor.

On Title Page, in field (56), under "Other Publications", in column 2, line 46, delete "Munich :" and insert -- Munich; --, therefor.

On Title Page, in field (56), under "Other Publications", in column 2, line 46, after "New York :" delete "New York :". (Repeated Words)

On Title Page, in field (56), under "Other Publications", in column 2, lines 48–49, delete "(Phosphorus)" and insert -- (Phosphorous) --, therefor.

On Title Page, in field (56), under "Other Publications", in column 2, line 54, delete "engineering:" and insert -- engineering; --, therefor.

On Title Page, in field (56), under "Other Publications", in column 2, line 3, delete "Co.,," and insert -- Co., --, therefor.

On Title Page, in field (56), under "Other Publications", in column 2, line 6, delete "Co." and insert -- Co., --, therefor.

In column 1, line 4, after "60/432,181" insert -- , --.

In column 5, line 53, delete "Nordelg" and insert -- Nordel® --, therefor.

In column 6, line 18, delete "AquaStike" and insert -- AuqaStik® --, therefor.

In column 6, line 23, delete "DeraKaneg" and insert -- DeraKane® --, therefor.

In column 6, line 29, delete "Thermoplasitic" and insert -- Thermoplastic --, therefor.

In column 8, line 37, delete "polyeythylenes," and insert -- polyethylenes, --, therefor.

In column 12, line 65, delete "phospaphe nanthrene" and insert
-- phosphaphenanthrene --, therefor.

In column 15, line 67, delete "(e.g. foam)" and insert -- (e.g., foam) --, therefor.

In column 17, line 25, delete "below:" and insert -- below. --, therefor.

UNITED STATES PATENT AND TRADEMARK OFFICE

CERTIFICATE OF CORRECTION

PATENT NO. : 7,040,706 B2
APPLICATION NO. : 10/731876
DATED : May 9, 2006
INVENTOR(S) : Koffler It is certified that error appears in the above-identified patent and that said Letters Patent is hereby corrected as shown below:

In column 26, line 7, after “Procedures” insert -- : --.

In column 27, line 16, delete “fusabondÒ” and insert -- fusabond --, therefor.

In column 34, line 44, delete “100° C.” and insert -- 110° C. --, therefor.

In column 41, line 22, delete “DoNotTrim.” and insert -- Do Not Trim. --, therefor.

In column 49, line 19, delete “I 10° C.” and insert -- 110° C. --, therefor.

In column 54, line 16, delete “100° C.” and insert -- 110° C. --, therefor.

In column 54, line 63, delete “20"20"” and insert -- 20"x20" --, therefor.

In column 55, line 55, after “foam)” delete “used”.

In column 57, line 26, after “foam)” delete “used”.

In column 58, line 41, delete “sat” and insert -- seat --, therefor.

In column 58, line 47, delete “following.” and insert -- following: --, therefor.

In column 59, line 6, delete “25%” and insert -- 65% --, therefor.

In column 59, line 40, delete “sat” and insert -- seat --, therefor.

UNITED STATES PATENT AND TRADEMARK OFFICE

CERTIFICATE OF CORRECTION

PATENT NO. : 7,040,706 B2
APPLICATION NO. : 10/731876
DATED : May 9, 2006
INVENTOR(S) : Koffler It is certified that error appears in the above-identified patent and that said Letters Patent is hereby corrected as shown below:

In column 60, line 41, delete “sat” and insert -- seat --, therefor.

In column 63, line 62, in Claim 9, delete “size” and insert -- side --, therefor.

In column 65, line 57, in Claim 29, after “zone” insert -- , --.

In column 66, line 7, in Claim 32, delete “size” and insert -- side --, therefor.

Signed and Sealed this

Twenty-sixth Day of September, 2006

JON W. DUDAS
*Director of the United States Patent and Trademark Office*